US006566028B2

(12) United States Patent
Tazawa et al.

(10) Patent No.: US 6,566,028 B2
(45) Date of Patent: May 20, 2003

(54) TONER, AND PROCESS FOR PRODUCING TONER

(75) Inventors: Yayoi Tazawa, Mishima (JP); Takeshi Ikeda, Kawasaki (JP); Yoshinobu Baba, Yokohama (JP); Hitoshi Itabashi, Yokohama (JP); Yuzo Tokunaga, Yokohama (JP); Yasukazu Ayaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/819,067

(22) Filed: Jul. 16, 2001

(65) Prior Publication Data

US 2002/0197551 A1 Dec. 26, 2002

Related U.S. Application Data

(62) Division of application No. 09/443,133, filed on Nov. 18, 1999, now Pat. No. 6,358,658.

(30) Foreign Application Priority Data

| | | |
|---|---|---|
| Nov. 18, 1998 | (JP) | 10-328654 |
| Nov. 18, 1998 | (JP) | 10-328655 |
| Jul. 1, 1999 | (JP) | 11-188208 |
| Jul. 1, 1999 | (JP) | 11-188209 |

(51) Int. Cl.[7] ..... G03G 5/00

(52) U.S. Cl. ..... 430/137.11; 430/110.1; 430/111.1

(58) Field of Search ..... 430/137.11, 110.1, 430/111.1

(56) References Cited

U.S. PATENT DOCUMENTS

| | | | | |
|---|---|---|---|---|
| 4,758,491 | A | 7/1988 | Alexandrovich et al. | 430/110 |
| 4,950,573 | A | 8/1990 | Yamaguchi et al. | 430/109 |
| 5,102,763 | A | 4/1992 | Winnik et al. | 430/110 |

FOREIGN PATENT DOCUMENTS

| | | |
|---|---|---|
| DE | 3739217 | 6/1988 |
| JP | 06-289647 | 10/1994 |
| JP | 07-098516 | 4/1995 |
| JP | 07-181722 | 7/1995 |
| JP | 07-239573 | 9/1995 |
| JP | 08-015894 | 1/1996 |
| JP | 08-095284 | 4/1996 |
| JP | 09-179341 | 7/1997 |

OTHER PUBLICATIONS

Database WPI, Section Ch, Week 199508, Derwent Publ., AN 1995–057697 XP–002130712 (corresponds to JP 06–337543).

Patent Abstracts of Japan, vol. 14, No. 78 (P–1006), Feb. 1990 (corresponds to JP 01–293354.

Database WPI, Section Ch, Week 199526, Derwent Publ., AN 1995–197126, XP–002131015 (corresponds to JP 07–114213).

*Primary Examiner*—Mark A. Chapman

(74) *Attorney, Agent, or Firm*—Fitzpatrick, Cella, Harper & Scinto

(57) ABSTRACT

A toner is comprised of toner particles composed of at least a binder resin and a clorant, wherein the toner particles each have a coating layer formed on their surfaces in a state of particulate matters being stuck to one another. The particulate matters contains at least a silicon compound.

52 Claims, No Drawings

TONER, AND PROCESS FOR PRODUCING TONER

This is a division of application Ser. No. 09/443,133 filed Nov. 18, 1999 now U.S. Pat. No. 6,358,658.

BACKGROUND OF THE INVENTION

1. Field of the Invention

This invention relates to a toner for developing electrostatic images or a toner for forming toner images in a toner-jet type image forming method, and a process for producing the toner. More particularly, this invention relates to a toner used preferably in a system where toner images formed by toner are heat-and-pressure fixed to printing sheets such as transfer mediums, and a process for producing such a toner.

2. Related Background Art

In electrostatic development, the system is so set up that toner particles charged electrostatically develop an electrostatic latent image formed on a photosensitive drum, by the aid of an electrostatic force acting in accordance with potential differences on the drum. Here, the toner particles are charged electrostatically by the friction between toner particles themselves or between toner particles and carrier particles. In order to cause this friction in a good efficiency and uniformly, it is important to make the toner retain a fluidity.

For such purpose, as methods commonly used to impart a fluidity to toners, a method is well known in which fluidity-providing agents such as inorganic fine particles as typified by silica, titania or alumina particles or organic fine particles comprised of polymeric compounds are externally added to toner particles surfaces. Also, the method of adding such fluidity-providing agent has many alternatives. For example, it is common to use a method in which the fluidity-providing agent is made to adhere to the surfaces of toner particles by the aid of electrostatic force, or van der Waals force, acting between toner particles and the fluidity-providing agent. This method of making the fluidity-providing agent adhere to the surfaces of toner particles is carried out using a stirrer or mixer.

In the above method, however, it is not easy to make the fluidity-providing agent adhere to the surfaces of toner particles in a uniformly dispersed state. Also, fluidity-providing agent particles not adhering to the toner particles may mutually form agglomerates, which are included in the toner in what is called a free state. It is difficult to avoid the presence of such free additives. In such a case, the fluidity of toner may decrease to cause, e.g., a decrease in quantity of triboelectricity, so that it may become impossible to attain a sufficient image density or inversely images with much fog may become formed. In addition, in conventional cases the fluidity-providing agent adheres to the surfaces of toner particles only by the aid of electrostatic force or van der Waals force as stated above. Hence, when continuous copying is made, the fluidity-providing agent may come off the surfaces of toner particles or become buried in toner particles increasingly, bringing about a problem that image quality attained at the initial stage of running can not be maintained at the latter half of continuous copying.

As a method of imparting the fluidity to toner without use of any fluidity-providing agent, a method is known in which, as disclosed in Japanese Patent Application Laid-open No. 7-181722, fine wax particles are made to stick to the surfaces of toner particles and are provided on their outer sides with polysiloxane layers obtained by polycondensation of an aminosilane alkoxide and an alkylalkoxysilane, and a method, as disclosed in Japanese Patent Application Laid-open No. 8-95284, a toner is obtained by polymerizing a monomer system to which an organosilane compound has been added. The toners obtainable by these methods, however, have smooth toner particle surfaces, and hence have had the problem of causing a lowering of transfer efficiency.

In addition, in the field of electrophotography, it has recently been more strongly required to form images with a higher image quality. Then, as a means for achieving a high image quality of images, toners used in developers may be made to have a sharp charge quantity distribution. When toners have a sharp charge quantity distribution, individual toner particles constituting the toner can be charged in a uniform quantity. Hence, images formed may have less fog or black spots around images and it becomes possible to reproduce toner images faithful to latent images formed on the photosensitive drum. In general, the charge quantity of toner particles is proportional to the particle diameter of toner particles. Accordingly, in order to make the toner have a sharp charge quantity distribution, it is thought to be effective to make the toner have a sharp particle size distribution. In order to impart electric charge to toner particles in a sufficient quantity, commonly employed is a method of adding what is called external additives such as inorganic fine particles as typified by silica, titania or alumina particles or organic fine particles comprised of polymeric compounds.

Since, however, it is common for such external additives to be made to stick mechanically to the surfaces of toner particles by means of a stirrer or mixer, the external additive may become released from toner particles or inversely become buried in toner particles. Such a phenomenon may occur especially when continuous printing is made. Then, this phenomenon may cause a change in the surface state of toner particles. Hence, when images are formed, it may become difficult to continuously maintain the charge quantity of toner kept at the running initial stage, and become difficult to maintain the initial sharp charge quantity distribution during the running. The external additives have had such problems.

Moreover, in recent years, with a surprising spread of personal computers, the demand for printers and copying machines employing electrophotographic systems shows a tendency of expanding from those for offices toward those for general users. With such a tendency, these printers and copying machines of electrophotographic systems are sought to be made small-sized as apparatus, to achieve energy saving for ecological requirement and to be made low-cost. As a method of settling these subjects, fixing temperature may be made lower. As a means for its achievement, it is attempted that binder resins constituting toners are made to have a lower molecular weight or a lower glass transition point (Tg), or waxes are incorporated into toner particles in a larger content.

Making binder resins have a lower molecular weight or have a lower glass transition point (Tg) can make melting temperature lower. However, such toners may concurrently have a poor storage stability to cause in-machine melt adhesion, or mutual melt adhesion of toner particles to have a low fluidity, especially in an environment of high temperature.

To solve such problems, methods are proposed in which silane compounds are used. For example, Japanese Patent Application Laid-open No. 7-98516 discloses a method in which a polyester resin and a metal alkoxide are kneaded and cross-linked. Also, Japanese Patent Application Laid-open No. 7-239573 discloses a method in which a vinyl type resin formed by covalent linkage of a vinyl monomer and a silane coupling agent having an unsaturated double bond and an alkoxysilyl group is used as a binder resin. In these methods, however, the binder resin is compositionally limited, or silane compounds are present even inside the toner particles. Thus, it has substantially been difficult to control fixing performance and storage stability which are performances conflicting with each other.

There are other methods. For example, Japanese Patent Application Laid-open No. 6-289647 discloses a method in which toner particles are coated with a curable silicone resin; Japanese Patent Application Laid-open No. 8-15894, a method in which a metal alkoxide is made to adhere to the surfaces of toner particles; and Japanese Patent Application Laid-open No. 9-179341, a method in which toner particles are provided with covering in the form of continuous thin films using a silane coupling agent. These methods are attempts to prepare base particles by the use of a resin having a relatively low Tg and coating their surfaces with a hard material such as a silicone resin or a metal alkoxide so that toner particles can be prevented from blocking and at the same time fixing temperature can be made lower. The surfaces of toner particles, however, are not well covered with the silane compound or, even when covered, the surfaces of coating layers are smooth, and hence the toner particles have small contact areas on fixing members such as a heat roll and may have a poor heat absorption efficiency, resulting in a great difference between the Tg and an actual melting temperature of the base particles. Thus, it has been difficult to achieve satisfactory low-temperature fixing.

SUMMARY OF THE INVENTION

An object of the present invention is to provide a toner having a superior fluidity even without use of any fluidity-providing agent and yet can attain a high transfer efficiency, and a process for producing such a toner.

Another object of the present invention is to provide a toner making use of no fluidity-providing agent so as to provide a toner which no longer has any possibility that the fluidity-providing agent becomes released from or buried in toner particles, even when development is repeated continuously, can maintain a stable image density even after long-time running, and has a superior fixing performance, and a process for producing such a toner.

A still another object of the present invention is to provide a toner that can maintain its sharp charge quantity distribution throughout running of long-time image reproduction, whereby high-quality images having less fog and black spots around images and having a high dot reproducibility can stably be obtained, and a process for producing such a toner.

A further object of the present invention is to provide a toner having superior anti-blocking properties in spite of its good low-temperature fixing performance, and a process for producing such a toner.

To achieve the above objects, the present invention provides a toner comprising toner particles composed of at least a binder resin and a colorant, wherein the toner particles each have a coating layer formed on their surfaces in a state of particulate matters being stuck to one another; the particulate matters containing at least a silicon compound.

The present invention also provides a process for producing a toner, comprising the steps of;

producing toner particles composed of at least a binder resin and a colorant; and building up a polycondensate of a silicon compound on the surfaces of the toner particles from the outside of the particles to form on each toner particle surface a coating layer in a state of particulate matters being stuck to one another; the particulate matters containing at least a silicon compound.

The present invention still also provides a process for producing a toner, comprising the steps of;

producing toner particles composed of at least a binder resin and a colorant and having a silicon compound present internally; and allowing the toner particles to react in an aqueous medium selected from the group consisting of water and a mixed solvent of water and a water-miscible solvent, to cause the silicon compound to undergo hydrolysis and polycondensation on the surfaces of the toner particles to form on each toner particle surface a coating layer in a state of particulate matters being stuck to one another; the particulate matters containing at least the silicon compound.

DESCRIPTION OF THE PREFERRED EMBODIMENTS

The toner of the present invention is characterized in that the surfaces of toner particles composed of at least a binder resin and a colorant, constituting the toner, are each provided with a coating layer formed in a state of particulate matters being stuck to one another, containing at least a silicon compound. In the present invention, the coating layer formed in a state of particulate matters being stuck to one another, containing at least a silicon compound, refers specifically to a layer formed on each toner particle surface by hydrolysis and polycondensation of a silicon compound typified by a silane alkoxide, and preferably a layer so formed that fine unevenness on the order of nanometer (nm) is observable on the surface.

As a result of extensive studies, the present inventors have discovered that a toner provided with a sufficient fluidity can be obtained without use of any conventional external additive when the above coating layer formed in a state of particulate matters being stuck to one another, containing at least a silicon compound, is provided on each surface of the toner particles composed of at least a binder resin and a colorant. Thus, they have accomplished the present invention. It has been found that this enables the toner to retain a stable charging performance. It has also been found that, since no external additive is used, the toner no longer has any possibility that the fluidity-providing agent becomes released from or buried in toner particles, even when development is repeated continuously, and promises a superior running performance.

"The coating layer formed in a state of particulate matters being stuck to one another, containing at least a silicon compound" provided on the toner particle surface will be described in detail.

As a result of studies made on the state of particle surface of the toner having good performances as stated above, the present inventors have reached the following findings. First, cross sections of particles constituting the toner of the present invention were observed with a transmission electron microscope (TEM). This enabled observation of how a layer structure is formed which is constituted of particulate matters with a diameter of tens of nanometers (nm) each.

The surface configuration of toner particles before and after the washing of toner with a surface-active agent was further examined by electron probe microanalysis (EPMA)

using a scanning electron microscope (SEM) fitted with an X-ray microanalyzer. As a result, obtained was the result that the percent loss of silicon atoms that results from the washing was small. It was also ascertainable that the particulate matters containing a silicon compound do not merely adhere to the toner particle surface but are present in such a state that the particulate matters are stuck to one another to from a coating layer.

The layer structure of the coating layer which is a requirement constituting the present invention, formed on the toner particle surface in a state of particulate matters being stuck to one another, containing at least a silicon compound, (hereinafter often "coating layer formed of silicon-compound-containing particulate matters being stuck to one another") is ascertained in the manner described below in detail.

In the present invention, the fact that the coating layers formed on toner particle surfaces are in a state of particulate matters being stuck to one another, containing at least a silicon compound, is ascertained in the following way.

Coating Layer Formed of Silicon-Compound-Containing Particulate Matters Being Stuck to one Another:

To Ascertain the Presence of the Layer Structure by Observation with a Transmission Electron Microscope:

Particles of toner to be examined are buried in epoxy resin, and thereafter ultra-thin slices of the particles of toner are prepared using a microtome. The slices are fastened to a measuring cell for the transmission electron microscope. This is used as a sample.

The sample is observed with a transmission electron microscope H-7500 (manufactured by Hitachi Ltd.) at 10,000 to 50,000 magnifications to ascertain that the layer structure formed of the particulate matters is present on the toner particle surface.

To ascertain the particulate matters being stuck to one another, on the basis of the percent loss of silicon atoms present on the particle surfaces of toner after washing with a surface-active agent:

(1) Measurement by Electron Probe Microanalysis (EPMA) to Determine the Quantity (% by Weight) of Silicon Atoms Present on Particle Surfaces of Toner:

The particle surfaces of the toner are examined by means of a field-emission scanning electron microscope S-4500 (manufactured by Hitachi Ltd.) fitted with an X-ray microanalyzer X-5770W (manufactured by Horiba Seisakusho K. K.) to make electron probe microanalysis (EPMA) under conditions of an accelerating voltage of 20 kV, a sample absorption electric current of $1.0\times10^{-10}$ A and 25,000 magnifications. Quantity (concentration) Sil (% by weight) of silicon atoms present thereon where the total sum of quantities (% by weight) of carbon atoms, oxygen atoms and silicon atoms is regarded as 100% is measured. The measurement is made in 20 visual fields, and an average value thereof is regarded as a measured value.

(2) Washing Particle Surfaces of Toner with Surface-Active Agent:

0.2 g of toner is dispersed in 5 ml of an aqueous 5% by weight dodecylbenzenesulfonic acid solution. The dispersion obtained is set on an ultrasonic cleaner for 30 minutes to wash the particle surfaces of the toner thoroughly. Centrifugal separation and washing are further repeated to remove the dodecylbenzenesulfonic acid completely from the particle surfaces of the toner, followed by drying under reduced pressure to separate the toner.

(3) Measurement of the Quantity (% by Weight) of Silicon Atoms Present on Particle Surfaces of Toner After Washing with Surface-Active Agent:

To measure the quantity (% by weight) of silicon atoms which had been present on the particle surfaces of the toner and has been removed therefrom as a result of the above operation (2), the particle surfaces of the toner having been washed with the surface-active agent are examined by electron probe microanalysis (EPMA) in the same manner as in the above (1), to measure a quantity Si2 (% by weight) of silicon atoms present.

(4) Analysis of the State of the Coating Layer Provided on the Toner Particle Surface and Formed of Particulate Matters Containing a Silicon Compound:

From the values of Si1 and Si2 obtained by the above procedure of (1) to (3), the percent loss of the quantity of silicon atoms present on the toner particles, resulting from the washing with surface-active agent, is calculated according to the following expression. In an instance where the percent loss of the quantity of silicon atoms present on the particle surfaces of the toner is extremely small, the coating layer formed on the toner particle surface, formed of the particulate matters containing a silicon compound, can be judged to stand adherent in such a state that it may come off the particle surface with difficulty. Accordingly, in an instance where the percent loss of the quantity of silicon atoms present on the particle surfaces of the toner, calculated according to the following expression, is not more than 30%, the coating layer formed on the toner particle surface is regarded as a layer in which the particulate matters containing a silicon compound stand stuck firmly to one another. This is used as means for ascertaining whether or not the particulate matters containing a silicon compound stand stuck to one another.

$$\text{Percent loss (\%) of quantity of silicon atoms present on particles} = (1-Si2/Si1)\times100$$

(wherein Si1 represents a quantity of silicon atoms present on particle surfaces of toner before the washing with surface-active agent, and Si2 represents a quantity of silicon atoms present on particle surfaces of toner after the washing with surface-active agent.)

As described above, in the present invention, the result obtained by visually ascertaining with a transmission electron microscope the layer structure formed of particulate matters is combined with the result obtained by measuring the percent loss of silicon atoms on the particle surfaces of the toner after the washing with surface-active agent. This combination is used as means for ascertaining "the coating layer formed in a state of particulate matters being stuck to one another, containing at least a silicon compound".

As ascertained by the above method, in the toner of the present invention, the coating layers present on the toner particles constituting the toner are each formed of particulate matters being stuck to one another, containing at least a silicon compound. Thus, it follows that fine unevenness is present on the toner particle surfaces. This enables achievement of a high transfer efficiency. Also, in the present invention, the coating layers are formed on the toner particle surfaces by a silicon compound polycondensate produced by a sol-gel process described later as a typical example of a toner production process. According to this process, the polycondensate takes the form of a film, and also the film has the form of a coating layer which covers the whole of each toner particle surface as a film formed in a state where particulate matters containing a polycondensate of a silicon compound are chemically combined with one another. Hence, there is no room for any free fine particles not adhering to toner particles or any free fine particles due to deterioration by running which are ascribable to the addition of fluidity-providing agent as in the case when the conventional fluidity-providing agent such as silica is made to adhere to toner particle surfaces as stated previously. Thus, the toner of the present invention can have a superior running performance.

Detailed studies made by the present inventors have revealed that, when the quantity of silicon atoms present on the particle surfaces of the toner is measured by electron probe microanalysis (EPMA), the quantity of their presence may preferably be in the range of from 0.10 to 20.0% by weight, more preferably in the range of from 0.1 to 10.0% by weight, and still more preferably in the range of from 0.10 to 4.0% by weight, to obtain a coating layer in a more preferred state. More specifically, it has been confirmed that a higher fluidity and a high transfer efficiency can be imparted to the toner when the surfaces of toner particles are provided with coating layers formed of particulate matters being stuck to one another, containing such a silicon compound that may provide the quantity of silicon atoms present on the particle surfaces of toner which is at least 0.10% by weight. Also, when the quantity of silicon atoms present on the toner particle surfaces provided with such coating layers is at least 0.10% by weight, the toner particle surfaces can be covered sufficiently with such coating layers. Hence, a higher fluidity can be imparted to the toner, and a toner that can be charged in a sufficient quantity can be obtained.

Meanwhile, it has been fount that the toner exhibits a better fixing performance when the coating layer is so provided that the quantity of silicon atoms present on the particle surfaces of the toner is not more than 20.0% by weight. This is presumably because the binder resin constituting the toner particles well exhibits its thermoplasticity when the toner particles are provided with the coating layers in which the quantity of silicon atoms present on the particle surfaces of the toner fulfills the above conditions.

In the present invention, the surfaces of toner particles serving as base particles are provided with the specific coating layers as described above. Hence, the binder resin constituting the toner can be made to have a lower melt temperature and can be improved in fixing performance. Even a toner having such a form does not cause, even in an environment of high temperature, any in-machine melt-adhesion or any mutual melt-adhesion of toner which may cause a lowering of fluidity. Thus, a toner simultaneously satisfying the function to promise a good storage stability can be obtained.

The toner having such a superior fixing performance may preferably be so constituted that it has at least one glass transition point at temperatures of 60° C. or below, has a melt-starting temperature of 100° C. or below, and also has a difference of 38° C. or smaller between the glass transition point and the melt-starting temperature.

In the case of the toner constituted as described above, preferable coating layers can be obtained when the quantity of silicon atoms present on the particle surfaces of the toner as measured by electron probe microanalysis (EPMA) is in the range of from 0.10 to 10.0% by weight, and preferably in the range of from 0.10 to 4.0% by weight.

Since the surfaces of toner particles are provided with the coating layers formed of particulate matters being stuck to one another, containing such a silicon compound that may provide the quantity of silicon atoms present on the particle surfaces of toner which is at least 0.10% by weight, it becomes possible for sol-gel films to envelop toner particles well, showing superior anti-blocking properties, as so presumed. On the other hand, if the quantity of silicon atoms present on toner particle surfaces provided with the coating layers formed of silicon-compound-containing particulate matters being stuck to one another is less than 0.10% by weight, this means that sol-gel films are present on the particle surfaces in a small quantity, so that the sol-gel films cover the toner particles insufficiently, resulting in damage of anti-blocking properties of the toner.

Where the coating layers are so provided that the quantity of silicon atoms present on the particle surfaces of the toner is not more than 10.0% by weight, the toner particles can retain a good fixing performance. More specifically, when such coating layers are formed, the thermoplasticity of the binder resin constituting the toner particles is by no means damaged by providing the coating layers, and can be well exhibited.

In addition, since the coating layers formed on the surfaces of toner particles are formed of at least silicon-compound-containing particulate matters being stuck to one another, the surfaces of toner particles constituting the toner have fine unevenness as stated previously. This makes surface areas of toner particles larger, and hence fixing members such as a heat roll and the toner have a larger contact area, bringing about an improvement in heat absorption efficiency. As the result, compared with toners comprising toner particles having coating layers which are conventionally formed for the purpose of anti-blocking properties, a difference may less be produced between the Tg and melt-starting temperature of the toner particles and those of the toner. Hence, a sufficiently low-temperature fixing performance can be achieved.

In addition, as stated previously, the coating layers provided on the toner particle surfaces are formed by building up a polycondensate of a silicon compound by a sol-gel process described later as a typical example. The polycondensate takes the form of a film, and the film having the form of a coating layer in which the film formed in a state where particulate matters containing a polycondensate of a silicon compound are chemically combined with one another covers the whole of each toner particle surface. Hence, the surfaces of toner particles in which the binder resin having a low glass transition point and promising a good low-temperature fixing performance is used as the chief component can be enveloped. As the result, the toner can be free from any mutual melt-adhesion even in an environment of high temperature.

Studies made by the present inventors have further revealed that, in order to make the above coating layers have the advantageous function as stated previously, it is necessary for the coating layer to stand chiefly formed on the toner particle surface and in the vicinity thereof. More specifically, it has been found that if, e.g., the above polycondensate of a silicon compound, which is a preferred constituent of the coating layer formed of silicon-compound-containing particulate matters being stuck to one another, is present up to the interiors of particles of the toner, the binder resin constituting the toner particles may lose its thermoplasticity to tend to damage the fixing performance of the resulting toner.

In this regard, as a result of detailed studies further made by the present inventors, the following has been ascertained: As a requirement for the coating layer formed of silicon-compound-containing particulate matters being stuck to one another, formed on the toner particle surface and in the vicinity thereof, the quantity (% by weight) of silicon atoms present in cross sections of particles of the toner where the total sum of quantities of carbon atoms, oxygen atoms and silicon atoms present therein is regarded as 100% may be not more than 4.0% by weight as a value measured by electron probe microanalysis (EPMA), within the value of which a toner having a sufficient fixing performance can be obtained. More specifically, if the quantity of silicon atoms present in the particle cross sections of the toner is more than 4.0% by weight, it means that the polycondensate of a silicon compound, which is a constituent of the coating layer formed of silicon-compound-containing particulate matters being stuck to one another is present up to the interiors of particles of the toner. As the result, the fixing performance is damaged, as so presumed.

The quantity (% by weight) of silicon atoms present in the particle cross sections of the toner as defined in the present invention is measured in the manner as described below.

Measurement of the Quantity of Silicon Atoms Present in Particle Cross Sections of Toner:

Particles of toner for measurement are buried in epoxy resin, and thereafter ultra-thin slices of the particles of toner are prepared using a microtome. These are used as a sample. This sample is put on a sample rack made of aluminum, used for scanning electron microscopy, and is fastened with a conductive carbon pressure-sensitive adhesive sheet. On this sample, silicon atoms are determined in the same manner as the above measurement of the quantity of silicon atoms present on the particle surfaces of the toner.

In the toner of the present invention, a more preferable effect can be obtained when the quantity of silicon atoms present on the particle surfaces of the toner is twice or more the quantity of silicon atoms present in the particle cross sections of the toner. More specifically, studies made by the present inventors have revealed that a better fixing performance can be attained when images are formed using a toner comprising toner particles each provided with the coating layer formed of silicon-compound-containing particulate matters being stuck to one another that meets such a requirement. This is presumably because, since the coating layer having such a configuration is formed on the toner particle surface and in a more vicinity thereof, the thermoplasticity of binder resin is not damaged by the formation of the coating layer formed of silicon-compound-containing particulate matters being stuck to one another, bringing about an improvement in fixing performance.

It has also been found that a more preferable effect can be obtained when the quantity of silicon atoms present on the particle surfaces of the toner is not more than 4.0% by weight. Then, it has also been found that such constitution can be achieved with ease by using a silicon compound having an organic substituent, as the silicon compound contained in the coating layer formed of silicon-compound-containing particulate matters being stuck to one another, and this can bring about a more improvement in the running performance of the toner. This is considered to be presumably because the use of the silicon compound having an organic substituent, as the silicon compound contained in the above coating layer additionally provides the resulting coating layer with a flexibility attributable to organic chains, so that a superior running performance has been achieved.

More specifically, in the case when the silicon compound contained in the coating layer formed of silicon-compound-containing particulate matters being stuck to one another has an organic substituent, it is thought that the quantity of carbon atoms present on the particle surfaces of the toner is made larger, in other words, the quantity of silicon atoms present on the particle surfaces of the toner where the total sum of quantities of carbon atoms, oxygen atoms and silicon atoms is regarded as 100% is made smaller. However, as a result of studies made by the present inventors on the relationship between the quantity of silicon atoms present on the particle surfaces of the toner and the running performance of the running performance of the toner, it has been found that the coating layers to be formed can be more improved in durability when the quantity of silicon atoms present on the particle surfaces of the toner where the total sum of quantities of carbon atoms, oxygen atoms and silicon atoms is regarded as 100% is not more than 4.0% by weight, and this can bring about a more improvement in running performance of the toner of the present invention.

In the toner of the present invention, comprising toner particles provided with the coating layer formed of silicon-compound-containing particulate matters being stuck to one another, unreacted silanol groups (—SiOH) remain on the toner particle surfaces in some cases. Accordingly, in order for the toner to retain a sufficient charge quantity in an environment of high temperature and high humidity, the surface of the coating layer may preferably be treated with a coupling agent.

More specifically, where the surface of the coating layer formed of silicon-compound-containing particulate matters being stuck to one another is treated with a coupling agent, the hydroxyl groups of the unreacted silanol groups having remained on the toner particle surfaces are capped with the coating layers provided on the toner particle surfaces. Hence, the toner can be less affected by the atmospheric moisture and can retain a sufficient charge quantity even in an environment of high temperature and high humidity. Thus, the function of the coating layers present on the toner particle surfaces, stated previously, can be more enhanced.

In the present invention, the toner may have a small diameter and a sharp particle size distribution, having a number-average particle diameter of from 0.1 $\mu$m to 10.0 $\mu$m and a coefficient of variation in number distribution, of 20.0% or less. This is preferable in order to form high-quality images.

Controlling the size and particle size distribution of the toner in this way makes the toner have a sharp charge quantity distribution when such a toner is used, thus it becomes possible to obtain images with less black spots around images and a high dot reproducibility. If the toner has a number-average particle diameter smaller than 0.1 $\mu$m, the toner may be handled with difficulty as a powder. If it has a number-average particle diameter larger than 10.0 $\mu$m, the toner may have so excessively large a particle diameter with respect to latent images that it may be difficult to reproduce dots faithfully. Also, a toner having a coefficient of variation in number distribution, of more than 20.0% may have uneven charge quantity to form images with much fog and many black spots around images, resulting in a low dot reproducibility.

In the present invention, in order to achieve the objects as stated previously, the toner may more preferably have a number-average particle diameter of from 1.0 $\mu$m to 8.0 $\mu$m, and still more preferably from 3.0 $\mu$m to 5.0 $\mu$m, and the toner may more preferably have a coefficient of variation in number distribution, of 15.0% or less, and still more preferably 10.0% or less.

The toner in which the coating layers as described above are provided on the surfaces of toner particles having a sharp particle size distribution can retain its charge quantity distribution even after long-time running.

The number-average particle diameter and particle size distribution of the toner as used in the present invention are measured in the manner described below.

First, a photograph of the toner is taken with a field-emission scanning electron microscope S-4500 at 5,000 magnifications, manufactured by Hitachi Ltd. From this photograph, particle diameter of each toner particle is measured on toner particles so as to be measured on 300 partciles or more in cumulation. From the measurements obtained, the number-average particle diameter is calculated. Also, the coefficient of variation in number distribution of the toner is determined from the following expression.

Coefficient of variation (%)=(standard deviation of number distribution)/(number-average particle diameter)×100

In addition to the shape-related features described above, the toner of the present invention may preferably have, in its thermal properties, at least one glass transition point at temperatures of 60° C. or below, have a melt-starting temperature of 100° C. or below and also have a difference of 38° C. or smaller between the glass transition point and the melt-starting temperature. This can materialize a fixing temperature lower than conventional fixing temperatures, and also can satisfy, as stated previously, anti-blocking properties on account of the coating layers provided on the toner particle surfaces.

The above specific thermal properties of the toner will be detailed below.

Studies made by the present inventors have revealed that the toner does not exhibit any good fixing performance in some cases in the fixing performance test described layer, if the toner does not satisfy the requirements that it has at least one glass transition point at temperatures of 60° C. or below and also has a melt-starting temperature of 100° C. Also, if it has a difference greater than 38° C. between the glass transition point and the melt-starting temperature, the low-temperature fixing performance possessed by the toner particles can not be retained and the toner whose toner particles have been coated with sol-gel films can not exhibit a good fixing performance in the fixing performance test.

In order to control the melt-starting temperature and glass transition point of the toner in the manner described above, the thermal properties of toner particles serving as base particles (toner particles having not provided with the coating layers) may be controlled by controlling, e.g.;

1) composition of the binder resin;

2) molecular weight and molecular weight distribution of the binder resin; and 3) content of a wax or release agent.

Then, the thermal properties may preferably be so controlled that the toner particles have at least one glass transition point (Tg) at temperatures of 60° C. or below, and more preferably 40° C. or below, and have a melt-starting temperature of 100° C. or below, and more preferably 80° C. or below.

In the case when the melt temperature is controlled by controlling the content of a release agent incorporated in the toner, the use of a release agent in a content more than 80% by weight based on the weight of the toner inclusive of the coating layers may cause come-off of images once fixed on transfer paper or film, and is supposed to be substantially impractical. Taking account of releasability from fixing rollers, the form incorporated with the release agent can be said to be preferred. Accordingly, in the toner of the present invention, the release agent may preferably be in a content ranging from 5 to 80 parts by weight, and more preferably from 10 to 60 parts by weight, based on the total weight of the toner.

As release agents usable in the present invention, solid waxes are preferred. Stated specifically, solid waxes which are solid at room temperature are preferred. They may specifically include, e.g., paraffin wax, polyolefin wax, Fischer-Tropsch wax, amide waxes, higher fatty acids, ester waxes, and derivatives thereof such as graft compounds or block compounds thereof. Ester waxes having at least one long-chain ester moiety having at least 10 carbon atoms as shown by the following structural formulas are particularly preferred as being effective for high-temperature anti-offset properties without impairment of the transparency required for OHP.

Structural formulas of the typical compounds of preferable specific ester waxes usable in the present invention are shown below as general structural formulas (1) to (5).

$$[R_1—COO—(CH_2)_n—]_a—C—[—(CH_2)_m—OCO—R_2]_b \quad (1)$$

wherein a and b each represent an integer of 0 to 4, provided that a+b is 4; $R_1$ and $R_2$ each represent an organic group having 1 to 40 carbon atoms, provided that a difference in the number of carbon atoms between $R_1$ and $R_2$ is 10 or more; and n and m each represent an integer of 0 to 15, provided that n and m are not 0 at the same time.

$$[R_1—COO—(CH_2)_n—]_a—C—[—(CH_2)_m—OH]_b \quad (2)$$

wherein a and b each represent an integer of 0 to 4, provided that a+b is 4; $R_1$ represents an organic group having 1 to 40 carbon atoms; and n and m each represent an integer of 0 to 15, provided that n and m are not 0 at the same time.

$$[R_1—COO—(CH_2)_n]_a—C(H)—(CH_2)_m—OH]_b \quad (3)$$

wherein a and b each represent an integer of 0 to 3, provided that a+b is 3 or less; $R_1$ represents an organic group having 1 to 40 carbon atoms; and n and m each represent an integer of 0 to 15, provided that n and m are not 0 at the same time.

$$R_1—COOR_2 \quad (4)$$

wherein $R_1$ and $R_2$ each represent a hydrocarbon group having 1 to 40 carbon atoms; and $R_1$ and $R_2$ may have the number of carbon atoms which is the same or different from each other.

$$R_1COO(CH_2)_nOOCR_2 \quad (5)$$

wherein $R_1$ and $R_2$ each represent a hydrocarbon group having 1 to 40 carbon atoms; n represents an integer of 2 to 20; and $R_1$ and $R_2$ may have the number of carbon atoms which is the same or different from each other.

The glass transition point and melt-starting temperature used in the present invention are measured in the manner as described below.

Measurement of Glass Transition Point:

The glass transition point Tg of resin is measured according to a method prescribed in ASTM D3418, using a differential thermal analyzer DSC-7, manufactured by Perkin Elmer Co.

Measurement of Melt-Starting Temperature:

The melt-starting temperature in the present invention is measured with a flow tester CFT-500 (manufactured by Shimadzu Corporation). A sample for measurement is weighed in an amount of about 1.0 to 1.5 g. This is pressed for 1 minute using a molder under application of a pressure of 9,806.65 kPa (100 kgf/cm$^2$) to prepare a pressed sample.

This pressed sample is put to the measurement with the flow tester in an environment of normal temperature and normal humidity (temperature: about 20–30° C.; humidity: 30–70% RH) under the following conditions to obtain a humidity-apparent viscosity curve. From the smooth curve obtained, the temperature at which the viscosity begins to decrease is read, and is regarded as the melt-starting temperature.

Rate temperature: 6.0° C./minute

Set temperature: 70.0° C.

Maximum temperature: 200.0° C.

Interval: 3.0° C.

Preheating: 300.0 seconds

Load: 20.0 kg

Die (diameter): 1.0 mm

Die (length): 1.0 mm

Plunger: 1.0 $cm^2$

The toner production process will be described below by which the toner of the present invention which is so made up that its toner particles have on their surfaces the coating layers formed of silicon-compound-containing particulate matters being stuck to one another.

In the toner production process of the present invention, toner particles composed of at least a binder resin and a colorant are prepared and then, on their surfaces, the coating layers formed of silicon-compound-containing particulate matters being stuck to one another are formed in the manner as described later. As the toner particles, any of those conventionally known may be used as long as they are toner particles composed of at least a binder resin and a colorant and optionally containing various additives. More specifically, the toner particles used in the present invention may be those of what is called the pulverization toner, obtained by kneading a toner material composition comprised of a binder resin and other optional components, cooling the kneaded product obtained, followed by pulverization, or what is called the polymerization toner, obtained by polymerizing polymerizable monomers that form a binder resin. In the toner of the present invention, however, spherical toner particles may preferably be used as the toner particles because, if toner particles have no specific shape, the above coating layers formed on their surfaces tend to deteriorate. Such spherical toner particles may be obtained with ease by sphering toner particles produced by pulverization or producing toner particles by polymerization.

As a typical example for producing the toner particles according to the present invention, having on their surfaces the coating layers formed of silicon-compound-containing particulate matters being stuck to one another, a method commonly called a sol-gel process may be applied. An example for producing the toner particles by this sol-gel process is described below.

The sol-gel process is commonly known as a method for producing planar metal compound polycondensation films or solid-state metal compound polycondensates. Metal compound films formed by this method are commonly called sol-gel films.

The sol-gel films are, stated specifically, films formed by hydrolysis-polycondensation of silicon compounds typified by silane alkoxides, and having surfaces on which fine unevenness on the order of nanometer (nm) is observable. As a result of extensive studies, the present inventors have discovered that, without use of any external additive used in conventional toners, a toner which can retain a sufficient charge quantity and may hardly cause a lowering of performance of toner as a result of running can be obtained by providing the sol-gel films on the toner particle surfaces.

As a result of extensive studies, the present inventors have also found that, when the sol-gel films having the properties described above are provided on the toner particle surfaces, the toner containing a binder resin having a low Tg can be free from blocking while keeping its low-temperature fixing performance.

As a first embodiment of the process by which the coating layer formed of silicon-compound-containing particulate matters being stuck to one another is formed on the toner particle surface, a process may be used which comprises producing toner particles composed of at least a binder resin and a colorant, and building up a polycondensate of a silicon compound on the surfaces of the toner particles from the outside of the particles to form on each toner particle surface the above coating layer.

Stated specifically, this is a process in which the toner particles serving as base particles (hereinafter often "base-particle toner particles") are dispersed in an aqueous medium comprising water or a mixed solvent of a water-miscible solvent and water in which medium a silane alkoxide has been dissolved and thereafter the aqueous dispersion obtained is added dropwise to water or other aqueous medium in which an alkali has been added. According to this process, the silane alkoxide having been dissolved in the aqueous dispersion containing toner particles causes hydrolysis and polycondensation in the presence of the alkali to become gradually insoluble, and is further built up on the toner particle surface by hydrophobic mutual action. As the result, the coating layer formed of silicon-compound-containing particulate matters being stuck to one another is formed on the toner particle surface. In the case when the toner particles produced by polymerization are used, the reaction system after the polymerization is completed to form the toner particles serving as base particles may be cooled to room temperature and thereafter the silane alkoxide may be dissolved therein so as to be used as an aqueous toner dispersion.

As the water-miscible solvent that may be used in the above process, organic solvents including alcohols as exemplified by methanol, ethanol and isopropanol may be used. With an increase in organicity (i.e., the number of carbon atoms) of these solvents, the solubility of the silane alkoxide polycondensate increases to make it difficult for the silane alkoxide polycondensate to be built up on the toner particle surface. Accordingly, methanol or ethanol may preferably be used as the water-miscible solvent.

As a second embodiment of the process by which the coating layer formed of silicon-compound-containing particulate matters being stuck to one another is formed on the toner particle surface, a process may be used which comprises producing toner particles composed of at least a binder resin and a colorant and having a silicon compound present internally, and dispersing the toner particles in an aqueous medium selected from the group consisting of water and a mixed solvent of water and a water-miscible solvent to cause the silicon compound to undergo hydrolysis and polycondensation reaction on the surfaces of the toner particles, to form on each toner particle surface the above coating layer.

In the above process, the toner particles are dispersed in water or a mixed solvent of water and a water-miscible solvent, whereupon the silicon compound made present in the toner particles comes into contact with water to undergo hydrolysis. Namely, sol-gel reaction takes place only on the toner particle surfaces and in the vicinity thereof. After the reaction is completed, the toner particles may be washed with a solvent such as an alcohol to remove any unreacted silicon compound remaining inside the toner particles. As the result, a polycondensate of the silicon compound becomes present selectively on the toner particle surfaces.

Thus, the coating layers formed of silicon-compound-containing particulate matters being stuck to one another and in which the quantity of silicon atoms present on the toner particle surfaces is larger than the quantity of silicon atoms present inside the toner particles can be formed on the toner particle surfaces.

The aqueous medium used when the toner particles are dispersed, which is preferred in the above process, may include water and a mixed solvent of water and a water-miscible solvent including alcohols such as methanol, ethanol and propanol.

As methods by which the silicon compound is made previously present inside the toner particles, the silicon compound may be made present mixedly when the toner particles are produced, or may be introduced into particles obtained after the toner particles serving as base particles are produced by a conventional method. In the latter method, it is effective to use a method in which the silicon compound is made to permeate into the toner particles in water or a mixed solvent of water and a water-miscible solvent. Stated specifically, such a method may include the following method.

For example, a method is available in which the toner particles serving as base particles and the silicon compound are dispersed in a liquid medium in which the silicon compound is slightly soluble, as typified by water. In such a method, the silicon compound having slightly dissolved in the liquid medium is dispersed into the liquid medium to become absorbed in the toner particles, or the silicon compound having been dispersed physically comes into contact with the toner particles to become absorbed in the toner particles, thus the silicon compound can be introduced into the toner particles.

In such a method, in order to disperse the silicon compound stably in the liquid medium, it is preferable to use a surface-active agent. As the surface-active agent, any conventionally known surface-active agents commonly used may be used.

Here, a dispersion of the toner particles and a dispersion of the silicon compound may separately be prepared and the both may be mixed. In such an instance, if the dispersion of the silicon compound is added to the dispersion of the toner particles, the toner particles tend to coalesce to undesirably provide a toner having a broad particle size distribution than the toner particles before reaction. As the result, the toner to be obtained may have a broad triboelectric charge distribution to tend to cause difficulties such as black spots around images. Accordingly, in the instance where a dispersion of the toner particles and a dispersion of the silicon compound are separately prepared and the both are mixed, it is preferable to add the dispersion of the toner particles to the dispersion of the silicon compound.

The particle size distribution the toner particles have had before the coating layers are formed should be retained after the coating layers have been formed on the toner particle surfaces to produce the toner of the present invention. To this end, when the silicon compound is dispersed in the liquid medium such as water, the silicon compound may preferably be dispersed in the form of droplets as small as possible with respect to individual toner particles. Also, as methods therefor, it is preferable to use a method in which materials are stirred mechanically by means of a high-speed stirrer and a method in which the silicon compound is finely dispersed by means of an ultrasonic dispersion machine.

In the case when the silicon compound is made to permeate into toner particles so as to be made present therein, the silicon compound may be made to permeate into toner particles using the silicon compound and other slightly water-soluble solvent in combination for the purpose of improving the rate of permeation as a supplementary means.

As the slightly water-soluble solvent used here, any solvents may be used as long as they are solvents more hydrophilic than the silicon compound used and are solvents slightly soluble in water. Stated specifically, they may include, e.g., isopentyl acetate, isobutyl acetate, methyl acetate and ethyl acetate. In use of any of these slightly water-soluble solvents, the slightly water-soluble solvent must be removed from the interiors of toner particles by evaporating it, or by introducing toner particles into a hydrophobic medium and dissolving the slightly water-soluble solvent in the hydrophobic medium. The operation thus made also enables removal of the unreacted silicon compound remaining in toner particles.

As another method by which the silicon compound is made to permeate into base-particle toner particles so as to be made present therein, the toner particles may be dispersed in a liquid medium (aqueous medium) in which the silicon compound is soluble, as exemplified by an alcohol, to make the silicon compound have a low solubility to incorporate the silicon compound into toner particles. As methods for making the silicon compound have a low solubility, for example, temperature may be lowered, or a liquid medium i) which is soluble in the liquid medium in which the silicon compound is soluble and also ii) in which the silicon compound is insoluble is added slowly. The latter method may specifically include a method in which, e.g., the silicon compound is dissolved in a low-molecular weight alcohol such as methanol, the base-particle toner particles are dispersed therein, and thereafter water is added slowly to make the silicon compound have a low solubility, thus the silicon compound is permeated into the toner particles to become present therein.

In the case when as described above the method of dissolving the silicon compound in a medium and incorporating it into the toner particles is used, silane alcohol may dissolve out of toner particle surfaces into the medium if the silane alcohol formed after hydrolysis has a high solubility, and the silane alcohol having dissolved out may mutually form particles independently. Hence, it is necessary to select a medium in which the silane alcohol obtained by hydrolyzing the silicon compound is slightly soluble.

When the polycondensation reaction of the silicon compound is allowed to proceed on the toner particles in which the silicon compound stands permeated, the speed of stirring depends on the concentration of particles in the system, the size of the system, the quantity in which the silicon compound stands permeated and so forth. Stirring at a too high speed or too low speed tends to cause the particles to coalesce one another and may cause a disorder of particle size distribution of the toner obtained. Accordingly, the speed of stirring must be controlled appropriately.

In the above case, commonly available surface-active agents, polymeric dispersants or solid dispersants may also be used in order to disperse the base-particle toner particles uniformly in the slightly water-soluble medium.

In the toner of the present invention, the coating layer formed of silicon-compound-containing particulate matters being stuck to one another, formed on the toner particle surface, is a coating layer comprising a polycondensate of the silicon compound which is obtained by hydrolysis and polycondensation of the silicon compound such as a silane alkoxide in the manner as described above.

To obtain a filmlike polycondensate as described above, at least one type of silicon compound having at least two hydrolyzable and polycondensable groups in one molecule must be used. A monofunctional compound may be used in combination. Accordingly, in the present invention, the silicon compound usable to form the coating layer formed of silicon-compound-containing particulate matters being stuck to one another may include the following.

As a bifunctional or higher silane alkoxide, it may include, e.g., tetramethoxysilane, methyltriethoxysilane, hexyltriethoxysilane, triethoxychlorosilane, di-t-butoxyacetoxysilane, hydroxymethyltriethoxysilane, tetraethoxysilane, tetra-n-propoxysilane, tetrakis(2-methacryloxyethoxy)silane, allyltriethoxysilane, allyltrimethoxysilane, 3-aminopropyltriethoxysilane, 3-aminopropyltrimethoxysilane, bis(triethoxysilyl)ethylene, bis(triethoxysilyl)methane, bis(triethoxysilyl)-1,7-octadiene, 2,2-(chloromethyl)allyltrimethoxysilane, [(chloromethyl)phenylethyl]trimethoxysilane, 1,3-divinyltetraethoxydisloxane, 2-(3,4-epoxycyclohexyl)ethyltrimethoxysilane, (3-glycidoxypropyl)methyldiethoxysilane, (3-glycidoxypropyl)methyldimethoxysilane, (3-glycidoxypropyl)trimethoxysilane, 3-mercaptopropyltriethoxysilane, methacrylamidopropyltriethoxysilane, methacryloxymethyltriethoxysilane, methacryloxymethyltrimethoxysilane, (3-methacryloxypropyl)trimethoxysilane, 1,7-octadienyltriethoxysilane, 7-octenyltrimethoxysilane, tetrakis(ethoxyethoxy)silane, tetrakis(2-methacryloxyethoxy)silane, vinylmethyldiethoxysilane, vinylmethyldimethoxysilane, vinyltriethoxysilane and vinyltriphenoxysilane.

The monofunctional compound which may be used in combination with the bifunctional or higher silane alkoxide may include, e.g., (3-acryloxypropyl)dimethylmethoxysilane, o-acryloxy(polyethyleneoxy)trimethylsilane, acryloxytrimethylsilane, 1,3-bis(methacryloxy)-2-trimethylsiloxypropane, 3-chloro-2-trimethylsiloxypropene, (cyclohexenyloxy)trimethylsilane, methacryloxyethoxytrimethylsilane and (methacryloxymethyl)dimethylethoxysilane.

As a sol-gel reactive compound other than the silane alkoxide, an aminosilane as exemplified by 1,3,5,7-tetravinyl-1,3,5,7-tetramethylcyclotetrasilazan e may also be used. Such a sol-gel reactive compound may be used alone or in combination of two or more.

In the sol-gel reaction, it is commonly known that the sol-gel films formed have a bond state which differs depending on the acidity of reaction medium. Stated specifically, when the medium is acidic, $H^+$ adds electrophilicically to the oxygen of the alkoxyl group (—OR group) to become eliminated as an alcohol. Next, the water attacks nucleophilically and the corresponding moiety is substituted with the hydroxyl group. Here, the reaction of hydroxyl group substitution takes place slowly when the water in the medium is in a small content, and hence the polycondensation reaction takes place before all the alkoxy groups attached to the silane are hydrolyzed, to tend to relatively readily form a one-dimensional (simple) linear polymer or a two-dimensional polymer.

On the other hand, when the medium is alkaline, the alkoxyl group readily changes into a silane alcohol by nucleophilic substitution reaction attributable to $OH^-$. Especially when a silicon compound having three or more alkoxyl groups in the same silane, the polycondensation takes place three-dimensionally to form a three-dimensional polymer rich in cross linkages, i.e., a sol-gel film having a high strength. Also, the reaction terminates in a short time. Accordingly, in order to form sol-gel films on the surfaces of toner particles serving as base particles, the sol-gel reaction may preferably be made to proceed under alkalinity. Stated specifically, the reaction may preferably be made to proceed under an alkalinity of pH 9 or higher. This enables formation of sol-gel films having a higher strength and a good durability.

The above sol-gel reaction may also fundamentally proceed at room temperature, but the reaction is accelerated by heating. Accordingly, a heat may optionally be applied to the reaction system.

A process in which the coating layer formed of silicon-compound-containing particulate matters being stuck to one another as described above is further treated with a coupling agent will be described below.

The coupling agent may commonly be expressed to be a molecule made up by combination of a reactive site and a functional site; the former being a metal alkoxide or metal chloride capable of combining with a functional group such as a hydroxyl group, carboxyl group or epoxy group lying bare to the material surface and the latter being an alkyl group or ionic group capable of imparting hydrophobicity or ionic properties to the material surface. In the present invention, the nature of this coupling agent that reacts with hydroxyl groups on the material surface is utilized, where, after the coating layer formed of silicon-compound-containing particulate matters being stuck to one another has been formed on the toner particle surface, the coupling agent is allowed to react with the silanol groups having remained thereon to cap the hydroxyl groups on the toner particle surfaces so that the toner can retain its charging performance in a good state even in an environment of high temperature and high humidity. Accordingly, an ideal coupling agent used in the present invention may preferably be a compound capable of readily reacting with silanol groups and in itself not allowing any unreacted metal alcohol groups to remain. Thus, compounds commonly called terminal stoppers or capping agents and compounds called silylating agents also have the function applicable to this purpose. Accordingly, in the present invention, these compounds are also defined to be coupling agents in a broad sense.

A process by which the coating layers formed on the toner particle surfaces are treated with the coupling agent will be described below.

As a method therefor, the coating layers may be treated by commonly available coupling treatment, capping treatment or silylating treatment. For example, it may include a method in which a coupling agent is added dropwise in an acidic alcohol solution whose pH has been adjusted to 4.5 to 5.5, and subsequently the toner particles surface-coated with a silane compound are introduced thereinto, where the reaction mixture is stirred for about 5 minutes, followed by repetition of filtration and washing, and then drying to separate treated toner particles; and a method in which a coupling agent is dissolved in alcohol and the coupling agent alcohol solution obtained is sprayed on a powder being agitated in a high-power mixer such as a twin coater, followed by agitation drying. To prepare the acidic alcohol solution in the former method, when an alkali is used in the reaction for forming on the toner particle surfaces the coating layers containing a silicon compound, the alkali may be removed or neutralized and thereafter an acid may be added in the same system to make adjustment to acidic, or the alkali is separated from the solution and the coupling treatment may be made in an acidic solution prepared anew.

In the toner production process of the present invention, it is also possible to mix the coupling agent at the time of the formation of the coating layer formed of silicon-compound-containing particulate matters being stuck to one another, so as to make coupling treatment simultaneously with the formation of the coating layer. In this instance, silica monomers for forming the coating layer and the coupling agent may preferably be selected in such combination that the reactivity of the former is higher than the reactivity of the latter so that the mutual reaction of silica monomers proceeds first to form coating layers on the toner particle surfaces and thereafter the unreacted silanols on the coating layer surfaces react with the coupling agent to subject the coating layer surfaces to coupling treatment.

The coupling agent usable in the present invention may include, e.g., the following.

As a silica type coupling agent, it may include the following. First, as a bifunctional or higher silica type coupling agent, it may include, e.g., tetramethoxysilane, methyltriethoxysilane,
hexyltriethoxysilane, triethoxychlorosilane,
di-t-butoxydiacetoxysilane,
hydroxymethyltriethoxysilane, tetraethoxysilane,
tetra-n-propoxysilane,
tetrakis(2-methacryloxyethoxy)silane,
allyltriethoxysilane, allyltrimethoxysilane,
3-aminopropyltriethoxysilane,
3-aminopropyltrimethoxysilane,
bis(triethoxysilyl)ethylene,
bis(triethoxysilyl)methane,
bis(triethoxysilyl)-1,7-octadiene,
2,2-(chloromethyl)allyltrimethoxysilane,
[(chloromethyl)phenylethyl]trimethoxysilane,
1,3-divinyltetraethoxydisloxane,
2-(3,4-epoxycyclohexyl)ethyltrimethoxysilane,
(3-glycidoxypropyl)methyldiethoxysilane,
(3-glycidoxypropyl)methyldimethoxysilane,
(3-glycidoxypropyl)trimethoxysilane,
3-mercaptopropyltriethoxysilane,
methacrylamidopropyltriethoxysilane,
methacryloxymethyltriethoxysilane,
methacryloxymethyltrimethoxysilane,
1,7-octadienyltriethoxysilane,
7-octenyltrimethoxysilane,
tetrakis(ethoxyethoxy)silane,
tetrakis(2-methacryloxyethoxy)silane,
vinylmethyldiethoxysilane, vinylmethyldimethoxysilane,
vinyltriethoxysilane, vinyltriphenoxysilane and
methacryloxypropyldimethoxysilane.

As a monofunctional silica type coupling agent, it may include, e.g., (3-acryloxypropyl)dimethylmethoxysilane,
o-acryloxy(polyethyleneoxy)trimethylsilane,
acryloxytrimethylsilane,
1,3-bis(methacryloxy)-2-trimethylsiloxypropane,
3-chloro-2-trimethylsiloxypropene,
(cyclohexenyloxy)trimethylsilane,
methacryloxyethoxytrimethylsilane and
(methacryloxymethyl)dimethylethoxysilane.

What is called a silylating agent may also be used as the coupling agent in the present invention, as exemplified by allyloxytrimethylsilane, trimethylchlorosilane, hexamethyldisilazane, dimethylaminotrimethylsilane, bis(trimethylsilyl)acetamide, trimethylsilyl diphenylurea, and trimethylsilyl imidazole.

As a titanium type coupling agent, it may include, e.g., o-allyloxy(polyethylene oxide) trisiopropoxytitanate, titanium allylacetoacetate triisopropoxide, titanium bis(triehtanolamine) diisopropoxide, titanium n-butoxide, titanium chloride triisopropoxide, titanium n-butoxide(bis-2,4-pentanedionate), titanium chloride diethoxide, titanium diisopropoxide(bis-2,4-pentanedionate), titanium diisopropoxide bis(tetramethylheptanedionate), titanium diisopropoxide bis(ethylacetoacetate), titanium ethoxide, titanium 2-ethylhexyoxide, titanium isobutoxide, titanium isopropoxide, titanium lactate, titanium methacrylate isopropoxide, titanium methacryloxyethylacetoacetate triisopropoxide, (2-methacryloxyethoxy) triisopropoxytitanate, titanium methoxide, titanium methoxypropoxide, titanium methyl phenoxide, titanium n-nolyl oxide, titanium oxide bis(pentanedionate), titanium n-propoxide, titanium stearyloxide, titanium tetrakis[bis-2,2-(allyloxymethyl) butoxide], titanium triisostearolyl isopropoxide, titanium methacrylate methoxyethoxide, tetrakis(trimethylsiloxy)titanium, titanium tris(dodecylbenzene sulfonate) isopropoxide, and titanocene diphenoxide.

As an aluminum type coupling agent, it may include, e.g., aluminum(III) n-butoxide, aluminum(III) s-butoxide, aluminum(III) s-butoxide bis(ethyl acetoacetate), aluminum(III) t-butoxide, aluminum(III) di-s-butoxide ethyl acetate, aluminum(III) diisopropoxide ethyl acetoacetate, aluminum(III) ethoxide, aluminum(III) ethoxyethoxyethoxide, aluminum hexafluoropentanedionate, aluminum(III) 3-hydroxy-2-methyl-4-pyrronate, aluminum(III) isopropoxide, aluminum 9-octadecenyl acetoacetate diisopropoxide, aluminum(III) 2,4-pentanedionate, aluminum phenoxide, and aluminum(III) 2,2,6,6-tetramethyl-3,5-heptanedionate.

Any of these may be used alone, may be used in plurality, or may be used in appropriate combination. The charge quantity of the toner may appropriately controlled by controlling the quantity of treatment to be employed.

There are no particular limitations on the quantity of treatment with the coupling agent. Treatment in a too large quantity may cause mutual combination of coupling agents to form coating films unwantedly to bring about a possibility of damaging fixing performance.

A process for producing the toner particles serving as base particles for the formation of the coating layer formed of silicon-compound-containing particulate matters being stuck to one another will be described below.

Polymerizable monomers usable when the base-particle toner particles are produced by polymerization may include, e.g., styrene monomers such as styrene, o-methylstyrene, m-methylstyrene, p-methoxystyrene, p-ethylstyrene and p-t-butylstyrene; acrylic acid monomers such as acrylic acid, methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, phenyl acrylate, methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, diaminomethyl methacrylate, dimethylaminoethyl methacrylate, benzyl methacrylate, crotonic acid, isocrotonic acid, acid phosphoxyethyl methacrylate, acid phosphoxypropyl methacrylate, acryloyl morpholine, 2-hydroxyethyl acrylate, 2-hydroxyethyl methacrylate, acrylonitrile, methacrylonitrile, and acrylamide; vinyl ether monomers such as methyl vinyl ether, ethyl vinyl ether propyl vinyl ether, n-butyl vinyl ether, isobutyl vinyl ether, β-chloroethyl vinyl ether, phenyl vinyl ether, p-methylphenyl vinyl ether, p-chlorophenyl vinyl ether, p-bromophenyl vinyl ether, p-nitrophenyl vinyl ether, p-methoxyphenyl vinyl ether, and butadiene; dibasic acid monomers such as itaconic acid, maleic acid, fumaric acid, monobutyl itaconate, and monobutyl maleate; and heterocyclic monomers such as 2-vinylpyridine, 4-vinylpyridine, and N-vinyl imidazole. Any of these vinyl monomers may be used alone or in combination of two or more monomers, and may be used in any desired combination to select preferable polymer composition so that preferable properties can be attained.

As polymerization solvents (solvents in which polymerizable monomers are soluble but their polymers are insoluble) usable when the base-particle toner particles are produced by polymerization, those enabling products obtained by polymerization (i.e., polymers) to become precipitated with the progress of polymerization may be used. Stated specifically, they may include, e.g., straight-chain or branched aliphatic alcohols such as methanol, ethanol, 1-propanol, 2-propanol, 1-butanol, 2-butanol, isobutyl alcohol, tertiary butyl alcohol, 1-pentanol, 2-pentanol, 3-pentanol, 2-methyl-1-butanol, isopentyl alcohol, tertiary pentyl alcohol, 1-hexanol, 2-methyl-1-pentanol, 4-methyl-2-pentanol, 2-ethylbutanol, 1-heptanol, 2-heptanol, 3-heptanol, 2-octanol and 2-ethyl-1-hexanol; and aliphatic hydrocarbons such as butane, 2-methylbutane, n-hexane, cyclohexane, 2-methylpentane, 2,2-dimethylbutane, 2,3-dimethylbutane, heptane, n-octane, isooctane, 2,2,3-trimethylpentane, decane, nonane, cyclopentane, methylcyclopentane, methylcyclohexane, ethylcyclohexane, p-mentane and bicyclohexyl; as well as aromatic hydrocarbons, halogenated hydrocarbons, ethers, fatty acids, esters, sulfur-containing compounds, and mixture of any of these.

As polymeric dispersants usable in dispersion polymerization, they may specifically include, e.g., polystyrene, polyhydroxystyrene, polyhydroxystyrene-acrylate copolymers, hydroxystyrene-vinyl ether or vinyl ester copolymers, polymethyl methacrylate, phenol novolak resin, cresol novolak resin, styrene-acrylic copolymers, vinyl ether copolymers specifically as exemplified by polymethyl vinyl ether, polyethyl vinyl ether, polybutyl vinyl ether and polyisobutyl vinyl ether, polyvinyl alcohol, polyvinyl pyrrolidone, polyvinyl acetate, a styrene-butadiene copolymer, an ethylene-vinyl acetate copolymer, vinyl chloride, polyvinyl acetal, cellulose, cellulose acetate, cellulose nitrate, alkylated celluloses, hydroxyalkylated celluloses specifically as exemplified by hydroxymethyl cellulose and hydroxypropyl cellulose, saturated alkyl polyester resins, aromatic polyester resins, polyamide resins, polyacetal, and polycarbonate resins; mixtures of these; and copolymers that can be formed by using in any desired proportion the monomers capable forming the polymeric compounds described above.

The toner of the present invention may be incorporated with a high-molecular-weight component or a gel component as a constituent of the toner so that melt-viscosity properties can be controlled as occasion calls, e.g., for anti-offset. The incorporation of such a component is achievable by the use of a cross-linking agent having at least two polymerizable double bonds per one molecule. Such a cross-linking agent may specifically include, e.g., aromatic divinyl compounds such as divinylbenzene and divinylnaphthalene; and compounds such as ethylene glycol diacrylate, ethylene glycol dimethacrylate, triethylene glycol dimethacrylate, tetraethylene glycol dimethacrylate, 1,3-butylene glycol dimethacrylate, trimethylolpropane triacrylate, trimethylolpropane trimethacrylate, 1,4-butanediol diacrylate, neopentyl glycol diacrylate, 1,6-hexanediol diacrylate, pentaerythritol triacrylate, pentaerythritol tetraacrylate, pentaerythritol dimethacrylate, pentaerythritol tetramethacrylate, glycerol acroxydimethacrylate, N,N-divinylaniline, divinyl ether, divinyl sulfide, and divinyl sulfone.

Any of these may be used alone or in the form of an appropriate mixture of two or more compounds. The cross-linking agent may also previously be mixed in polymerizable monomers or may appropriately be added in the course of polymerization as occasion calls. The cross-linking agent used in the present invention may be in a concentration appropriately controlled taking account of molecular weight and molecular weight distribution of polymers produced. It may preferably be in a concentration within the range of from 0.01 to 5% by weight based on the total weight of polymerizable monomers used.

As the binder resin usable when the toner particles are produced by pulverization, it may include, e.g., polystyrene; homopolymers of styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Cross-linked styrene copolymers and cross-linked polyester resins are also preferred binder resins.

In the toner of the present invention, the binder resin may also be incorporated with a gel content in order to prevent offset from occurring at the time of melting.

As the colorant constituting the base-particle toner particles, any desired pigments or dyes may be used. Both of them may also be used in combination. For example, carbon black, magnetic materials, and colorants toned in black by the use of yellow, magenta and cyan colorants shown below may be used as black colorants.

As yellow colorants, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferred.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 are particularly preferably usable.

Any of these colorants may be used alone, in the form of a mixture, or in the state of a solid solution.

In the case when a magnetic material is used as the colorant, it may preferably be added in an amount of from 40 to 150 parts by weight based on 100 parts by weight of the binder resin. In the case when other colorant is used, it may preferably be added in an amount of from 5 to 20 parts based on 100 parts by weight of the binder resin.

The toner of the present invention may also be incorporated with a magnetic material so that it can be used as a magnetic toner. In this case, the magnetic material may also serve as the colorant. The magnetic material usable in the present invention may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

The magnetic material used in the present invention may preferably be a surface-modified magnetic material. A surface modifier usable here may include, e.g., silane coupling agents and titanium coupling agents. These magnetic materials may also preferably be those having an average particle diameter of 1 $\mu$m or smaller, and preferably from 0.1 $\mu$m to 0.5 $\mu$m. As the magnetic material, it is preferable to use those having a coercive force (Hc) of from $1.59\times10^3$ to $2.39\times10^4$ A/m (20 to 300 oersteds), a saturation magnetization ($\sigma s$) of from 50 to 200 $A\cdot m^2/kg$ (50 to 200 emu/g) and a residual magnetization ($\sigma r$) of from 2 to 20 $A\cdot m^2/kg$ (2 to 20 emu/g), as magnetic characteristics under application of $7.96\times10^2$ kA/m (10 K oersteds).

A charge control agent may optionally be added to the toner of the present invention. In such a case, any conventionally known charge control agents may be used. It is preferable to use charge control agents that make toner's charging speed higher and are capable of stably maintaining a constant charge quantity. Stated specifically, they may include, as negative charge control agents, e.g., metal compounds of salicylic acid, alkylsalicylic acids, dialkylsalicylic acids, naphthoic acid or dicarboxylic acids, polymer type compounds having sulfonic acid or carboxylic acid in the side chain, boron compounds, urea compounds, silicon compounds and carixarene. As positive charge control agents, they may include, e.g., quaternary ammonium salts, polymer type compounds having such a quaternary ammonium salt in the side chain, guanidine compounds, and imidazole compounds. Any of these charge control agents may preferably be used in a amount of from 0.5 to 10 parts by weight based on 100 parts by weight of the binder resin.

In the toner of the present invention, for the purpose of improving the releasability required when used in combination with a heat roll fixing assembly, a low-temperature fluidity-providing component such as wax may be incorporated into the toner particles. The wax used here may include, e.g., paraffin wax, polyolefin wax and modified products of these (e.g., oxides or graft-treated products), higher fatty acids and metal salts thereof, higher fatty acid alcohols, higher fatty acid esters, and fatty acid amide waxes. Of these waxes it is preferable to use those having a softening point within the range of from 30 to 130° C. as measured by the ring-and-ball method (JIS K2351). When such a wax is incorporated into the toner particles, it may preferably be added in the form of fine powder.

In the toner of the present invention, in order to control in an appropriate quantity the electric charge to be imparted to the toner particles, commonly available inorganic fine particles or organic fine particles such as silica, titania and alumina may auxiliarily used as an external additive.

There are no particular limitations on the particle diameter of the toner of the present invention, thus obtained. In order to have a high fluidity, the toner may preferably have a small particle diameter of from 0.1 to 10 $\mu$m as its number-average particle diameter, and a sharp particle size distribution, having a coefficient of variation in number distribution of 20.0% or less. In order to achieve such particle diameter and particle size distribution, it may be necessary to employ what is called classification step in addition to the steps for toner production described previously. Accordingly, in the present invention, to avoid such a step, the dispersion polymerization mentioned previously may preferably be used when the base-particle toner particles are produced. The dispersion polymerization is commonly a process in which polymerizable monomers are polymerized in a polymerization solvent in which the monomers are soluble but the polymer obtained is insoluble, and in the presence of a particle stabilizer as typified by a polymeric dispersant. This is known as a process that can obtain particles with a uniform particle size distribution. Also, this dispersion polymerization is preferable for producing small-diameter toner particles having particle diameter of about 1 $\mu$m to 5 $\mu$m, as being preferable for the toner. Thus, in the present invention, the base-particle toner particles may preferably be produced by this dispersion polymerization.

The toner of the present invention, constituted as described above, may be used as a one-component type developer, or may be blended with a carrier so as to be used as a two-component type developer. When the two-component type developer is prepared by blending the toner of the present invention with a magnetic carrier, they may be blended in such a proportion that the toner in the developer has a concentration within the range of from 2 to 15% by weight. If the toner is in a concentration lower than 2% by weight, image density tends to lower. If on the other hand it is in a concentration higher than 15% by weight, fog and in-machine toner scatter tend to occur.

As the carrier, it is preferable to use a carrier having the following magnetic characteristics, i.e., to use a carrier having a magnetization intensity of from 30 to 300 kA/m (30 to 300 emu/$cm^3$) at 79.57 kA/m (1,000 oersteds) after it has been saturated magnetically. If the carrier used has a magnetization intensity of 300 kA/m (300 emu/$cm^3$) or above, toner images with a high image quality may be obtained with difficulty. If on the other hand it has a magnetization intensity of 30 kA/m (30 emu/$cm^3$) or below, magnetic binding force may decrease to tend to cause carrier adhesion.

As described above, according to the present invention, the coating layer in a state of particulate matters being stuck to one another, containing at least a silicon compound (the coating layer formed of silicon-compound-containing particulate matters being stuck to one another) is provided on the toner particle surface. This can provide a toner which exhibits a good fluidity even without use of any fluidity-providing agent, can retain a stable electric charge quantity even in long-time running, and can form good images achievable of a high transfer efficiency.

In addition, according to the present invention, no fluidity-providing agent is used. Hence, a toner is provided which no longer has any possibility that the fluidity-providing agent becomes released from or buried in toner particles, even when development is repeated continuously, and can retain a good fluidity during running, promising a superior running performance.

According to the toner production process of the present invention, the toner having the above properties can be obtained with ease and stably.

Specific constitution of the toner of the present invention and its production process will be described below by giving Examples.

EXAMPLE 1-1

Production of Base-Particle Toner Particles:

Into a four-necked flask having a high-speed stirrer TK-type homomixer, 910 parts by weight of ion-exchanged water and 100 parts by weight of polyvinyl alcohol were added. The mixture obtained was heated to 55° C. with stirring at number of revolutions of 1,200 rpm, to prepare an aqueous dispersion medium. Meanwhile, materials shown below were dispersed for 3 hours by means of an attritor, and thereafter 3 parts by weight of a polymerization initiator 2,2'-azobis(2,4-dimethylvaleronitrile) was added to prepare a monomer dispersion.

(Composition of monomer dispersion)

| | (by weight) |
|---|---|
| Styrene monomer | 90 parts |
| n-Butyl acrylate monomer | 30 parts |
| Carbon black | 10 parts |
| Salicylic acid silane compound | 1 part |
| Release agent (paraffin wax 155) | 20 parts |

Next, the monomer dispersion thus obtained was introduced into the dispersion medium held in the above four-necked flask to carry out granulation for 10 minutes while maintaining the above number of revolutions. Subsequently, with stirring at 50 rpm, polymerization was carried out at 55° C. for 1 hour, then at 65° C. for 4 hours and further at 80° C. for 5 hours. After the polymerization was completed, the slurry formed was cooled, and was washed repeatedly with purified water to remove the dispersant, further followed by washing and then drying to obtain toner particles serving as base particles of a black toner.

A photograph of the toner particles was taken with a field-emission scanning electron microscope S-4500, manufactured by Hitachi Ltd. From this photograph, particle diameter of toner particles was measured so as to be measured on 300 particles or more in cumulation, and the number-average particle diameter was calculated to find that it was 8.30 $\mu$m. From this result, the standard deviation (S.D.) of number-average particle diameter was further calculated with a computer, and the coefficient of variation in number distribution of the toner particles was calculated therefrom according to the following expression. As the result, the coefficient of variation of the toner particles was 38.4%.

Coefficient of variation (%) of particles=[(standard deviation of number distribution)/(number-average particle diameter)]×100

Formation of Coating Layers Formed of Silicon-Compound-Containing Particulate Matters Being Stuck to one Another:

0.9 part by weight of the black toner particles obtained as described above were dispersed in 4.1 parts by weight of methanol. Thereafter, as the silicon compound, 2.5 parts by weight of tetraethoxysilane was dissolved therein, followed by further addition of 40 parts by weight of methanol. Then, the dispersion obtained was added dropwise in an alkaline solution prepared by mixing 100 parts by weight of methanol with 10 parts by weight of an aqueous 28% by weight $NH_4OH$ solution, and these were stirred at room temperature for 48 hours to build up films on the toner particle surfaces; the films being constituted of particles containing at least a polycondensate of the silicon compound.

After the reaction was completed, the particles obtained were washed with purified water, and then washed with methanol. Thereafter, the particles were filtered and dried to obtain a toner comprising toner particles covered with coating layers constituted of particles containing at least a polycondensate of the silicon compound.

The particle diameter of this toner was measured in the manner described above, to find that the number-average particle diameter was 8.33 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron prove microanalysis (EPMA) was found to be 15.32% by weight. The quantity of silicon atoms present in the toner's particle cross sections determined similarly was found to be 0.03% by weight. Therefore, the quantity of silicon atoms present on the toner's particle surfaces was 510.67 times the quantity of silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 11.4% by weight. Therefore, the percent loss of silicon atoms present on the particle surfaces of the toner after washing with the surface-active agent was 25.33%. Thus, it was ascertained that the coating layers formed on the particle surfaces of the toner obtained as described above were layers formed of silicon-compound-containing particulate matters being stuck to one another.

Subsequently, 5 parts by weight of the above toner and 95 parts by weight of carrier particles comprising ferrite cores having a particle diameter of 40 $\mu$m and coated with silicone resin were blended to prepare a two-component type developer. Then the charge quantity (quantity of triboelectricity) of the toner of this two-component type developer was measured in the following way to find that it was −32.60 mC/kg.

The charge quantity of the toner is measured in the following way.

10 g of the above two-component type developer is put into a 50 ml polyethylene bottle. This is shaked for 10 minutes by means of a paint shaker to charge the toner electrostatically. This is put in a blow-off powder charge quantity measuring unit (TB-200, manufactured by Toshiba Chemical Co., Ltd.) to make measurement using a sieve of 625 meshes while blowing nitrogen gas and at a pressure of $9.81\times10^{-2}$ MPa (1 kgf/cm$^2$). A value obtained after 30 seconds is regarded as charge quantity (mC/kg) of the toner.

Then, using the above developer, images were formed by means of a remodeled machine of a full-color laser copying machine CLC700, manufactured by CANON INC., (so remodeled as to drive at a process speed of 200 mm/sec and at a transfer current of 400 μA in an environment of 25° C./30% RH). The images were formed in an environment of temperature 25° C. and humidity 30% RH to evaluate the performances of the toner by the methods shown below. A 30,000-sheet running test was also made using the same machine. The charge quantity of the toner of the two-component type developer was measured after this running test to find that it was −32.10 mC/kg. Thus, it was confirmed that a stable charge quantity was retained in spite of the running.

Evaluation (1) Fixing Performance:

A solid image was copied on an OHP sheet. Thereafter, a part of the image formed was cut out and observed with a scanning electron microscope at 1,000 magnifications to evaluate fixing performance by examining whether or not any particle shape of the toner remained. As the result, no particle shape was observable, showing that the toner had been fixed well.

(2) Transfer Efficiency:

In the course of printing, at the stage where the toner was still not completely transferred, the copying machine was stopped being driven. First, quantity (A) of toner on the photosensitive member before transfer was measured, and then quantity (B) of toner not transferred to a recording medium and remaining on the photosensitive member was measured. Transfer efficiency was calculated according to the following expression.

$$\text{Transfer efficiency } (\%)=[\{(A)-(B)\}/(A)]\times 100$$

As the result, the transfer efficiency of the toner of the present Example was 98.5%, showing that the toner was transferred in a good state.

(3) Observation of Particle Surfaces of Toner After Running Test:

Particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

EXAMPLE 1-2

Production of Base-Particle Toner Particles:

Toner particles were produced by pulverization in the following way.

| | (by weight) |
|---|---|
| Styrene/butyl acrylate 80/20 copolymer | 100 parts |
| Carbon black | 6 parts |
| Chromium salt of di-tert-butylsalicylic acid | 4 parts |

The above materials were thoroughly premixed, and the mixture obtained was melt-kneaded. The kneaded product was cooled, and thereafter crushed with a hammer mill into particles of about 1 to 2 mm in diameter. Subsequently, the crushed product obtained was finely pulverized by means of a fine grinding mill of an air jet system. The finely pulverized product thus obtained was further classified using an Elbow Jet classifier to obtain toner particles serving as base particles of a black toner.

Like Example 1-1, a photograph of the toner particles was taken with a field-emission scanning electron microscope S-4500, manufactured by Hitachi Ltd. From this photograph, particle diameter of toner particles was measured so as to be measured on 300 particles or more in cumulation, and the number-average particle diameter was calculated to find that it was 8.9 μm.

Formation of Coating Layers Formed of Silicon-Compound-Containing Particulate Matters Being Stuck to one Another:

The subsequent procedure of Example 1-1 was repeated except for using the black toner particles obtained as described above were used as the base particles, to obtain a toner comprising toner particles covered with coating layers constituted of particles containing at least a polycondensate of the silicon compound.

The particle diameter of this toner was measured in the same manner as in Example 1-1, to find that the number-average particle diameter was 9.00 μm. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the e was found to be 15.24% by weight. The quantity of silicon atoms present in the toner's particle cross sections which was determined similarly was found to be 0.02% by weight. Therefore, the quantity of silicon atoms present on the toner's particle surfaces was 762.00 times the quantity of silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 11.66% by weight. Therefore, the percent loss of silicon atoms present on the particle surfaces of the toner after washing with the surface-active agent was 23.49%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 1-1. Then the charge quantity (quantity of triboelectricity) of the toner of this two-component type developer was measured to find that it was −33.40 mC/kg. Image evaluation using this developer was further made in the same manner as in Example 1-1 to obtain the results shown below. The charge quantity of the toner of the two-component type developer was measured after the running test to find that it was −32.80 mC/kg. Thus, it was confirmed that a relatively stable charge quantity was retained in spite of the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 98.2%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were slightly broken at some part, but were on the level of no problem.

EXAMPLE 1-3

In a mixed solvent prepared by dissolving 0.02 part by weight of polyvinyl alcohol in 20 parts by weight of a mixed solvent of ethanol/water=1:1 (weight ratio), 0.9 part by weight of the same black toner particles as the base particles used in Example 1-1 were dispersed, and then 5 parts by weight of 3-(methacryloxy)propyltrimethoxysilane as the silicon compound was dissolved therein. Subsequently, 120 parts by weight of water was slowly added dropwise to make the silicon compound have a lower solubility. After its addition was completed, the mixture obtained was further stirred for 5 hours to make the 3-(methacryloxy) propyltrimethoxysilane permeate into the toner particles so as to be made present therein.

Next, to this system, 20 parts by weight of an aqueous 28% by weight $NH_4OH$ solution was added, followed by stirring at room temperature for 12 hours to allow the sol-gel reaction to proceed on the toner particle surfaces, thus films constituted of particles containing at least a polycondensate of the silicon compound were formed thereon.

After the reaction was completed, the black toner particles obtained were washed with ethanol to wash away the unreacted silicon compound remaining in the particles, and were further filtered and dried to obtain a toner comprising toner particles covered with coating layers constituted of particles containing at least a polycondensate of the silicon compound.

The particle diameter of this toner was measured in the manner described previously, to find that the number-average particle diameter was 8.32 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron prove microanalysis (EPMA) was found to be 3.33% by weight. The quantity of silicon atoms present in the toner's particle cross sections which was determined similarly was found to be 0.25% by weight. Therefore, the quantity of silicon atoms present on the toner's particle surfaces was 13.32 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 2.98% by weight. Therefore, the percent loss of silicon atoms present on the particle surfaces of the toner after washing with the surface-active agent was 10.51%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −30.2 mC/kg. Image evaluation using this developer was further made in the same manner as in Example 1-1 to obtain the results shown below. The charge quantity of the toner of the two-component type developer was measured after the running test to find that it was −30.18 mC/kg. Thus, like Example 1-1, a stable charge quantity was retained in spite of the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 98.4%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

EXAMPLE 1-4

In 120 parts by weight of an aqueous 0.3% by weight sodium dodecyl sulfonate solution, 4 parts by weight of dibutyl phthalate was finely dispersed by means of an ultrasonic homogenizer to prepare a dibutyl phthalate emulsion. Next, 0.9 part by weight of the same black toner particles as those used in Example 1-1 were dispersed in 4.0 parts by weight of an aqueous 0.3% by weight sodium dodecyl sulfonate solution to prepare a dispersion of toner particles. Thereafter, the dibutyl phthalate emulsion obtained as described above was introduced into the dispersion of toner particles, followed by stirring at room temperature for 2 hours.

Next, a dispersion prepared by adding 5 parts by weight of 3-(methacryloxy)propyltrimethoxysilane as the silicon compound to 100 parts by weight of an aqueous 0.3% by weight sodium dodecyl sulfonate solution and finely dispersing them by means of an ultrasonic homogenizer was introduced into the dispersion of toner particles, followed by stirring at room temperature for 4 hours. Thus, the toner particles serving as base particles and the silicon compound were dispersed to make the 3-(methacryloxy) propyltrimethoxysilane become absorbed in the toner particles to incorporate the silicon compound into the toner particles.

Thereafter, 10 parts by weight of an aqueous 30% by weight $NH_4OH$ solution was introduced, followed by stirring at room temperature for 12 hours to allow the sol-gel reaction to proceed on the toner particle surfaces, thus films constituted of particles containing at least a polycondensate of the silicon compound were formed on the toner particles.

After the reaction was completed, ethanol was introduced in a large quantity into the system to remove unreacted 3-(methacryloxy)propyltrimethoxysilane and the dibutyl phthalate which were remaining in the particles. Next, the toner particles obtained were again washed with ethanol and then washed with purified water, followed by filtration and drying to obtain a toner of the present Example.

The particle diameter of the toner thus obtained was measured in the manner described previously, to find that the number-average particle diameter was 8.69 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 3.42% by weight. The quantity of silicon atoms present in the toner's particle cross sections which was determined similarly was found to be 0.25% by weight. Therefore, the quantity of silicon atoms present on the toner's particle surfaces was 13.68 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 3.04% by weight. Therefore, the percent loss of silicon atoms present on the particle surfaces of the toner after washing with the surface-active agent was 11.11%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −29.64 mC/kg. Image evaluation using this developer was made in the same manner as in Example 1-1 to obtain the results shown below. The charge quantity of the toner of the two-component type developer was measured after the running test to find that it was −29.60 mC/kg. Thus, like Example 1-1, a stable charge quantity was retained in spite of the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 98.4%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

EXAMPLE 1-5

A mixture solution prepared by mixing 2 parts by weight of isoamyl acetate and as the silicon compound 3.5 parts by weight of tetraethoxysilane and 0.5 part by weight of methyltriethoxysilane in combination was introduced into 30 parts by weight of an aqueous 0.3% by weight sodium dodecylbenzenesulfonate solution, followed by stirring by means of an ultrasonic homogenizer to prepare a dispersion of mixture of isoamyl acetate, tetraethoxysilane and methyltriethoxysilane.

Next, the dispersion of mixture of isoamyl acetate and silicon compound thus obtained was introduced into a dispersion prepared by dispersing in 30 parts by weight of an aqueous 0.3% by weight sodium dodecylbenzenesulfonate solution 0.9 part by weight of the same black toner particles as those used in Example 1-1, followed by stirring at room temperature for 2 hours to incorporate the silicon compound into the toner particles.

Next, 5 parts by weight of an aqueous 28% by weight $NH_4OH$ solution was mixed, followed by stirring at room temperature for 12 hours to allow the sol-gel reaction to proceed, thus films constituted of particles containing at least a polycondensate of the silicon compound were formed on the toner particles.

Next, ethanol was introduced in a large quantity into the system to remove unreacted tetraethoxysilane and methyltriethoxysilane and the isoamyl acetate from the insides of the toner particles. The particles were further washed with ethanol and then washed with purified water, followed by filtration and drying to obtain a toner.

The particle diameter of the toner thus obtained was measured in the manner described previously, to find that the number-average particle diameter was 8.74 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 3.15% by weight. The quantity of silicon atoms present in the toner's particle cross sections which was determined similarly was found to be 0.33% by weight. Therefore, the quantity of silicon atoms present on the toner's particle surfaces was 9.55 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 2.98% by weight. Therefore, the percent loss of silicon atoms present on the particle surfaces of the toner after washing with the surface-active agent was 5.40%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −28.24 mC/kg. Image evaluation using this developer was made in the same manner as in Example 1-1 to obtain the results shown below. The charge quantity of the toner of the two-component type developer was measured after the running test to find that it was −28.21 mC/kg. Thus, like Example 1-1, a stable charge quantity was retained in spite of the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 98.4%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

(4) Toner Scatter:

How the toner image formed on the drum (photosensitive member) scattered was visually examined. As a result, the toner was found to have scattered in a slightly larger quantity than the original toner particles.

EXAMPLE 1-6

A toner of the present Example was obtained in the same manner as in Example 1-5 except that the addition of the dispersion of silicon compound to the dispersion of toner particles was changed to a method of adding the dispersion of toner particles to the dispersion of silicon compound.

The particle diameter of the toner thus obtained was measured in the manner described previously, to find that the number-average particle diameter was 8.49 $\mu$m. The coefficient of variation in number distribution of this toner was 38.8%, showing substantially the same coefficient of variation as the original toner particles. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 3.75% by weight. The quantity of silicon atoms present in the toner's particle cross sections which was determined similarly was found to be 0.31% by weight. Therefore, the quantity of silicon atoms present on the toner's particle surfaces was 12.10 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 3.63% by weight. Therefore, the percent loss of silicon atoms present on the particle surfaces of the toner after washing with the surface-active agent was 3.20%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −31.80 mC/kg. Image evaluation using this developer was made in the same manner as in Example 1-1 to obtain the results shown below. The charge quantity of the toner of the two-component type developer was measured after the running test to find that it was −31.78 mC/kg. Thus, like Example 1-1, a stable charge quantity was retained in spite of the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 97.5%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

EXAMPLE 1-7

Using as a one-component type developer the toner obtained in Example 1-1, the developer was loaded in a remodeled machine of a commercially available electrophotographic copying machine FC-2, manufactured by CANON INC. A running test to form a solid white image on 30,000 sheets was made in an environment of temperature 25° C. and humidity 30% RH to make evaluation in the same manner as in Example 1-1 to obtain the results as shown below.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 98.6%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

The charge quantity (quantity of triboelectricity) of the toner used as the one-component type developer was measured in the following way to find that it was −30.70 mC/kg. The charge quantity of the one-component type developer (toner) after the 30,000-sheet running test was −30.30 mC/kg, showing that a stable charge quantity was retained even after the running.

The charge quantity of the above toner is measured in the following way.

9.5 g of iron-powder carrier (EFV-100/200) and 0.5 of the toner are put into a 50 ml polyethylene bottle. This is shaked for 10 minutes by means of a paint shaker to charge the toner electrostatically. This is put in a blow-off powder charge quantity measuring unit (TB-200, manufactured by Toshiba Chemical Co., Ltd.) to make measurement using a sieve of 625 meshes while blowing nitrogen gas and at a pressure of $9.81\times10^{-2}$ MPa (1 kgf/cm$^2$). A value obtained after 30 seconds is regarded as charge quantity (mC/kg) of the toner.

EXAMPLE 1-8

Polymerization was carried out in the same manner as the polymerization in Example 1-1 except that to the composition of the monomer dispersion used therein 5 parts by weight of tetraethoxysilane was further added as the silicon compound and also the aqueous $NH_4OH$ solution was added in that system to make the monomer dispersion alkaline. (As the result, the silicon compound to be incorporated into the toner particles when the polymerization toner is produced can be made to readily cause the sol-gel reaction by heat.) Thereafter, the toner particles were washed with a large quantity of ethanol to remove unreacted tetraethoxysilane, further followed by filtration and drying to obtain a toner comprising toner particles provided with coating layers constituted of particles containing at least a polycondensate of the silicon compound.

The particle diameter of the toner thus obtained was measured in the manner described previously, to find that the number-average particle diameter was 8.65 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 10.12% by weight. The quantity of silicon atoms present in the toner's particle cross sections which was determined similarly was found to be 5.75% by weight. Therefore, the quantity of silicon atoms present on the toner's particle surfaces was 1.76 times the quantity of silicon atoms present in the toner's particle cross sections, thus the polycondensate of the silicon compound was found also present inside the particle of the toner.

The quantity of silicon atoms present on the toner's particle surfaces after the toner was washed with an aqueous 5% by weight dodecylbenzenesulfonic acid solution was also found to be 9.84% by weight. Therefore, the percent loss of silicon atoms present on the particle surfaces of the toner after washing with the surface-active agent was 2.77%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −33.24 mC/kg. Image evaluation using this developer was made in the same manner as in Example 1-1 to obtain the results shown below. The charge quantity of the toner of the two-component type developer was measured after the running test to find that it was −32.84 mC/kg. Thus, it was stable even after the running.

Evaluation (1) Fixing Performance:

Evaluated in the same manner as in Example 1-1. As the result, particle shape of the toner was partly observable, showing that the toner had a fixing performance inferior to that in other Examples. However, the image was smooth on the whole, and there was no problem in practical use.

(2) Transfer Efficiency:

Transfer efficiency was calculated in the same manner as in Example 1-1.

As the result, the transfer efficiency of the toner of the present Example was 98.5%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

EXAMPLE 1-9

A toner comprising toner particles provided with coating layers constituted of particles containing at least a polycondensate of the silicon compound was obtained in the same manner as in Example 1-1 except that when the sol-gel reaction was carried out the tetraethoxysilane was added in an amount of 0.5 part by weight.

The particle diameter of the toner thus obtained was measured in the manner described previously, to find that the number-average particle diameter was 8.35 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 0.08% by weight. The quantity of silicon atoms present in the toner's particle cross sections which was determined similarly was found to be 0.01% by weight. Therefore, the quantity of silicon atoms present on the toner's particle surfaces was 8.00 times the quantity of silicon atoms present in the toner's particle cross sections.

The quantity of silicon atoms present on the toner's particle surfaces after the toner was washed with an aqueous 5% by weight dodecylbenzenesulfonic acid solution was also found to be 0.06% by weight. Therefore, the percent loss of silicon atoms present on the particle surfaces of the toner after washing with the surface-active agent was 25.00%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −26.01 mC/kg. Image evaluation using this developer was made in the same manner as in Example 1-1 to obtain the results shown below. The charge quantity of the toner of the two-component type developer was measured after the running test to find that it was −25.51 mC/kg. Thus, it was stable even after the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 97.2%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

EXAMPLE 1-10

A toner comprising toner particles provided with coating layers constituted of particles containing at least a polycondensate of the silicon compound was obtained in the same manner as in Example 1-1 except that when the sol-gel reaction was carried out the tetraethoxysilane was added in an amount of 6.0 parts by weight.

The particle diameter of the toner thus obtained was measured in the manner described previously, to find that the number-average particle diameter was 8.79 $\mu$m. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 10.33% by weight. The quantity of silicon atoms present in the toner's particle cross sections which was determined similarly was found to be 0.04% by weight. Therefore, the quantity of silicon atoms present on the toner's particle surfaces was 258.25 times the quantity of silicon atoms present in the toner's particle cross sections, thus the polycondensate of the silicon compound was found present on the particle surfaces of the toner in a large quantity.

The quantity of silicon atoms present on the toner's particle surfaces after the toner was washed with an aqueous 5% by weight dodecylbenzenesulfonic acid solution was also found to be 7.66% by weight. Therefore, the percent loss of silicon atoms present on the particle surfaces of the toner after washing with the surface-active agent was 25.85%. Thus, it was ascertained that the coating layers formed on the particle surfaces of the toner obtained as described above were layers formed of silicon-compound-containing particulate matters being stuck to one another.

Using the toner thus obtained, a two-component type developer was prepared in the same manner as in Example 1-1. The charge quantity (quantity of triboelectricity) of the toner of this two-component type developer was measured to find that it was −33.59 mC/kg. Image evaluation using this developer was made in the same manner as in Example 1-1 to obtain the results shown below. The charge quantity of the toner of the two-component type developer was measured after the running test to find that it was −32.99 mC/kg. Thus, it was stable even after the running.

Evaluation (1) Fixing Performance:

Evaluated in the same manner as in Example 1-1. As the result, particle shape of the toner was partly observable, showing that the toner had a fixing performance inferior to that in other Examples. However, the image was smooth on the whole, and there was no problem in practical use.

(2) Transfer Efficiency:

Transfer efficiency was calculated in the same manner as in Example 1-1.

As the result, the transfer efficiency of the toner of the present Example was 98.7%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

COMPARATIVE EXAMPLE 1-1

A two-component type developer was prepared in the same manner as in Example 1-1 except that the black toner particles obtained therein were used as they were, without forming the coating layers on their surfaces. The charge quantity (quantity of triboelectricity) of the toner of this two-component type developer was measured to find that it was −10.4 mC/kg. Image evaluation using this developer was made in the same manner as in Example 1-1 to obtain the results shown below. The charge quantity of the toner of the two-component type developer was measured after the running test to find that it was −8.95 mC/kg. Thus, the charge quantity was found to have decreased a little as a result of the running.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 68.9%, which was inferior when compared with Examples.

COMPARATIVE EXAMPLE 1-2

To 100 parts by weight of the same black toner particles as those obtained in Example 1-1, 5 parts by weight of hydrophobic fine silica powder having a weight-average particle diameter of 40 nm was added. These were mixed using a Henschel mixer to obtain a toner in which the silica fine powder was added externally as a fluidity-providing agent.

The particle diameter of the toner thus obtained was measured in the manner described previously, to find that the number-average particle diameter was 8.33 $\mu$m. This toner was observed on a scanning electron microscope photograph. As a result, although particulate matters were observable on the particle surfaces of the toner, many breaks or openings were present between individual particles and no filmlike matter was formed. Also, cross sections of the particles of this toner were observed on a transmission electron microscope photograph. As a result, although particles were present or discontinuous layers were seen in places on the toner's particle surfaces, no continuous layers were seen.

The quantity of silicon atoms present on the particle surfaces of the toner as determined by the electron probe microanalysis (EPMA) was found to be 0.45% by weight. The quantity of silicon atoms present in the toner's particle cross sections which was determined similarly was found to be 0.00% by weight.

The quantity of silicon atoms present on the toner's particle surfaces after the toner was washed with an aqueous 5% by weight dodecylbenzenesulfonic acid solution was also found to be 0.30% by weight. Therefore, the percent loss of silicon atoms present on the particle surfaces of the toner after washing with the surface-active agent was 33.33%. Thus, because of a high percent loss of silicon atoms as a result of the washing with the surface-active agent, the particulate matters on the particle surfaces of the toner was not recognizable as coating layers formed of particulate matters being stuck to one another.

Using the toner thus obtained, a two-component type developer was prepared in the same manner as in Example 1-1. The charge quantity (quantity of triboelectricity) of the toner of this two-component type developer was measured to find that it was −29.8 mC/kg. Image evaluation using this developer was made in the same manner as in Example 1-1 to obtain the results shown below. The charge quantity of the toner of the two-component type developer was measured after the running test to find that it was −26.4 mC/kg. Thus, the charge quantity was found to have decreased a little.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Comparative Example was 89.7%, which was a little inferior to those in Examples.

(3) Observation of Particle Surfaces of Toner After Running Test:

In the same manner as in Example 1-1, particle surfaces of the toner after the running test were observed on a scanning electron microscope photograph. As a result, the silica particles added externally stood free in places or stood buried in the toner particles, and many breaks or openings were seen between individual silica particles.

Characteristics of the toner particles and toners produced in Examples 1-1 to 1-10 and Comparative Examples 1-1 and 1-2 are summarized in Table 1. The results of evaluation tests made using the developers making use of the toners produced in Examples 1-1 to 1-10 and Comparative Examples 1-1 and 1-2 are summarized in Table 2.

In Table 2, the fixing performance is the one evaluated on images developed and fixed on OHP sheets and thereafter observed with a scanning electron microscope at 1,000 magnifications. Evaluated as shown below.

A: Any area where the particle shape of toner remains is not observable.

B: Areas where the particle shape of toner remains are present in places.

C: Areas where the particle shape of toner remains are present almost overall.

EXAMPLE 2-1

Production of Base-Particle Toner Particles:

Into a four-necked flask having a high-speed stirrer TK-type homomixer, 910 parts by weight of ion-exchanged water and 100 parts by weight of polyvinyl alcohol. The mixture obtained was heated to 55° C. with stirring at number of revolutions of 1,200 rpm, to prepare an aqueous dispersion medium. Meanwhile, materials shown below were dispersed for 3 hours by means of an attritor, and thereafter 3 parts by weight of a polymerization initiator 2,2'-azobis(2,4-dimethylvaleronitrile) was added to prepare a monomer dispersion.

(Composition of monomer dispersion)

| | (by weight) |
|---|---|
| Styrene monomer | 85 parts |
| n-Butyl acrylate monomer | 35 parts |
| Carbon black | 12 parts |
| Salicylic acid silane compound | 1.5 parts |
| Release agent (paraffin wax 155) | 20 parts |

Next, the monomer dispersion thus obtained was introduced into the dispersion medium held in the above four-necked flask to carry out granulation for 10 minutes while maintaining the above number of revolutions. Subsequently, with stirring at 50 rpm, polymerization was carried out at 55° C. for 1 hour, then at 65° C. for 4 hours and further at 80° C. for 5 hours. After the polymerization was completed, the slurry formed was cooled, and was washed repeatedly with purified water to remove the dispersant, further followed by washing and then drying to obtain toner particles serving as base particles of a black toner.

A photograph of the toner particles was taken with a field-emission scanning electron microscope S-4500, manufactured by Hitachi Ltd. From this photograph, particle diameter of toner particles was measured so as to be measured on 300 particles or more in cumulation, and the number-average particle diameter was calculated to find that it was 8.30 $\mu$m. From this result, the standard deviation (S.D.) of number-average particle diameter was further calculated with a computer, and the coefficient of variation in number distribution of the toner particles was calculated therefrom. As the result, the coefficient of variation of the toner particles was 38.4%.

Formation of Coating Layers Formed of Silicon-Compound-Containing Particulate Matters Being Stuck to one Another:

0.9 part by weight of the black toner particles obtained as described above were dispersed in 3.5 parts by weight of methanol. Thereafter, as the silicon compound, 3.0 parts by weight of tetraethoxysilane and 0.5 part by weight of methyltriethoxysilane in combination were dissolved therein, followed by further addition of 40 parts by weight of methanol. Then, the dispersion obtained was added dropwise in an alkaline solution prepared by mixing 100 parts by weight of methanol with 10 parts by weight of an aqueous 28% by weight $NH_4OH$ solution, and these were stirred at room temperature for 12 hours to build up films on the toner particle surfaces; the films being constituted of particles containing at least a polycondensate of the silicon compound.

Next, this reaction system was heated to 50° C., and the evaporated matter was cooled and was driven off out of the system to remove the ammonia held in the system. Thereafter, methanol was so added that the liquid quantity came to be substantially the same level as that before heating, and acetic acid was further continued being slowly added until the pH came to be 2. Subsequently, 0.2 part by weight of dimethylethoxysilane was added to this system, followed by stirring for 30 minutes to make coupling treatment. Thereafter, the particles were filtered and washed repeatedly and then dried to obtain a toner of the present Example.

The particle diameter of this toner was measured in the manner described previously, to find that the number-average particle diameter was 8.65 $\mu$m. Particle surfaces of this toner were observed on a scanning electron microscope photograph. As a result, coating layers having fine particulate unevenness each having a diameter of about 45 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 16.32% by weight. The quantity of silicon atoms present in the toner's particle cross sections which was determined similarly was found to be 0.03% by weight. Therefore, the quantity of silicon atoms present on the toner's particle surfaces was 544 times the quantity of silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 15.34% by weight. Therefore, the percent loss of silicon atoms present on the particle surfaces of the toner after washing with the surface-active agent was 6.00%. Thus, it was ascertained that the coating layers formed on the particle surfaces of the toner obtained as described above were layers formed of silicon-compound-containing particulate matters being stuck to one another.

Subsequently, 5 parts by weight of the above toner and 95 parts by weight of carrier particles comprising ferrite cores having a particle diameter of 40 $\mu$m and coated with silicone resin were blended to prepare a two-component type developer. Then the charge quantity (quantity of triboelectricity) of the toner of this two-component type developer was measured to find that it was −32.46 mC/kg.

Then, using the above developer, images were formed by means of the same remodeled machine of a full-color laser copying machine CLC700, manufactured by CANON INC., as that used in Example 1-1, in an environment of temperature 25° C. and humidity 30% RH to evaluate the performances of the toner by the methods shown below. A 30,000-sheet running test was also made using the same machine. The charge quantity of the toner of the two-component type developer was measured after this running test to find that it was −31.86 mC/kg. Thus, it was confirmed that a stable charge quantity was retained in spite of the running. Images were not seen to deteriorate throughout the running, and were kept good. These results are shown in Table 4.

Evaluation (1) Fixing Performance:

Evaluated in the same manner as in Example 1-1. As the result, no particle shape was observable, showing that the toner had been fixed well.

(2) Transfer Efficiency:

Transfer efficiency was calculated in the same manner as in Example 1-1.

As the result, the transfer efficiency of the toner of the present Example was 98.6%, showing that the toner was transferred in a good state.

(3) Observation of Particle Surfaces of Toner After Running Test:

In the same manner as in Example 1-1, particle surfaces of the toner after the running test were observed on a scanning electron microscope photograph. As a result, the coating layers on the particle surfaces of the toner, constituted of particles containing at least a polycondensate of the silicon compound were not broken to find that the toner retained substantially the same surface state of particles as the toner before the running test.

The same evaluation as the above were also made in an environment of temperature 30° C. and humidity 80% RH. As a result, the charge quantity of the toner at the running initial stage was −32.22 mC/kg, and was less affected by environmental changes. The charge quantity of the toner after the 30,000-sheet running was −31.74 mC/kg. Thus, no great decrease in charge quantity as a result of the running was seen even in the environment of high temperature and high humidity. Images formed were also stable, and were kept good.

EXAMPLE 2-2

In the same manner as in Example 2-1, coating layers constituted of particles containing a polycondensate of the silicon compound were provided, followed by filtration and washing which were carried out repeatedly. The particles thus separated by filtration were again dispersed in 40 parts by weight of alcohol, and were subjected to coupling treatment in the same manner as in Example 2-1 to obtain a toner of the present Example.

The particle diameter of this toner was measured in the manner described previously, to find that the number-average particle diameter was 8.45 μm. Particle surfaces of this toner were observed on a scanning electron microscope photograph. As a result, coating layers having fine particulate unevenness were observable on the particle surfaces of the toner. Also, cross sections of the particles of this toner were observed on a transmission electron microscope photograph to ascertain that the coating layers were formed on the particle surfaces of this toner. Also, from this scanning-electron-microscopic observation of the toner particle surfaces, the diameter of the fine particles on that surfaces was measured to determine the number-average particle diameter of in-layer fine particles on toner particle surfaces, which was found to be 43 nm.

Then, the quantity of silicon atoms present on the particle surfaces of the toner as determined by the electron probe microanalysis (EPMA) was found to be 15.98% by weight. The quantity of silicon atoms present in the toner's particle cross sections which was determined similarly was found to be 0.02% by weight. Therefore, the quantity of silicon atoms present on the toner's particle surfaces was 799 times the quantity of silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 15.39% by weight. Therefore, the percent loss of silicon atoms present on the particle surfaces of the toner after washing with the surface-active agent was 3.69%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −31.15 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −30.77 mC/kg. Thus, it was confirmed that a stable charge quantity was retained in spite of the running. Images were not seen to deteriorate throughout the running, and were kept good. These results are shown in Table 4.

The same measurement was also made in an environment of temperature 30° C. and humidity 80% RH. As a result, the charge quantity of the toner at the running initial stage was −30.86 mC/kg, and was less affected by environmental changes. The charge quantity of the toner after the 30,000-sheet running was −30.35 mC/kg. Thus, no great decrease in charge quantity as a result of the running was seen even in the environment of high temperature and high humidity. Images formed were also kept good.

EXAMPLE 2-3

In the same manner as in Example 2-1, toner particles were produced on the surfaces of which the coating layers constituted of particles containing a polycondensate of the silicon compound had been formed. After the coating layers were formed, the toner particles were thoroughly washed, filtered, and then dried to separate them. Next, a 25% methanol solution of dimethylethoxysilane was prepared. The toner particles obtained in the manner described above was agitated for 20 minutes in a Henschel mixer while spraying 10 parts by weight of the above methanol solution on 50 parts by weight of that particles, followed by drying with fluidization to produce a toner.

The particle diameter of this toner was measured in the manner described previously, to find that the number-average particle diameter was 8.82 μm. Particle surfaces of this toner were observed on a scanning electron microscope photograph. As a result, coating layers having fine particulate unevenness each having a diameter of about 50 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 15.87% by weight. The quantity of silicon atoms present in the toner's particle cross sections which was determined similarly was found to be 0.03% by weight. Therefore, the quantity of silicon atoms present on the toner's particle surfaces was 529 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 15.28% by weight. Therefore, the percent loss of silicon atoms present on the particle surfaces of the toner after washing with the surface-active agent was 3.72%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −31.52 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −31.13 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −31.33 mC/kg, and was less affected by environmental changes. The charge quantity of the toner after the 30,000-sheet running was −30.86 mC/kg. Thus, no great decrease in charge quantity as a result of the running was seen even in the environment of high temperature and high humidity. Images formed were also kept good. These results are shown in Table 4.

EXAMPLE 2-4

The procedure of production process of Example 2-1 was repeated except that the coupling agent was replaced with titanium ethoxide. Thus, a toner comprising toner particles having coating layers containing silicon, having been treated with a titanium coupling agent, was obtained.

The particle diameter of this toner was measured in the manner described previously, to find that the number-average particle diameter was 8.69 μm. Particle surfaces of this toner were observed on a scanning electron microscope photograph. As a result, coating layers having fine particulate unevenness each having a diameter of about 46 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 13.55% by weight. The quantity of silicon atoms present in the toner's particle cross sections which was determined similarly was found to be 0.03% by weight. Therefore, the quantity of silicon atoms present on the toner's particle surfaces was 452 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 12.56% by weight. Therefore, the percent loss of silicon atoms present on the particle surfaces of the toner after washing with the surface-active agent was 7.31%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −33.21 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −32.77 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −33.00 mC/kg, and was less affected by environmental changes. The charge quantity of the toner after the 30,000-sheet running was −32.48 mC/kg. Thus, no great decrease in charge quantity as a result of the running was seen even in the environment of high temperature and high humidity. Images formed were also kept good. These results are shown in Table 4.

EXAMPLE 2-5

The procedure of production process of Example 2-1 was repeated except that the coupling agent was replaced with aluminum(III) n-butoxide. Thus, a toner comprising toner particles having coating layers containing silicon, having been treated with an aluminum coupling agent, was obtained.

The particle diameter of this toner was measured in the manner described previously, to find that the number-average particle diameter was 8.74 μm. Particle surfaces of this toner were observed on a scanning electron microscope photograph. As a result, coating layers having fine particulate unevenness each having a diameter of about 48 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 12.54% by weight. The quantity of silicon atoms present in the toner's particle cross sections which was determined similarly was found to be 0.02% by weight. Therefore, the quantity of silicon atoms present on the toner's particle surfaces was 627 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 11.57% by weight. Therefore, the percent loss of silicon atoms present on the particle surfaces of the toner after washing with the surface-active agent was 7.74%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −33.25 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −32.90 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −30.92 mC/kg, and was less affected by environmental changes. The charge quantity of the toner after the 30,000-sheet running was −30.40 mC/kg. Thus, no great decrease in charge quantity as a result of the running was seen even in the environment of high temperature and high humidity. Images formed were also kept good. These results are shown in Table 4.

EXAMPLE 2-6

The procedure of production process of Example 2-1 was repeated except that the coupling agent was replaced with methacryloxypropylmethyldimethoxysilane. Thus, a toner comprising toner particles having coating layers containing silicon, having been treated with a silane coupling agent, was obtained.

The particle diameter of this toner was measured in the manner described previously, to find that the number-average particle diameter was 8.69 μm. Particle surfaces of this toner were observed on a scanning electron microscope photograph. As a result, coating layers having fine particulate unevenness each having a diameter of about 48 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 16.54% by weight. The quantity of silicon atoms present in the toner's particle cross sections which was determined similarly was found to be 0.03% by weight. Therefore, the quantity of silicon atoms present on the toner's particle surfaces was 551 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 15.67% by weight. Therefore, the percent loss of silicon atoms present on the particle surfaces of the toner after washing with the surface-active agent was 5.26%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −31.41 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −31.01 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −33.76 mC/kg, and was less affected by environmental changes. The charge quantity of the toner after the 30,000-sheet running was −33.23 mC/kg. Thus, no great decrease in charge quantity as a result of the running was seen even in the environment of high temperature and high humidity. Images formed were also kept good. These results are shown in Table 4.

EXAMPLE 2-7

The procedure of Example 2-1 was repeated except that the coupling agent was replaced with hexamethyldisilazane, to obtain the intended toner.

The particle diameter of this toner was measured in the manner described previously, to find that the number-average particle diameter was 8.82 μm. Particle surfaces of this toner were observed on a scanning electron microscope photograph. As a result, coating layers having fine particulate unevenness each having a diameter of about 50 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 16.25% by weight. The quantity of silicon atoms present in the toner's particle cross sections which was determined similarly was found to be 0.03% by weight. Therefore, the quantity of silicon atoms present on the toner's particle surfaces was 542 times the quantity of silicon atoms present in the toner's particle cross sections, thus the polycondensate of the silicon compound was found only slightly present inside the particles of the toner.

The quantity of silicon atoms present on the toner's particle surfaces after the toner was washed with an aqueous 5% by weight dodecylbenzenesulfonic acid solution was also found to be 15.41% by weight. Therefore, the percent loss of silicon atoms present on the particle surfaces of the toner after washing with the surface-active agent was 5.17%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −32.11 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −31.69 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −31.89 mC/kg, and was less affected by environmental changes. The charge quantity of the toner after the 30,000-sheet running was −31.43 mC/kg. Thus, no great decrease in charge quantity as a result of the running was seen even in the environment of high temperature and high humidity. Images formed were also kept good. These results are shown in Table 4.

EXAMPLE 2-8

The procedure of Example 2-1 was repeated except that the coupling agent was replaced with 2.0 parts by weight dimethylethoxysilane, to obtain the intended toner.

The particle diameter of this toner was measured in the manner described previously, to find that the number-average particle diameter was 8.99 μm. Particle surfaces of this toner were observed on a scanning electron microscope photograph. As a result, coating layers having fine particulate unevenness each having a diameter of about 54 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 17.02% by weight. The quantity of silicon atoms present in the toner's particle cross sections which was determined similarly was found to be 0.02% by weight. Therefore, the quantity of silicon atoms present on the toner's particle surfaces was 851 times the quantity of silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 16.24% by weight. Therefore, the percent loss of silicon atoms present on the particle surfaces of the toner after washing with the surface-active agent was 4.58%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −33.24 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −32.65 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −32.98 mC/kg, and was less affected by environmental changes. The charge quantity of the toner after the 30,000-sheet running was −32.47 mC/kg. Thus, no great decrease in charge quantity as a result of the running was seen even in the environment of high temperature and high humidity. Images formed were also kept good. These results are shown in Table 4.

EXAMPLE 2-9

The procedure of Example 2-1 was repeated except that as the coupling agent the dimethylethoxysilane was added in an amount of 0.1 part by weight, to obtain the intended toner.

The particle diameter of this toner was measured in the manner described previously, to find that the number-average particle diameter was 8.55 μm. Particle surfaces of this toner were observed on a scanning electron microscope photograph. As a result, coating layers having fine particulate unevenness each having a diameter on the order of nanometers of about 44 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) was found to be 15.35% by weight. The quantity of silicon atoms present in the toner's particle cross sections which was determined similarly was found to be 0.02% by weight. Therefore, the quantity of silicon atoms present on the toner's particle surfaces was 768 times the quantity of silicon atoms present in the toner's particle cross sections.

The quantity of silicon atoms present on the toner's particle surfaces after the toner was washed with an aqueous 5% by weight dodecylbenzenesulfonic acid solution was also found to be 14.46% by weight. Therefore, the percent loss of silicon atoms present on the particle surfaces of the toner after washing with the surface-active agent was 5.80%. Thus, it was ascertained that the coating layers formed on the particle surfaces of the toner obtained as described above were layers formed of silicon-compound-containing particulate matters being stuck to one another.

Subsequently, using the toner thus obtained, a two-component type developer was prepared in the same manner as in Example 2-1. Then the charge quantity (quantity of triboelectricity) of the toner of this two-component type developer was measured in an environment of temperature 25° C. and humidity 30% RH to find that it was −32.54 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −31.10 mC/kg. Thus, it was confirmed that a stable charge quantity was retained in spite of the running. Images were not seen to deteriorate throughout the running, and were kept good.

The same measurement was also made in an environment of temperature 30° C. and humidity 80% RH. As a result, the charge quantity of the toner at the running initial stage was −30.89 mC/kg, and was less affected by environmental changes. The charge quantity of the toner after the 30,000-sheet running was −30.40 mC/kg. Thus, no great decrease in charge quantity as a result of the running was seen even in the environment of high temperature and high humidity. Images formed were also kept good. These results are shown in Table 4.

COMPARATIVE EXAMPLE 2-1

A two-component type developer was prepared in the same manner as in Example 2-1 except that the black toner particles obtained therein were used as they were, without forming the coating layers on their surfaces. The charge quantity (quantity of triboelectricity) of the toner of this two-component type developer was measured in an environment of temperature 25° C. and humidity 30% RH to find that it was −10.40 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −8.95 mC/kg. Thus, the charge quantity was found to have decreased a little as a result of the running.

The same measurement was also made in an environment of temperature 30° C. and humidity 80% RH. As a result, the charge quantity of the toner at the running initial stage was −5.24 mC/kg, which was a value lower than the initial charge quantity in the environment of temperature 25° C. and humidity 30% RH, thus environmental variations of charge quantity were observable. The charge quantity of the toner after the 30,000-sheet running was −3.32 mC/kg. Thus, the charge quantity was found to have decreased as a result of the running also in the environment of high temperature and high humidity. These results are shown in Table 4.

COMPARATIVE EXAMPLE 2-2

To 100 parts by weight of the same black toner particles as those obtained in Example 2-1, 5 parts by weight of hydrophobic fine silica powder having a weight-average particle diameter of 40 nm was added. These were mixed using a Henschel mixer to obtain a toner in which the silica fine powder was added externally as a fluidity-providing agent.

The particle diameter of the toner thus obtained was measured in the manner described previously, to find that the number-average particle diameter was 8.33 $\mu$m. This toner was observed on a scanning electron microscope photograph. As a result, although particulate matters were observable on the particle surfaces of the toner, many breaks or openings were present between individual particles and no filmlike matter was formed. Also, cross sections of the particles of this toner were observed on a transmission electron microscope photograph. As a result, although particles were present or discontinuous layers were seen in places on the toner's particle surfaces, no continuous layers were seen.

The quantity of silicon atoms present on the particle surfaces of the toner as determined by the electron probe microanalysis (EPMA) was found to be 0.45% by weight. The quantity of silicon atoms present in the toner's particle cross sections which was determined similarly was found to be 0.00% by weight.

The quantity of silicon atoms present on the toner's particle surfaces after the toner was washed with an aqueous 5% by weight dodecylbenzenesulfonic acid solution was also found to be 0.30% by weight. Therefore, the percent loss of silicon atoms present on the particle surfaces of the toner after washing with the surface-active agent was 33.33%. Thus, because of a high percent loss of silicon atoms as a result of the washing with the surface-active agent, the particulate matters on the particle surfaces of the toner was not recognizable as coating layers formed of particulate matters being stuck to one another.

Using the toner thus obtained, a two-component type developer was prepared in the same manner as in Example 2-1. The charge quantity (quantity of triboelectricity) of the toner of this two-component type developer was measured to find that it was −29.8 mC/kg.

Then, using this developer, images were formed by means of the remodeled machine of a full-color laser copying machine CLC700, manufactured by CANON INC., in an environment of temperature 25° C. and humidity 30% RH to make the same 30,000-sheet running test as that in Example 2-1. The charge quantity of the toner of the two-component type developer was measured after this running test to find that it was −26.40 mC/kg. Thus, the charge quantity was found to have decreased a little as a result of the running.

The same measurement was also made in an environment of temperature 30° C. and humidity 80% RH. As a result, the charge quantity of the toner at the running initial stage was −19.45 mC/kg, which was a value lower than the initial charge quantity in the environment of temperature 25° C. and humidity 30% RH, thus environmental variations of charge quantity were observable. The charge quantity of the toner after the 30,000-sheet running was −17.23 mC/kg. Thus, the charge quantity was found to have decreased as a result of the running also in the environment of high temperature and high humidity. These results are shown in Table 4.

Characteristics of the toner particles and toners produced in Examples 2-1 to 2-9 and Comparative Examples 2-1 and 2-2 are summarized in Table 3. The results of evaluation tests made using the developers making use of the toners produced in Examples 2-1 to 2-9 and Comparative Examples 2-1 and 2-2 are summarized in Table 4.

EXAMPLE 3-1

Production of Base-Particle Toner Particles:

First, toner particles were produced in the following way.

| | (by weight) |
|---|---|
| Methanol | 95 parts |
| Styrene | 40 parts |
| Polyvinyl pyrrolidone | 5 parts |
| n-Butyl acrylate | 10 parts |
| 2,2'-Azobisisobutyronitrile | 2 parts |
| Carbon black | 2 parts |

The above materials were thoroughly stirred to dissolve or disperse them, and thereafter put into a reaction vessel displaced with nitrogen, followed by heating to 65° C. in a stream of nitrogen to carry out reaction for 20.0 hours. The reaction product thus obtained was filtered, and the filtrate obtained was diluted with methanol and then thoroughly stirred. Thereafter, this was again filtered. The operation of this dilution and washing was repeatedly made three times in total. Next, the filtrate thus obtained was thoroughly dried in a vacuum drier to obtain black toner particles. The black toner particles thus obtained had a number-average particle diameter of 5.04 μm and a standard deviation of 0.61. Therefore, the coefficient of variation in number distribution of the toner particles was 12.10%.

Formation of Coating Layers Formed of Silicon-Compound-Containing Particulate Matters Being Stuck to one Another:

0.9 part by weight of the black toner particles obtained in the manner described above were dispersed in 40 parts by weight of methanol. Thereafter, 2.5 parts by weight of tetraethoxysilane was dissolved therein. Then, the dispersion obtained was added dropwise with stirring in a mixed solvent prepared by adding 100 parts by weight of methanol to 10 parts by weight of an aqueous 28% by weight $NH_4OH$ solution, and these were stirred at room temperature for 48 hours to build up films on the toner particle surfaces; the films being formed of a condensate of the silicon compound.

After the reaction was completed, the particles obtained were washed with purified water, and then washed with methanol. Thereafter, the particles were filtered and dried to obtain a black toner of the present Example, comprising toner particles covered with coating layers formed of silicon-compound-containing particulate matters being stuck to one another.

The particle size distribution of the toner thus obtained was measured to find that the number-average particle diameter was 5.45 μm, a standard deviation of 1.09 and a coefficient of variation in number distribution of 20.00%. Thus, it was a toner having a small particle diameter and a sharp particle size distribution.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by the electron probe microanalysis (EPMA) (EDX) was found to be 10.70% by weight. The quantity of silicon atoms present in the toner's particle cross sections which was determined similarly was found to be 0.03% by weight. Therefore, the silicon atoms present on the toner's particle surfaces were in a proportion of 319.05 with respect to the silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 8.54% by weight. Therefore, the percent loss of silicon atoms present on the particle surfaces of the toner after washing with the surface-active agent was 20.14%. Thus, it was ascertained that the coating layers formed of silicon-compound-containing particulate matters being stuck to one another were formed on the particle surfaces of this toner.

Then, 5 parts by weight of the toner thus obtained and 95 parts by weight of a carrier comprising ferrite cores having a particle diameter of 40 μm and coated with silicone resin were blended to prepare a two-component type developer. The charge quantity (quantity of triboelectricity) of the toner of this two-component type developer was measured in the same manner as in Example 1-1 to find that it was −46.36 mC/kg.

Evaluation

On the two-component type developer thus obtained, fixing performance, dot reproducibility and running performance were evaluated in the following way.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, no particle shape was observable.

Dot Reproducibility:

In an environment of 25° C. and 30% RH, copies of an original image were taken by means of a remodeled machine of a full-color laser copying machine CLC700, manufactured by CANON INC., (so remodeled as to drive at a process speed of 200 mm/sec and at a transfer current of 400 μA in an environment of 25° C./30% RH). Then, images held on the drum before their transfer to transfer paper were observed with a microscope to evaluate dot reproducibility. As the result, the dots of toner images had been reproduced in a uniform shape on the whole, and neither fog nor black spots around dot images were seen, showing a good dot reproducibility.

Running Performance:

By means of the same apparatus as that used in the dot reproducibility evaluation test, images were reproduced on 100,000 sheets in an environment of 25° C. and 30% RH. Charge quantity of the toner after this running and toner images formed on the drum were observed to evaluate dot reproducibility. As the result, the charge quantity was −43.26 mC/kg, which showed a tendency of becoming lower than that before the running, but on the level of substantially no problem in practical use. Dot images on the drum were evaluated after images were formed on 100,000th sheet, where the toner stood scattered in a slightly larger quantity than the running initial stage, but dots were in a uniform shape and images with a good dot reproducibility were obtained.

EXAMPLE 3-2

Using the same toner particles as those used in Example 3-1, a black toner of the present Example was produced in the same manner as in Example 3-1 except that 2.5 parts by weight of the tetraethoxysilane, a constituent of the films formed of a polycondensate of the silicon compound, was replaced with 2.0 parts by weight of tetraethoxysilane and 0.5 part by weight of methyltriethoxysilane.

The black toner thus obtained had a number-average particle diameter of 5.31 μm and a standard deviation of 0.63. The coefficient of variation in number distribution of the toner particles was 11.86%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 4.21% by weight. The quantity of silicon atoms present in the toner's particle cross sections which was determined similarly was found to be 0.06% by weight. Therefore, the silicon atoms present on the toner's particle surfaces were in a proportion of 74.69 with respect to the silicon atoms present in the toner's particle cross sections, thus any polycondensate of the silicon compound was found little present inside the particles of the toner.

The quantity of silicon atoms present on the toner's particle surfaces after the toner was washed with an aqueous 5% by weight dodecylbenzenesulfonic acid solution was also found to be 3.20% by weight. Therefore, the percent loss of silicon atoms present on the particle surfaces of the toner after washing with the surface-active agent was 24.15%. Thus, it was ascertained that the coating layers formed of silicon-compound-containing particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −47.96 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, no particle shape was observable.

Dot Reproducibility:

The dots of toner images formed on the drum were in a uniform shape, and neither fog nor black spots around dot images were seen, showing a high dot reproducibility.

Running Performance:

The charge quantity of the toner after the running was −46.69 mC/kg, showing that the charge quantity decreased only slightly. Dot images on the drum were evaluated after images were formed on 100,000th sheet, where they showed substantially the same dot reproducibility as that at the running initial stage.

EXAMPLE 3-3

In 20 parts by weight of a mixed solvent of ethanol/water= 1:1 (weight ratio), 0.02 part by weight of polyvinyl alcohol was dissolved. In the solution obtained, 0.9 part by weight of the same black toner particles as those used in Example 3-1 were dispersed, and then 5 parts by weight of 3-(methacryloxypropyl)-trimethoxysilane was dissolved therein. Thereafter, 120.0 parts by weight of water was slowly added dropwise. After its addition was completed, the mixture obtained was stirred for 5 hours to make the alkoxysilane permeate into the toner particles so as to be made present therein.

Next, to this system, 20.0 parts by weight of an aqueous 28% by weight $NH_4OH$ solution was added, followed by stirring at room temperature for 12 hours to allow the sol-gel reaction to proceed. After the reaction was completed, the black toner particles obtained were washed with ethanol to wash away the unreacted silicon compound remaining in the particles, and were filtered and then dried to obtain a toner of the present Example.

The black toner thus obtained had a number-average particle diameter of 5.43 $\mu$m and a standard deviation of 0.77. The coefficient of variation in number distribution of the toner particles was 14.48%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 5.82% by weight. The quantity of silicon atoms present in the toner's particle cross sections which was determined similarly was found to be 0.44% by weight. Therefore, the silicon atoms present on the toner's particle surfaces were in a proportion of 13.13 with respect to the silicon atoms present in the toner's particle cross sections. Thus, it was ascertained that the coating layers formed of silicon-compound-containing particulate matters being stuck to one another were formed on the particle surfaces of the toner.

The quantity of silicon atoms present on the toner's particle surfaces after the toner was washed with an aqueous 5% by weight dodecylbenzenesulfonic acid solution was also measured to find that it was 4.53% by weight. Therefore, the percent loss of silicon atoms present on the particle surfaces of the toner after washing with the surface-active agent was 22.12%. Thus, it was ascertained that the coating layers formed of the particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −45.86 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, particle shape of the toner was partly observable, but the image surface was smooth on the whole.

Dot Reproducibility:

The dots were in a uniform shape, and neither fog nor black spots around dot images were seen, showing a satisfactory dot reproducibility.

Running Performance:

The charge quantity after the running was −44.48 mC/kg, showing that the charge quantity decreased only slightly. Toner images on the drum were evaluated after 100,000-sheet running, where they showed substantially the same dot reproducibility as that at the running initial stage.

EXAMPLE 3-4

In 120.0 parts by weight of an aqueous 0.3% by weight sodium dodecyl sulfonate solution, 4 parts by weight of dibutyl phthalate was finely dispersed by means of an ultrasonic homogenizer to prepare a dibutyl phthalate emulsion. Next, 0.9 part by weight of the same black toner particles as those used in Example 3-1 were dispersed in 4.0 parts by weight of an aqueous 0.3% by weight sodium dodecyl sulfonate solution to prepare a dispersion of toner particles. Thereafter, the dibutyl phthalate emulsion was mixed with the dispersion of toner particles, followed by stirring at room temperature for 2 hours.

Next, a dispersion prepared by finely dispersing 3-(methacryloxypropyl)trimethoxysilane in an aqueous 0.3% by weight sodium dodecyl sulfonate solution by means of an ultrasonic homogenizer was introduced into the dispersion of toner particles, followed by stirring at room temperature for 4 hours. Thereafter, 10 parts by weight of an aqueous 30% by weight $NH_4OH$ solution was introduced, followed by stirring at room temperature for 12 hours to carry out the sol-gel reaction. After the reaction was completed, ethanol was introduced in a large quantity into the system to remove unreacted 3-(methacryloxy) propyltrimethoxysilane and the dibutyl phthalate which were remaining in the particles. Next, the toner particles obtained were again washed with ethanol and then washed with purified water, followed by filtration and drying to obtain a black toner.

The particle diameter of the toner thus obtained was measured to find that the number-average particle diameter was 5.21 $\mu$m, the standard deviation was 0.54 and the coefficient of variation in number distribution was 10.36%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 6.23% by weight. The quantity of silicon atoms present in the toner's particle cross sections which was determined similarly was found to be 0.30% by weight. Therefore, the silicon atoms present on the toner's particle surfaces were in a proportion of 20.75 with respect to the silicon atoms present in the toner's particle cross sections. Thus, it was ascertained that the coating layers formed of silicon-compound-containing particulate matters being stuck to one another were formed on the particle surfaces of the toner.

The quantity of silicon atoms present on the toner's particle surfaces after the toner was washed with an aqueous 5% by weight dodecylbenzenesulfonic acid solution was also found to be 5.58% by weight. Therefore, the percent loss of silicon atoms present on the particle surfaces of the toner after washing with the surface-active agent was 10.46%. Thus, it was ascertained that the coating layers formed of the particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −47.55 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, particle shape of the toner was partly observable, but the image surface was smooth on the whole.

Dot Reproducibility:

The dots were in a uniform shape, and neither fog nor black spots around dot images were seen, showing a good dot reproducibility.

Running Performance:

The charge quantity after the running was −46.87 mC/kg, showing that the charge quantity decreased only slightly. Toner images on the drum were evaluated after 100,000-sheet running, where they showed substantially the same dot reproducibility as that at the running initial stage.

EXAMPLE 3-5

A solution prepared by mixing 2 parts by weight of isopentyl acetate and 4 parts by weight of 3-(methacryloxypropyl)trimethoxysilane was introduced into 30 parts by weight of an aqueous 0.3% by weight sodium dodecyl sulfonate solution. Thereafter, a dispersion of the isopentyl acetate and 3-(methacryloxypropyl) trimethoxysilane was prepared by means of an ultrasonic homogenizer. Next, 0.9 part by weight of the same black toner particles as those used in Example 3-1 were dispersed in 30 parts by weight of an aqueous 0.3% by weight sodium dodecyl sulfonate solution. Into this dispersion, the above dispersion of isopentyl acetate and 3-(methacryloxypropyl) trimethoxysilane was introduced, followed by stirring at room temperature for 2 hours. Next, 5 parts by weight of an aqueous 28% by weight $NH_4OH$ solution was mixed, followed by stirring at room temperature for 12 hours to carry out the sol-gel reaction. Then, ethanol was introduced in a large quantity into the system to remove unreacted 3-(methacryloxypropyl)trimethoxysilane and isopentyl acetate from the insides of the particles. The particles obtained were again washed with ethanol and then washed with purified water, followed by filtration and drying to obtain a black toner.

The particle diameter of the toner thus obtained was measured to find that the number-average particle diameter was 5.20 $\mu$m, the standard deviation was 0.69 and the coefficient of variation in number distribution was 13.27%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 5.99% by weight. The quantity of silicon atoms present in the toner's particle cross sections which was determined similarly was found to be 0.39% by weight. Therefore, the silicon atoms present on the toner's particle surfaces were in a proportion of 15.36 with respect to the silicon atoms present in the toner's particle cross sections. Thus, it was ascertained that the coating layers formed of silicon-compound-containing particulate matters being stuck to one another were formed on the particle surfaces of the toner.

The quantity of silicon atoms present on the toner's particle surfaces after the toner was washed with an aqueous 5% by weight dodecylbenzenesulfonic acid solution was also found to be 4.30% by weight. Therefore, the percent loss of silicon atoms present on the particle surfaces of the toner after washing with the surface-active agent was 28.22%. Thus, it was ascertained that the coating layers formed of the particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −47.59 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, particle shape of the toner was partly observable, but the image surface was smooth on the whole.

Dot Reproducibility:

The dots were in a uniform shape, and neither fog nor black spots around dot images were seen, showing a good dot reproducibility.

Running Performance:

The charge quantity after the running was −45.69 mC/kg, showing that the charge quantity decreased only slightly. Toner images on the drum were evaluated after 100,000-sheet running, where they showed substantially the same dot reproducibility as that at the running initial stage.

EXAMPLE 3-6

Polymerization was carried out in the same manner as the production of toner particles in Example 3-1 except that to the reaction system 5 parts by weight of 3-(methacryloxypropyl)trimethoxysilane was dissolved. Thereafter, an aqueous $NH_4OH$ solution was added in the system to make it alkaline. Thereafter, the toner particles were washed with a large quantity of ethanol to remove unreacted 3-(methacryloxypropyl)trimethoxysilane, further followed by filtration and drying to obtain a black toner.

The particle diameter of the toner thus obtained was measured to find that the number-average particle diameter was 5.68 $\mu$m, the standard deviation was 0.98 and the coefficient of variation in number distribution was 17.25%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 4.42% by weight. The quantity of silicon atoms present in the toner's particle cross sections which was determined similarly was found to be 0.12% by weight. Therefore, the silicon atoms present on the toner's particle surfaces were in a proportion of 37.94 with respect to the silicon atoms present in the toner's particle cross sections. Thus, it was ascertained that the coating layers formed of silicon-compound-containing particulate matters being stuck to one another were formed on the particle surfaces of the toner.

The quantity of silicon atoms present on the toner's particle surfaces after the toner was washed with an aqueous 5% by weight dodecylbenzenesulfonic acid solution was also found to be 3.38% by weight. Therefore, the percent loss of silicon atoms present on the particle surfaces of the toner after washing with the surface-active agent was 23.56%. Thus, it was ascertained that the coating layers formed of the particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −47.59 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, no particle shape was observable.

Dot Reproducibility:

The dots were in a uniform shape, and neither fog nor black spots around dot images were seen, showing a good dot reproducibility.

Running Performance:

The charge quantity after the running was −46.32 mC/kg, showing that the charge quantity decreased only slightly. Toner images on the drum were evaluated after 100,000-sheet running, where they showed substantially the same dot reproducibility as that at the running initial stage.

EXAMPLE 3-7

A black toner comprising toner particles having coating layers formed of silicon-compound-containing particulate matters being stuck to one another was produced in the same manner as the production of toner particles in Example 3-3 except that after the sol-gel reaction was completed the toner particles were washed with only water so that the unreacted alkoxide remaining inside the particles were kept present inside the particles, and in that state the toner particles were again dispersed in water, followed by heating to 50° C. to allow the sol-gel reaction to proceed up to the insides of particles.

The toner thus obtained had a number-average particle diameter of 6.89 $\mu$m and a standard deviation of 1.05. The coefficient of variation in number distribution of the toner particles was 15.24%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 6.32% by weight. The quantity of silicon atoms present in the toner's particle cross sections which was determined similarly was found to be 5.45% by weight. Therefore, the silicon atoms present on the toner's particle surfaces were in a proportion of 1.16 with respect to the silicon atoms present in the toner's particle cross sections. Thus, a polycondensate of the silicon compound was found present also relatively inward the toner particles.

The quantity of silicon atoms present on the toner's particle surfaces after the toner was washed with an aqueous 5% by weight dodecylbenzenesulfonic acid solution was also found to be 4.99% by weight. Therefore, the percent loss of silicon atoms present on the particle surfaces of the toner after washing with the surface-active agent was 21.11%. Thus, it was ascertained that the coating layers formed of silicon-compound-containing particulate matters being stuck to one another were formed on the particle surface's of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −47.55 mC/kg.

Fixing Performance:

Particle shape of the toner was observable in a little large quantity, but on the level of anyhow no problem.

Dot Reproducibility:

The dots were in a uniform shape, and neither fog nor black spots around dot images were seen, showing a good dot reproducibility.

Running Performance:

The charge quantity after the running was −46.98 mC/kg, showing that the charge quantity decreased only slightly. Toner images on the drum were evaluated after 100,000-sheet running, where they showed substantially the same dot reproducibility as that at the running initial stage.

EXAMPLE 3-8

A black toner was obtained in the same manner as the production of toner particles in Example 3-2 except that the tetraethoxysilane and methyltriethoxysilane were added in amounts of 10.0 parts by weight and 5 parts by weight, respectively.

The toner thus obtained had a number-average particle diameter of 6.55 $\mu$m and a standard deviation of 0.85. The coefficient of variation in number distribution of the toner particles was 12.98%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 20.16% by weight. The quantity of silicon atoms present in the toner's particle cross sections which was determined similarly was found to be 0.19% by weight. Therefore, the silicon atoms present on the toner's particle surfaces were in a proportion of 107.91 with respect to the silicon atoms present in the toner's particle cross sections. Thus, it was ascertained that the coating layers formed of silicon-compound-containing particulate matters being stuck to one another were formed on the particle surfaces of the toner.

The quantity of silicon atoms present on the toner's particle surfaces after the toner was washed with an aqueous 5% by weight dodecylbenzenesulfonic acid solution was also found to be 16.09% by weight. Therefore, the percent loss of silicon atoms present on the particle surfaces of the toner after washing with the surface-active agent was 20.21%. Thus, it was ascertained that the coating layers formed of the particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −45.23 mC/kg.

Fixing Performance:

Particle shape of the toner was observable in a large quantity, but on the level of anyhow no problem.

Dot Reproducibility:

The dots were in a uniform shape, and neither fog nor black spots around dot images were seen, showing a good dot reproducibility.

Running Performance:

The charge quantity after the running was −45.24 mC/kg, showing that the charge quantity decreased only slightly. Toner images on the drum were evaluated after 100,000-sheet running, where they showed substantially the same dot reproducibility as that at the running initial stage.

EXAMPLE 3-9

A black toner was obtained in the same manner as the production of toner particles in Example 3-2 except that the tetraethoxysilane and methyltriethoxysilane were added in amounts of 0.9 part by weight and 0.3 part by weight, respectively.

The toner thus obtained had a number-average particle diameter of 5.33 $\mu$m and a standard deviation of 0.99. The coefficient of variation in number distribution of the toner particles was 18.57%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 1.01% by weight. The quantity of silicon atoms present in the toner's particle cross sections which was determined similarly was found to be 0.01% by weight. Therefore, the silicon atoms present on the toner's particle surfaces were in a proportion of 92.14 with respect to the silicon atoms present in the toner's particle cross sections. Thus, it was ascertained that the coating layers formed of silicon-compound-containing particulate matters being struck to one another were formed on the particle surfaces of the toner.

The quantity of silicon atoms present on the toner's particle surfaces after the toner was washed with an aqueous 5% by weight dodecylbenzenesulfonic acid solution was also found to be 0.92% by weight. Therefore, the percent loss of silicon atoms present on the particle surfaces of the toner after washing with the surface-active agent was 9.24%. Thus, it was ascertained that the coating layers formed of the particulate matters being stuck to one another were formed on the particle surfaces of this toner.

Using the black toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −40.21 mC/kg.

Fixing Performance:

No particle shape was observable, showing a good fixing performance.

Dot Reproducibility:

The dots were in a uniform shape, and neither fog nor black spots around dot images were seen, showing a good dot reproducibility.

Running Performance:

The charge quantity after the running was −36.02 mC/kg, showing that the charge quantity decreased only slightly. Toner images on the drum were evaluated after 100,000-sheet running, where fog and black spots around dot images occurred a little, compared with those at the running initial stage. However, dots were in a uniform shape, showing a good dot reproducibility.

EXAMPLE 3-10

In the production of toner particles in Example 3-1, after the polymerization was completed the reaction system was cooled to room temperature. Thereafter, in a dispersion prepared by adding 20 parts by weight of methanol to 20 parts by weight of the reaction mixture, 28 parts by weight of tetraethoxysilane and 7 parts by weight of methyltriethoxysilane were dissolved. The dispersion obtained was added dropwise with stirring in a solution prepared by adding 100 parts by weight of methanol to 10 parts by weight of an aqueous 28% by weight $NH_4OH$ solution, and these were stirred at room temperature for 48 hours to build up films on the toner particle surfaces; the films being formed of a condensate of the silicon compound.

After the reaction was completed, the particles obtained were washed with purified water, and then washed with methanol. Thereafter, the particles were filtered and dried to obtain a toner comprising toner particles covered with coating layers formed of silicon-compound-containing particulate matters being stuck to one another.

The toner thus obtained had a number-average particle diameter of 5.29 $\mu$m and a standard deviation of 0.71. The coefficient of variation in number distribution of the toner particles was 13.42%. Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 4.15% by weight. The quantity of silicon atoms present in the toner's particle cross sections which was determined similarly was found to be 0.05% by weight. Therefore, the silicon atoms present on the toner's particle surfaces were in a proportion of 83.00 with respect to the silicon atoms present in the toner's particle cross sections. Thus, it was ascertained that the coating layers formed of silicon-compound-containing particulate matters being stuck to one another were formed on the particle surfaces of the toner.

The quantity of silicon atoms present on the toner's particle surfaces after the toner was washed with an aqueous 5% by weight dodecylbenzenesulfonic acid solution was also found to be 3.23% by weight. Therefore, the percent loss of silicon atoms present on the particle surfaces of the toner after washing with the surface-active agent was 22.14%. Thus, it was ascertained that the coating layers formed of the particulate matters being stuck to one another were formed on the particle surfaces of this toner.

Using this toner as a one-component type developer, the developer was loaded in a remodeled machine of a commercially available electrophotographic copying machine FC-2, manufactured by CANON INC. Evaluation like that in Example 3-1 was made in an environment of temperature 25° C. and humidity 30% RH to obtain the results as shown below.

Evaluation

On the one-component type developer thus obtained, the performances were evaluated like Example 3-1.

Initial Charge Quantity:

The charge quantity was measured in the same manner as in Example 3-1 to find that it was −47.89 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, no particle shape was observable.

Dot Reproducibility:

The dots were in a uniform shape, and neither fog nor black spots around dot images were seen, showing a good dot reproducibility.

Running Performance:

The charge quantity after the running was −45.14 mC/kg, showing that the charge quantity decreased only slightly. Toner images on the drum were evaluated after 100,000-sheet running, where they showed substantially the same dot reproducibility as that at the running initial stage.

EXAMPLE 3-11

A black toner was produced in the same manner as in Example 3-2 except that the toner particles serving as base particles were produced in the following way.

Production of Base-Particle Toner Particles:

Into a reaction vessel having a high-speed stirrer TK-type homomixer, 890 parts by weight of ion-exchanged water and 95 parts by weight of polyvinyl alcohol were added. The mixture obtained was heated to 55° C. with stirring at number of revolutions of 3,600 rpm to prepare a dispersion medium.

| | (by weight) |
|---|---|
| Styrene monomer | 85 parts |
| n-Butyl acrylate monomer | 34 parts |
| Carbon black | 10 parts |

A mixture of the above materials was dispersed for 3 hours by means of an attritor, and thereafter 3 parts by weight of a polymerization initiator 2,2'-azobis(2,4-dimethylvaleronitrile) was added. The dispersion obtained was introduced into the above dispersion medium to carry out granulation for 10 minutes while maintaining the number of revolutions. Thereafter, at 50 rpm, polymerization was carried out at 55° C. for 1 hour, then at 65° C. for 4 hours and further at 80° C. for 5 hours.

After the polymerization was completed, the slurry formed was cooled, and was washed repeatedly with purified water to remove the dispersant, further followed by washing and then drying to obtain black toner particles. The toner particles thus obtained were classified repeatedly to obtain toner particles having a number-average particle diameter of 10.24 μm, a standard deviation of 1.20 and a coefficient of variation in number distribution of 1.71%.

Using the above toner particles, coating layers formed of silicon-compound-containing particulate matters being stuck to one another were provided on the toner particles in the same manner as in Example 3-2 to produce a black toner. This toner had a number-average particle diameter of 10.60 μm, a standard deviation of 1.38 and a coefficient of variation in number distribution of 13.03 μm, which was a toner having a relatively large particle diameter.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

Then, the quantity of silicon atoms present on the particle surfaces of the toner as determined by EDX in the manner described previously was found to be 13.05% by weight. The quantity of silicon atoms present in the toner's particle cross sections which was determined similarly was found to be 0.04% by weight. Therefore, the silicon atoms present on the toner's particle surfaces were in a proportion of 326.25 with respect to the silicon atoms present in the toner's particle cross sections.

The quantity of silicon atoms present on the toner's particle surfaces after the toner was washed with an aqueous 5% by weight dodecylbenzenesulfonic acid solution was also found to be 10.38% by weight. Therefore, the percent loss of silicon atoms present on the particle surfaces of the toner after washing with the surface-active agent was 20.45%. Thus, it was ascertained that the coating layers formed of the particulate matters being stuck to one another were formed on the particle surfaces of this toner.

Using the toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −42.14 mC/kg.

Fixing Performance:

No particle shape was observable, showing a good fixing performance.

Dot Reproducibility:

Black spots around dot images and fog occurred a little, and dots were seen to stand in mass in places and were not in a uniform shape.

Running Performance:

The charge quantity after the running was −41.53 mC/kg, showing that the charge quantity decreased only slightly. Toner images on the drum which were evaluated after 100,000-sheet running were on substantially the same level as those at the running initial stage.

EXAMPLE 3-12

A black toner was produced in the same manner as in Example 3-3 except that the conditions for the classification of toner particles were changed. The toner obtained had a number-average particle diameter of 6.59 μm, a standard deviation of 1.89 and a coefficient of variation in number distribution of 28.68.

Using the toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −42.01 mC/kg.

Fixing Performance:

No particle shape was observable, showing a good fixing performance.

Dot Reproducibility:

Black spots around dots and fog occurred a little, dots were not in a uniform shape and image quality was a little poor, but no problem in practical use.

Running Performance:

The charge quantity after the running was −41.25 mC/kg, showing that the charge quantity decreased only slightly. Toner images on the drum which were evaluated after 100,000-sheet running were on substantially the same level as those at the running initial stage.

COMPARATIVE EXAMPLE 3-1

A two-component type developer was prepared in the same manner as in Example 3-1 except that, after the polymerization, the black toner particles used therein were used without providing thereon the coating layers formed of silicon-compound-containing particulate matters being stuck to one another. Using this two-component type developer, evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −7.56 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, no particle shape was observable.

Dot Reproducibility:

Image density was very low, and dots had disappeared in places, showing that the dots had not been reproduced well.

Running Performance:

The 100,000-sheet running was attempted, but the toner melt-adhered to one another on the running of 3,000th sheet, thus it was impossible to continue the running.

COMPARATIVE EXAMPLE 3-2

A black toner was produced in the same manner as in Example 3-6 except that the 3-(methacryloxypropyl)-trimethoxysilane was replaced with tetraethoxysilane, and the aqueous $NH_4OH$ solution was not added to make the hydrolysis and polycondensation reaction of the tetraethoxysilane take place with difficulty. The toner obtained had a number-average particle diameter of 5.10 $\mu$m, a standard deviation of 0.79 and a coefficient of variation in number distribution of 15.49%.

Particle surfaces of this toner were observed on a scanning electron microscope photograph. As a result, although particulate matters were observable in places on the particle surfaces of the toner, individual particles stood present apart from one another and no coating layers were formed. Also, cross sections of the particles of this toner were observed on a transmission electron microscope photograph to obtain similar results, where no coating layers were observable. This was presumably because the alkali treatment was not made and hence the hydrolysis reaction of the silicon compound did not proceed and any polycondensate sufficient for the formation of coating layers was not formed.

Then, the quantity of silicon atoms present on the particle surfaces of the toner as determined by EDX in the manner described previously was found to be 0.03% by weight. The quantity of silicon atoms present in the toner's particle cross sections which was determined similarly was found to be 0.01% by weight. Therefore, the silicon atoms present on the toner's particle surfaces were in a proportion of 3.00 with respect to the silicon atoms present in the toner's particle cross sections.

The quantity of silicon atoms present on the toner's particle surfaces after the toner was washed with an aqueous 5% by weight dodecylbenzenesulfonic acid solution was also found to be 0.02% by weight. Therefore, the percent loss of silicon atoms present on the particle surfaces of the toner after washing with the surface-active agent was 33.33%. Thus, it was not able to judge that sufficient coating layers were formed on the particle surfaces of this toner.

Using the toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −10.25 mC/kg.

Fixing Performance:

A solid image was copied on an OHP sheet. A part of the image formed was cut out and this image was observed with a scanning electron microscope at 1,000 magnifications to evaluate fixing performance by examining whether or not any particle shape of the toner remained. As the result, no particle shape was observable.

Dot Reproducibility:

Image density was low on the whole, and dots had disappeared in places.

Running Performance:

The 100,000-sheet running was attempted, but the toner caused melt-adhesion at 5,000-sheet in the developing assembly to make it difficult to continue development. This was presumably because, in the toner of the present Comparative Example, any coating layers of a polycondensate of the silicon compound were not formed.

COMPARATIVE EXAMPLE 3-3

To 100 parts by weight of the same black toner particles as those used in Example 3-2, 5 parts by weight of hydrophobic fine silica powder having a weight-average particle diameter of 40 nm was added. These were mixed using a Henschel mixer to obtain a toner in which the silica fine powder was added externally. The particle diameter of the toner thus obtained was measured to find that the number-average particle diameter was 5.04 $\mu$m, the standard deviation was 0.98 and the coefficient of variation in number distribution was 19.44%.

Particle surfaces of this toner were observed on a scanning electron microscope photograph. As a result, although particulate matters were observable in places on the particle surfaces of the toner, particles stood present individually and no coating layers were formed. Also, cross sections of the particles of this toner were observed on a transmission electron microscope photograph to obtain similar results.

Then, the quantity of silicon atoms present on the particle surfaces of the toner as determined by EDX in the manner described previously was found to be 0.54% by weight. The quantity of silicon atoms present in the toner's particle cross sections which was determined similarly was found to be 0.00% by weight.

The quantity of silicon atoms present on the toner's particle surfaces after the toner was washed with an aqueous 5% by weight dodecylbenzenesulfonic acid solution was also found to be 0.38% by weight. Therefore, the percent loss of silicon atoms present on the particle surfaces of the toner after washing with the surface-active agent was 30.18%. The percent loss of silicon concentration as a result of this washing was larger than that of the coating layers formed of silicon-compound-containing particulate matters being stuck to one another.

Using the toner thus obtained, a two-component type developer was prepared in the same manner as in Example 3-1. Evaluation was made like Example 3-1 to obtain the results shown below.

Evaluation

On the two-component type developer thus obtained, the performances were evaluated like Example 3-1.

Initial Charge Quantity:

The charge quantity was measured in the same manner as in Example 3-1 to find that it was −44.12 mC/kg.

Fixing Performance:

No particle shape was observable.

Dot Reproducibility:

The dots were in a uniform shape, and no black spots around dot images were seen, showing a good dot reproducibility.

Running Performance:

The charge quantity after the running was −21.0 mC/kg, showing that the charge quantity decreased. Toner images on the drum were evaluated after 100,000-sheet running were observed to find that many black spots around dot images appeared and also the dots were not in a uniform shape and stood in mass in places Characteristics of the toner particles and toners produced in Examples 3-1 to 3-12 and Comparative Examples 3-1 and 3-2 are summarized in Tables 5 and 6. The results of evaluation are summarized in Table 7.

With regard to the dot reproducibility shown in Table 7, copies of an original image were taken by means of the remodeled machine of a full-color laser copying machine CLC700, manufactured by CANON INC., in an environment of 25° C. and 30% RH. Then, images held on the drum before their transfer to transfer paper were observed with a microscope at the initial stage and after the 100,000-sheet running. The results are shown according to the following ranks.

A: Dots are in a uniform shape, and black spots around dot images are little seen.

B: Dots are in a uniform shape, and black spots around dot images are a little seen but on the level of no problem.

C: Dots are not in a uniform shape, and many black spots around dot images are seen.

D: Dots are not in a uniform shape, and dots stand in mass or disappeared. Many black spots around dot images are also seen.

E: Dots are not in a uniform shape, and dots stand in mass or disappeared greatly.

With regard to the fixing performance shown in Table 7, a solid image was developed and fixed on an OHP sheet and thereafter whether or not any particle shape of the toner remained was observed with a scanning electron microscope at 1,000 magnifications. The results are shown according to the following ranks.

A: No particle shape is observable.

B: Areas where the particle shape remains are present in places.

C: The particle shape remains on almost all particles.

EXAMPLE 4-1

Production of Base-Particle Toner Particles:

First, toner particles used in the present Example were produced in the following way.

Into a four-necked flask having a high-speed stirrer TK-type homomixer, 820 parts by weight of ion-exchanged water and 97 parts by weight of polyvinyl alcohol were added. The mixture obtained was heated to 55° C. while adjusting the number of revolutions to 1,000 rpm to prepare a dispersion medium.

A monomer dispersion was prepared in the following way.

| | (by weight) |
|---|---|
| Styrene monomer | 60 parts |
| n-Butyl acrylate monomer | 40 parts |
| Carbon black | 10 parts |
| Salicylic acid metal compound | 1 part |
| Release agent (paraffin wax 155) | 20 parts |

A mixture formulated as described above was dispersed for 3 hours by means of an attritor, and thereafter 3 parts by weight of a polymerization initiator 2,2'-azobis(2,4-dimethylvaleronitrile) was added. The dispersion obtained was introduced into the above dispersion medium to carry out granulation for 10 minutes while maintaining the number of revolutions. Thereafter, at 50 rpm, polymerization was carried out at 55° C. for 1 hour, then at 65° C. for 4 hours and further at 80° C. for 5 hours.

After the polymerization was completed, the slurry formed was cooled, and was washed repeatedly with purified water to remove unreacted matter, further followed by washing and then drying to obtain black toner particles. The particle diameter of the toner particles thus obtained was measured to find that the black toner particles had a number-average particle diameter of 6.01 μm. The glass transition point (Tg) of the toner particles was also measured to find that it as 27.86° C.

Formation of Coating Layers (Sol-Gel Films):

In 40 parts by weight of methanol, 0.8 part by weight of the black toner particles thus obtained and 2.5 parts by weight of tetraethoxysilane were dispersed and dissolved to prepare a toner dispersion. Thereafter, the toner dispersion prepared previously was added dropwise in a solution prepared by adding 100 parts by weight of methanol to 8 parts by weight of an aqueous 28% by weight $NH_4OH$ solution. After its addition was completed, these were stirred at room temperature for 48 hours to effect hydrolysis and polycondensation to build up sol-gel films on the toner particle surfaces. After the reaction was completed, the particles obtained were washed with purified water and then with methanol. Thereafter, the particles were filtered and dried to obtain a toner of the present Example, comprising toner particles covered with sol-gel films.

The particle diameter of this toner thus obtained was measured in the same manner as in Example 1-1 to find that the number-average particle diameter was 6.35 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 6.39% by weight where the total sum of quantities of carbon atoms, oxygen atoms and silicon atoms was regarded as 100%. The quantity of silicon atoms present in the toner's particle cross sections which was determined similarly was found to be 0.07% by weight where the total sum of quantities of carbon atoms, oxygen atoms and silicon atoms was regarded as 100%. Therefore, the silicon atoms present on the toner's particle surfaces were 91.00 times the silicon atoms present in the toner's particle cross sections. Thus, a polycondensate of the silicon compound was found present on the particle surfaces of the toner in its greater part and little present inside the particles of the toner.

The quantity of silicon atoms present on the toner's particle surfaces after the toner was washed with an aqueous 5% by weight dodecylbenzenesulfonic acid solution was also found to be 4.76% by weight. Therefore, the percent loss of silicon atoms present on the particle surfaces of the toner after washing with the surface-active agent was 25.46%. Thus, it was ascertained that the coating layers formed of silicon-compound-containing particulate matters being stuck to one another were formed on the particle surfaces of this toner.

The melt-starting temperature of the toner thus obtained was measured with a flow tester to find that it was 53.95° C. The glass transition point (Tg) of the toner particles was also measured to find that it was 35.71° C. Therefore, the difference between melt-starting temperature and glass transition point of this toner was 18.24° C.

Evaluation

On the toner of the present Example, its anti-blocking properties and fixing performance were evaluated in the following way. The results of evaluation of the toner are summarized in Table 9.

(1) Anti-Blocking Properties:

30 g of the toner was put in a 30 ml sample bottle. This was left in a 50° C. thermostatic chamber for 2 days. Thereafter, the bottle was slanted to observe its fluidity to make a blocking test. As the result, the toner kept having a good fluidity, showing good anti-blocking properties.

(2) Fixing Performance:

5 parts by weight of the toner thus obtained and 95 parts by weight of a carrier comprising ferrite cores having a particle diameter of 40 $\mu$m and coated with silicone resin were blended to prepare a two-component type developer. This developer was put in a remodeled machine of CLC700, so remodeled as to drive under the following conditions.

Roll pressure: $3.43\times10^{-1}$ MPa (3.5 kg/cm$^2$)

Roll speed: 70 mm/sec.

Process speed: 20 mm/sec.

Fixing temperature: 100° C.

Using this machine, a solid image was copied on an OHP sheet. Then, a part of the image formed was cut out and this image was observed with a scanning electron microscope at 1,000 magnifications to evaluate fixing performance by examining whether or not any particle shape of the toner remained. The image was observed at five visual fields completely not overlapping one another. As the result, no particle shape was observable.

EXAMPLE 4-2

In 25 parts by weight of a mixed solvent of ethanol/water= 1:1 (weight ratio), 0.02 part by weight of polyvinyl alcohol was dissolved. In the solution obtained, 0.9 part by weight of the same black toner particles as those used in Example 4-1 were dispersed, and then 5 parts by weight of hexyltrimethoxysilane was dissolved therein. Thereafter, 120 parts by weight of water was slowly added dropwise to make the hexyltrimethoxysilane absorbed into the toner particles so as to be made present therein. After its addition was completed, the mixture obtained was stirred for 5 hours.

Next, to this system, 20 parts by weight of an aqueous 28% by weight $NH_4OH$ solution was added, followed by stirring at room temperature for 12 hours to allow the sol-gel reaction (hydrolysis and polycondensation) to proceed. After the reaction was completed, the black toner particles obtained were washed with ethanol to wash away the unreacted alkoxide remaining in the particles, and were filtered and then dried to obtain a black toner of the present Example.

The number-average particle diameter of the toner thus obtained was measured in the same manner as in Example 4-1 to find that it was 6.78 $\mu$m.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 4.75% by weight where the total sum of quantities of carbon atoms, oxygen atoms and silicon atoms was regarded as 100%. The quantity of silicon atoms present in the toner's particle cross sections which was determined similarly was found to be 0.26% by weight where the total sum of quantities of carbon atoms, oxygen atoms and silicon atoms was regarded as 100%. Therefore, the silicon atoms present on the toner's particle surfaces were 18.05 times the silicon atoms present in the toner's particle cross sections. Thus, a polycondensate of the silicon compound was found present on the particle surfaces of the toner in a larger quantity than inside the particles of the toner.

The quantity of silicon atoms present on the toner's particle surfaces after the toner was washed with an aqueous 5% by weight dodecylbenzenesulfonic acid solution was also found to be 3.59% by weight. Therefore, the percent loss of silicon atoms present on the particle surfaces of the toner after washing with the surface-active agent was 24.58%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 64.69° C. The glass transition point (Tg) of the toner particles was also measured in the same manner as in Example 4-1 to find that it was 34.55° C. Therefore, the difference between melt-starting temperature and glass transition point of this toner was 30.14° C.

On the above toner, a blocking test was made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, no particle shape was observable, showing good fixing performance. (See Table 9.)

EXAMPLE 4-3

In 100 parts by weight of an aqueous 0.5% by weight sodium dodecyl sulfonate solution, 4 parts by weight of dibutyl phthalate was finely dispersed by means of an ultrasonic homogenizer to prepare a dibutyl phthalate emulsion (a dispersion). Next, 0.9 part by weight of the same black toner particles as those used in Example 4-1 were dispersed in 6.0 parts by weight of an aqueous 0.5% by weight sodium dodecyl sulfonate solution to prepare a dispersion of toner particles. Thereafter, the dibutyl phthalate emulsion was mixed with the dispersion of toner particles, followed by stirring at room temperature for 2 hours to incorporate the dibutyl phthalate into the black toner particles.

Next, a dispersion prepared by finely dispersing 5 parts by weight of (3-glycidoxypropyl)methyldimethoxysilane in 0.5 part by weight of an aqueous 0.3% by weight sodium dodecyl sulfonate solution by means of an ultrasonic homogenizer was introduced into the above dispersion of toner particles, followed by stirring at room temperature for 5 hours to make the (3-glycidoxypropyl) methyldimethoxysilane absorbed in the black toner particles so as to be made present therein. Thereafter, 10 parts by weight of an aqueous 30% by weight $NH_4OH$ solution was introduced, followed by stirring at room temperature for 12 hours to carry out the sol-gel reaction on the toner particle surfaces.

After the reaction was completed, ethanol was introduced in a large quantity into the system to remove unreacted (3-glycidoxypropyl)methyldimethoxysilane and the dibutyl phthalate which were remaining in the particles. Next, the toner particles obtained were again washed with ethanol and then washed with purified water, followed by filtration and drying to obtain a black toner of the present Example.

The number-average particle diameter of the toner thus obtained was measured in the same manner as in Example 4-1 to find that it was 6.89 $\mu$m.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 5.15% by weight where the total sum of quantities of carbon atoms, oxygen atoms and silicon atoms was regarded as 100%. The quantity of silicon atoms present in the toner's particle cross sections which was determined similarly was found to be 0.19% by weight where the total sum of quantities of carbon atoms, oxygen atoms and silicon atoms was regarded as 100%. Therefore, the silicon atoms present on the toner's particle surfaces were 27.85 times the silicon atoms present in the toner's particle cross sections. Thus, a polycondensate of the silicon compound was found present on the particle surfaces of the toner in a larger quantity than inside the particles of the toner.

The quantity of silicon atoms present on the toner's particle surfaces after the toner was washed with an aqueous 5% by weight dodecylbenzenesulfonic acid solution was also found to be 4.61% by weight. Therefore, the percent loss of silicon atoms present on the particle surfaces of the toner after washing with the surface-active agent was 10.56%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 57.64° C. The glass transition point (Tg) of the toner particles was also measured in the same manner as in Example 4-1 to find that it was 33.08° C. Therefore, the difference between melt-starting temperature and glass transition point of this toner was 24.56° C.

On the above toner, a blocking test was also made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, no particle shape was observable, showing good fixing performance. (See Table 9.)

EXAMPLE 4-4

A solution prepared by mixing 2.3 parts by weight of isopropyl acetate and 4 parts by weight of (3-glycidoxypropyl)methyldimethoxysilane was introduced into 50 parts by weight of an aqueous 0.5% by weight sodium dodecyl sulfonate solution. Thereafter, the mixture obtained was treated by means of a TK-type homomixer at 5,000 rpm for 30 minutes, and thereafter by means of Nanomizer System LA-30C (manufactured by Kosumo Keisoh K. K.) under conditions of treatment pressure of 1,300 kg/cm$^2$ and one pass, thus a dispersion of isopropyl acetate and (3-glycidoxypropyl)methyldimethoxysilane was prepared.

Next, 0.9 part by weight of the same black toner particles as those used in Example 4-1 were dispersed in 40 parts by weight of an aqueous 0.5% by weight sodium dodecyl sulfonate solution. Into the dispersion obtained, the above dispersion of isopropyl acetate and (3-glycidoxypropyl) methyldimethoxysilane was introduced, followed by stirring at room temperature for 2 hours. Next, 8 parts by weight of an aqueous 28% by weight $NH_4OH$ solution was mixed, followed by stirring at room temperature for 12 hours to carry out the sol-gel reaction. Then, ethanol was introduced in a large quantity into the system to remove unreacted (3-glycidoxypropyl)methyldimethoxysilane and isopropyl acetate from the insides of the particles. The particles obtained were further again washed with ethanol and then washed with purified water, followed by filtration and drying to obtain a black toner of the present Example.

The number-average particle diameter of the toner thus obtained was measured in the same manner as in Example 4-1 to find that it was 6.57 $\mu$m.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 3.91% by weight where the total sum of quantities of carbon atoms, oxygen atoms and silicon atoms was regarded as 100%. The quantity of silicon atoms present in the toner's particle cross sections which was determined similarly was found to be 0.13% by weight where the total sum of quantities of carbon atoms, oxygen atoms and silicon atoms was regarded as 100%. Therefore, the silicon atoms present on the toner's particle surfaces were 29.26 times the silicon atoms present in the toner's particle cross sections. Thus, a polycondensate of the silicon compound was found present on the particle surfaces of the toner in a larger quantity than inside the particles of the toner.

The quantity of silicon atoms present on the toner's particle surfaces after the toner was washed with an aqueous 5% by weight dodecylbenzenesulfonic acid solution was also found to be 3.12% by weight. Therefore, the percent loss of silicon atoms present on the particle surfaces of the toner after washing with the surface-active agent was 20.14%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 56.24° C. The glass transition point (Tg) of the toner particles was also measured in the same manner as in Example 4-1 to find that it was 33.60° C. Therefore, the difference between melt-starting temperature and glass transition point of this toner was 22.64° C.

On the above toner, a blocking test was also made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, no particle shape was observable, showing good fixing performance. (See Table 9.)

EXAMPLE 4-5

A toner comprising toner particles covered with aluminum type sol-gel films was obtained in the same manner as in Example 4-1 except that 2.5 parts by weight of tetraethoxysilane was replaced with 5.0 parts by weight of tetraethoxysilane. The number-average particle diameter of the toner thus obtained was measured in the same manner as in Example 4-1 to find that it was 6.59 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 19.73% by weight where the total sum of quantities of carbon atoms, oxygen atoms and silicon atoms was regarded as 100%. The quantity of silicon atoms present in the toner's particle cross sections which was determined similarly was found to be 0.02% by weight where the total sum of quantities of carbon atoms, oxygen atoms and silicon atoms was regarded as 100%. Therefore, the silicon atoms present on the toner's particle surfaces were 873.66 times the silicon atoms present in the toner's particle cross sections. Thus, a polycondensate of the silicon compound was found present on the particle surfaces of the toner in its greater part and little present inside the particles of the toner.

The quantity of silicon atoms present on the toner's particle surfaces after the toner was washed with an aqueous 5% by weight dodecylbenzenesulfonic acid solution was also found to be 15.87% by weight. Therefore, the percent loss of silicon atoms present on the particle surfaces of the toner after washing with the surface-active agent was 19.56%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 67.72° C. The glass transition point (Tg) of the toner particles was also measured in the same manner as in Example 4-1 to find that it was 33.48° C. Therefore, the difference between melt-starting temperature and glass transition point of this toner was 34.24° C.

On the above toner, a blocking test was also made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, 5.5 particles on the average were observable per visual field, but almost all the toner particles stood well fixed. (See Table 9.)

EXAMPLE 4-6

A black toner of the present Example was obtained in the same manner as in Example 4-1 except that the tetraethoxysilane and trimethoxysilane were replaced with 5 parts by weight of tetraethoxysilane and 2 parts by weight of trimethoxysilane, respectively. The number-average particle diameter of the toner thus obtained was measured in the same manner as in Example 4-1 to find that it was 6.82 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 12.79% by weight where the total sum of quantities of carbon atoms, oxygen atoms and silicon atoms was regarded as 100%. The quantity of silicon atoms present in the toner's particle cross sections which was determined similarly was found to be 0.06% by weight where the total sum of quantities of carbon atoms, oxygen atoms and silicon atoms was regarded as 100%. Therefore, the silicon atoms present on the toner's particle surfaces were 221.65 times the silicon atoms present in the toner's particle cross sections. Thus, a polycondensate of the silicon compound was found present on the particle surfaces of the toner in its greater part and little present inside the particles of the toner.

The quantity of silicon atoms present on the toner's particle surfaces after the toner was washed with an aqueous 5% by weight dodecylbenzenesulfonic acid solution was also found to be 9.71% by weight. Therefore, the percent loss of silicon atoms present on the particle surfaces of the toner after washing with the surface-active agent was 24.10%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 71.41° C. The glass transition point (Tg) of the toner particles was also measured in the same manner as in Example 4-1 to find that it was 33.52° C. Therefore, the difference between melt-starting temperature and glass transition point of this toner was 37.89° C.

On the above toner, a blocking test was also made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, 6.3 particles on the average were observable per visual field, but almost all the toner particles stood well fixed. (See Table 9.)

EXAMPLE 4-7

Polymerization was carried out in the same manner as the production of toner particles in Example 4-1 except that 5 parts by weight of (3-glycidoxypropyl) methyldimethoxysilane was added to the monomer dispersion and also an aqueous $NH_4OH$ solution was added to the system to make it alkaline. Thereafter, the toner particles were washed with a large quantity of ethanol to remove unreacted (3-glycidoxypropyl)methyldimethoxysilane, further followed by filtration and drying to obtain a black toner of the present Example. The number-average particle diameter of the toner thus obtained was measured in the same manner as in Example 4-1 to find that it was 6.22 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 4.10% by weight where the total sum of quantities of carbon atoms, oxygen atoms and silicon atoms was regarded as 100%. The quantity of silicon atoms present in the toner's particle cross sections which was determined similarly was found to be 4.00% by weight where the total sum of quantities of carbon atoms, oxygen atoms and silicon atoms was regarded as 100%. Therefore, the silicon atoms present on the toner's particle surfaces were 1.03 times the silicon atoms present in the toner's particle cross sections. Thus, a polycondensate of the silicon compound was found present not only on the particle surfaces of the toner but also inside the particles of the toner in substantially an equal proportion.

The quantity of silicon atoms present on the toner's particle surfaces after the toner was washed with an aqueous 5% by weight dodecylbenzenesulfonic acid solution was also found to be 3.68% by weight. Therefore, the percent loss of silicon atoms present on the particle surfaces of the toner after washing with the surface-active agent was 10.25%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 72.99° C. The glass transition point (Tg) of the toner particles was also measured in the same manner as in Example 4-1 to find that it was 36.45° C. Therefore, the difference between melt-starting temperature and glass transition point of this toner was 36.54° C.

On the above toner, a blocking test was also made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, 2.4 particles on the average were observable per visual field, but almost all the toner particles stood well fixed. (See Table 9.)

EXAMPLE 4-8

Toner particles were produced in the same manner as the production of base particles in Example 4-1 except that an ester wax (melting point: 50° C.) was added to the polymerization composition. The number-average particle diameter of the toner particles thus obtained was measured in the same manner as in Example 4-1 to find that it was 6.31 μm. Also, the glass transition point (Tg) of the toner particles was 20.13° C.

The toner particles thus obtained were covered with sol-gel films in the same manner as in Example 4-1 to produce a toner of the present Example. The number-average particle diameter of the toner thus obtained was measured in the same manner as in Example 4-1 to find that it was 6.62 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 5.78% by weight where the total sum of quantities of carbon atoms, oxygen atoms and silicon atoms was regarded as 100%. The quantity of silicon atoms present in the toner's particle cross sections which was determined similarly was found to be 0.06% by weight where the total sum of quantities of carbon atoms, oxygen atoms and silicon atoms was regarded as 100%. Therefore, the silicon atoms present on the toner's particle surfaces were 101.29 times the silicon atoms present in the toner's particle cross sections. Thus, a polycondensate of the silicon compound was found present on the particle surfaces of the toner in its greater part and little present inside the particles of the toner.

The quantity of silicon atoms present on the toner's particle surfaces after the toner was washed with an aqueous 5% by weight dodecylbenzenesulfonic acid solution was also found to be 4.88% by weight. Therefore, the percent loss of silicon atoms present on the particle surfaces of the toner after washing with the surface-active agent was 15.49%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 44.11° C. The glass transition point (Tg) of the toner particles was also measured in the same manner as in Example 4-1 to find that it was 28.69° C. Therefore, the difference between melt-starting temperature and glass transition point of this toner was 15.42° C.

On the above toner, a blocking test was also made in the same manner as in Example 4-1, where the toner kept having a good fluidity, showing good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, no particle shape was observable, showing good fixing performance. (See Table 9.)

EXAMPLE 4-9

Toner particles were produced in the same manner as the production of base particles in Example 4-1 except that the styrene monomer and butyl acrylate monomer were added in amounts changed to 120 parts by weight and 30 parts by weight, respectively. The number-average particle diameter of the toner particles thus obtained was measured in the same manner as in Example 4-1 to find that it was 6.32 μm.

The toner particles thus obtained were covered with sol-gel films in the same manner as in Example 4-1 to produce a toner. The number-average particle diameter of the toner obtained was found to be 6.44 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers formed of silicon-compound-containing particulate matters being stuck to one another were formed on the particle surfaces of this toner.

The quantity of silicon atoms present on the particle surfaces of the toner as determined by EDX was found to be 4.80% by weight where the total sum of quantities of carbon atoms, oxygen atoms and silicon atoms was regarded as 100%. The quantity of silicon atoms present in the toner's particle cross sections which was determined similarly was found to be 0.05% by weight where the total sum of quantities of carbon atoms, oxygen atoms and silicon atoms was regarded as 100%. Therefore, the silicon atoms present on the toner's particle surfaces were 99.93 times the silicon atoms present in the toner's particle cross sections. Thus, a polycondensate of the silicon compound was found present on the particle surfaces of the toner in its greater part and little present inside the particles of the toner.

The quantity of silicon atoms present on the toner's particle surfaces after the toner was washed with an aqueous 5% by weight dodecylbenzenesulfonic acid solution was also found to be 3.61% by weight. Therefore, the percent loss of silicon atoms present on the particle surfaces of the toner after washing with the surface-active agent was 24.78%. Thus, it was ascertained that the coating layers formed of the particulate matters being stuck to one another were formed on the particle surfaces of this toner.

The melt-starting temperature of the toner thus obtained was measured in the same manner as in Example 4-1 to find that it was 104.40° C. The glass transition point (Tg) of the toner particles was also measured in the same manner as in Example 4-1 to find that it was 64.18° C. Therefore, the difference between melt-starting temperature and glass transition point of this toner was 40.22° C.

On the above toner, a blocking test was also made in the same manner as in Example 4-1, where the toner kept having a good fluidity, showing good anti-blocking properties.

Using the above toner, a two-component type developer was prepared in the same manner as in Example 4-1. Using this two-component type developer, images for evaluating fixing performance were formed in the same manner as in Example 4-1 to evaluate fixing performance. As the result, 6.7 particles on the average were observable per visual field, but there was no problem on the fixing performance. This is presumed to be due to an excess coating weight for the coating layers formed of silicon-compound-containing particulate matters being stuck to one another, which made a sufficient heat fixing performance not achievable in the fixing performance test made in the present invention.

EXAMPLE 4-10

Production of Base-Particle Toner Particles:

First, toner particles were produced in the following way.

Into a four-necked flask having a high-speed stirrer TK-type homomixer, 1000 parts by weight of ion-exchanged water and 45 parts by weight of polyvinyl alcohol were added. The mixture obtained was heated to 55° C. while adjusting the number of revolutions of the stirrer to 3,000 rpm to prepare a dispersion medium.

A monomer dispersion was prepared in the following way.

| | (by weight) |
|---|---|
| Styrene monomer | 3 parts |
| n-Butyl acrylate monomer | 20 parts |
| Carbon black | 5 parts |
| Salicylic acid metal compound | 0.5 part |
| Release agent (paraffin wax 155) | 8 parts |

The above materials were dispersed for 3 hours by means of an attritor, and thereafter 1.4 part by weight of a polymerization initiator 2,2'-azobis(2,4-dimethylvaleronitrile) was added. The dispersion obtained was introduced into the above dispersion medium to carry out granulation for 10 minutes while maintaining the number of revolutions. Thereafter, at 50 rpm, polymerization was carried out at 55° C. for 1 hour, then at 65° C. for 4 hours and further at 80° C. for 5 hours.

After the polymerization was completed, the slurry formed was cooled, and was washed repeatedly with purified water to remove unreacted matter, further followed by washing and then drying to obtain toner particles. The number-average particle diameter of the toner particles thus obtained, measured in the same manner as in Example 4-1, was found to be 5.02 μm. The glass transition point (Tg) of the toner particles was also measured to find that it was 27.86° C.

Formation of Coating Layers (Sol-Gel Films):

The toner particles were covered with coating layers formed of silicon-compound-containing particulate matters being stuck to one another, in the same manner as in Example 4-1 except that the quantity of the tetraethoxysilane was changed to 2.5 parts by weight to 10 parts by weight. The number-average particle diameter of the toner of the present Example thus obtained was measured in the same manner as in Example 4-1 to find that it was 6.32 μm.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers were formed on the particle surfaces of this toner.

The quantity of silicon atoms present on the particle surfaces of the toner as determined by EDX was found to be 20.49% by weight where the total sum of quantities of carbon atoms, oxygen atoms and silicon atoms was regarded as 100%. The quantity of silicon atoms present in the toner's particle cross sections which was determined similarly was found to be 1.70% by weight where the total sum of quantities of carbon atoms, oxygen atoms and silicon atoms was regarded as 100%. The coating layers can be said to be coating layers having a relatively large coating weight. From the above measurements, the silicon atoms present on the toner's particle surfaces were 12.08 times the silicon atoms present in the toner's particle cross sections. Thus, a polycondensate of the silicon compound was found present inside the particles of the toner to a certain degree.

The quantity of silicon atoms present on the toner's particle surfaces after the toner was washed with an aqueous 5% by weight dodecylbenzenesulfonic acid solution was also found to be 14.86% by weight. Therefore, the percent loss of silicon atoms present on the particle surfaces of the toner after washing with the surface-active agent was 27.48%. Thus, it was ascertained that the coating layers formed of silicon-compound-containing particulate matters being stuck to one another were formed on the particle surfaces of this toner.

The melt-starting temperature of the toner thus obtained was measured in the same manner as in Example 4-1 to find that it was 142.40° C. The glass transition point (Tg) of the toner particles was also measured in the same manner as in Example 4-1 to find that it was 34.55° C. Therefore, the difference between melt-starting temperature and glass transition point of this toner was 107.9° C.

On the above toner, a blocking test was also made in the same manner as in Example 4-1, where the toner kept having a good fluidity, showing good anti-blocking properties.

Using the above toner, a two-component type developer was prepared in the same manner as in Example 4-1. Using this two-component type developer, images for evaluating fixing performance were formed in the same manner as in Example 4-1 to evaluate fixing performance. As the result, 7.9 particles on the average were observable per visual field, but there was no problem on the fixing performance. This is presumed to be due to the coating weight on the toner particles which was relatively so excess as to make the polycondensate of the silicon compound also present inside the toner particles, which made a sufficient heat fixing performance not achievable in the fixing performance test made in the present invention.

EXAMPLE 4-11

In Example 4-1, when the sol-gel films were formed, the particles were reacted at room temperature for 2 days and thereafter filtered without introducing any alcohol into the system. Thereafter, the toner particles were washed and then heated overnight in a 50° C. dryer to obtain a toner. The number-average particle diameter of the toner thus obtained was measured in the same manner as in Example 4-1 to find that it was 6.25 $\mu$m.

Particle surfaces of this toner were observed on a scanning electron microscope photograph. As a result, coating layers having fine particulate unevenness each having a diameter of about 40 nm were observable on the particle surfaces of the toner. Also, cross sections of the particles of this toner were observed on a transmission electron microscope photograph to ascertain that the coating layers formed of silicon-compound-containing particulate matters being stuck to one another were formed on the particle surfaces of this toner.

The quantity of silicon atoms present on the particle surfaces of the toner as determined by EDX was found to be 6.05% by weight where the total sum of quantities of carbon atoms, oxygen atoms and silicon atoms was regarded as 100%. The quantity of silicon atoms present in the toner's particle cross sections which was determined similarly was found to be 5.32% by weight where the total sum of quantities of carbon atoms, oxygen atoms and silicon atoms was regarded as 100%. Therefore, the silicon atoms present on the toner's particle surfaces were 1.14 times the silicon atoms present in the toner's particle cross sections. Thus, a polycondensate of the silicon compound was found also present inside the particles of the toner.

The quantity of silicon atoms present on the toner's particle surfaces after the toner was washed with an aqueous 5% by weight dodecylbenzenesulfonic acid solution was also found to be 4.55% by weight. Therefore, the percent loss of silicon atoms present on the particle surfaces of the toner after washing with the surface-active agent was 24.78%. Thus, it was ascertained that the coating layers formed of the particulate matters being stuck to one another were formed on the particle surfaces of this toner.

The melt-starting temperature of the toner thus obtained was measured in the same manner as in Example 4-1 to find that it was 99.57° C. The glass transition point (Tg) of the toner particles was also measured in the same manner as in Example 4-1 to find that it was 35.83° C. Therefore, the difference between melt-starting temperature and glass transition point of this toner was 63.74° C.

On the above toner, a blocking test was also made in the same manner as in Example 4-1, where the toner kept having a good fluidity, showing good anti-blocking properties.

Using the above toner, a two-component type developer was prepared in the same manner as in Example 4-1. Using this two-component type developer, images for evaluating fixing performance were formed in the same manner as in Example 4-1 to evaluate fixing performance. As the result, 8.5 particles on the average were observable per visual field, but there was no problem on the fixing performance. This is presumed to be due to the silicon compound polycondensate present up to inside the toner particles, which damaged fixing performance to make a sufficient heat fixing performance not achievable in the fixing performance test made in the present invention. (See Table 9.)

COMPARATIVE EXAMPLE 4-1

The black toner particles used in Example 4-1, obtained after the polymerization, were not provided thereon with the coating layers formed of silicon-compound-containing particulate matters being stuck to one another. Thus, a toner of the present Comparative Example was produced. The glass transition point of the toner particles was 27.86° C. as stated in Example 4-1. The melt-starting temperature of this toner was measured in the same manner as in Example 4-1 to find that it was 32.89° C. Therefore, the difference between melt-starting temperature and glass transition point of this toner was 5.03° C.

On the above toner, a blocking test was also made in the same manner as in Example 4-1, where the toner melted completely to have stuck filmily to the bottom of a sample bottle.

Using the above toner, a two-component type developer was prepared in the same manner as in Example 4-1. Using this two-component type developer, images for evaluating fixing performance were attempted to be formed in the same manner as in Example 4-1. However, the toner caused mutual melt-adhesion in an agitator, making it impossible to form images well. (See Table 9.)

COMPARATIVE EXAMPLE 4-2

A toner was produced in the same manner as in Example 4-1 except that the quantity of tetraethoxysilane was changed to 0.1 part by weight. The number-average particle diameter of the toner thus obtained was measured in the same manner as in Example 4-1 to find that it was 6.35 $\mu$m.

Particle surfaces of this toner were observed on a scanning electron microscope photograph. As a result, coating layers having any unevenness attributable to the silica coating layers were not observable on the particle surfaces of the toner. Also, cross sections of the particles of this toner were observed on a transmission electron microscope photograph to obtain similar results, where no coating layers formed of silicon-compound-containing particulate matters being stuck to one another layers were observable.

The quantity of silicon atoms present on the particle surfaces of the toner as determined by EDX was found to be 0.09% by weight where the total sum of quantities of carbon atoms, oxygen atoms and silicon atoms was regarded as 100%. The quantity of silicon atoms present in the toner's particle cross sections which was determined similarly was found to be 0.02% by weight where the total sum of quantities of carbon atoms, oxygen atoms and silicon atoms was regarded as 100%.

The quantity of silicon atoms present on the toner's particle surfaces after the toner was washed with an aqueous 5% by weight dodecylbenzenesulfonic acid solution was also found to be 0.07% by weight. Therefore, the percent loss of silicon atoms present on the particle surfaces of the toner after washing with the surface-active agent was 30.15%. It was found from this result that, although the presence of silicon atoms was ascertained, the particles of this toner did not have the coating layers formed of the particulate matters being stuck to one another.

The melt-starting temperature of the toner thus obtained was measured in the same manner as in Example 4-1 to find that it was 49.15° C. The glass transition point (Tg) of the toner particles was also measured in the same manner as in Example 4-1 to find that it was 28.74° C. Therefore, the difference between melt-starting temperature and glass transition point of this toner was 20.41° C.

On the above toner, a blocking test was also made in the same manner as in Example 4-1, where part of the toner melted to have stuck to the bottom of a sample bottle. This is supposed to be due to substantially no formation of the coating layers formed of silicon-compound-containing particulate matters being stuck to one another.

Using the above toner, a two-component type developer was prepared in the same manner as in Example 4-1. Using this two-component type developer, images for evaluating fixing performance were formed in the same manner as in Example 4-1 to evaluate fixing performance. As the result, no particle shape was observable. (See Table 9.)

COMPARATIVE EXAMPLE 4-3

To 100 parts by weight of the base-particle toner particles as used in Example 4-1, 0.50 part by weight of room-temperature-curable silicone resin was added. These were put into a sample bottle, and were stirred for 30 minutes by means of a roll mill. Thereafter, the stirring was further continued for 3 hours in an atmosphere of 40° C. to obtain a toner comprising toner particles coated with silicon resin. The toner obtained had a number-average particle diameter of 6.63 $\mu$m.

Particle surfaces of this toner were observed on a scanning electron microscope photograph. As a result, coating layers had smooth surfaces and any particulate unevenness was not observable. Also, cross sections of the particles of this toner were observed on a transmission electron microscope photograph to ascertain that some coating layers were formed on the particle surfaces of the toner.

The quantity of silicon atoms present on the particle surfaces of the toner as determined by EDX was found to be 3.66% by weight where the total sum of quantities of carbon atoms, oxygen atoms and silicon atoms was regarded as 100%. The quantity of silicon atoms present in the toner's particle cross sections which was determined similarly was found to be 0.07% by weight where the total sum of quantities of carbon atoms, oxygen atoms and silicon atoms was regarded as 100%. Therefore, the silicon atoms present on the toner's particle surfaces were 54.65 times the silicon atoms present in the toner's particle cross sections. Thus, a polycondensate of the silicon compound was found present chiefly on the particle surfaces of the toner and little present inside the particles of the toner.

The quantity of silicon atoms present on the toner's particle surfaces after the toner was washed with an aqueous 5% by weight dodecylbenzenesulfonic acid solution was also found to be 2.85% by weight. Therefore, the percent loss of silicon atoms present on the particle surfaces of the toner after washing with the surface-active agent was 22.14%. Thus, although the particles of this toner have coating layers containing a silicon compound, the coating layers have smooth surfaces and were quite different from the coating layers formed of the particulate matters being stuck to one another.

The melt-starting temperature of the toner thus obtained was measured in the same manner as in Example 4-1 to find that it was 106.21° C. The glass transition point (Tg) of the toner particles was also measured in the same manner as in Example 4-1 to find that it was 28.55° C. Therefore, the difference between melt-starting temperature and glass transition point of this toner was 77.66° C.

On the above toner, a blocking test was also made in the same manner as in Example 4-1, where the toner showed a good fluidity and good anti-blocking properties. Using the above toner, a two-component type developer was prepared in the same manner as in Example 4-1. Using this two-component type developer, images for evaluating fixing performance were formed in the same manner as in Example 4-1 to evaluate fixing performance. As the result, almost all the particles were found to have not been fixed to remain particulate. This supposed to be due to the toner particle having so smooth surfaces as to have a poor thermal conductivity, which made a sufficient heat fixing performance not achievable in the fixing performance test made in the present invention.

COMPARATIVE EXAMPLE 4-4

To 100 parts by weight of the same black toner particles as those used in Example 4-1, 5 parts by weight of hydrophobic fine silica powder having a weight-average particle diameter of 40 nm was added. These were mixed using a Henschel mixer to obtain a toner in which the silica fine powder was added externally. The number-average particle diameter of the toner thus obtained was measured to find that it was 6.10 $\mu$m.

Particle surfaces of this toner were observed on a scanning electron microscope photograph. As a result, although particulate matters were observable on the particle surfaces of the toner, many brakes or openings were present between individual particles and no filmlike matter was observable. Also, cross sections of the particles of this toner were observed on a transmission electron microscope photograph to ascertain that, although silica particles were observable on the particle surfaces of this toner, the silica particles were present individually from one another.

Then, the quantity of silicon atoms present on the particle surfaces of the toner as determined by EDX was found to be 0.55% by weight. The quantity of silicon atoms present in the toner's particle cross sections which was determined similarly was found to be 0.01% by weight.

The quantity of silicon atoms present on the toner's particle surfaces after the toner was washed with an aqueous 5% by weight dodecylbenzenesulfonic acid solution was also found to be 0.37% by weight. Therefore, the percent loss of silicon atoms present on the particle surfaces of the toner after washing with the surface-active agent was 33.48%.

The melt-starting temperature of the toner thus obtained was measured in the same manner as in Example 4-1 to find that it was 43.33° C. The glass transition point (Tg) of the toner particles was also measured in the same manner as in Example 4-1 to find that it was 29.75° C. Therefore, the difference between melt-starting temperature and glass transition point of this toner was 13.58° C.

On the above toner, a blocking test was also made in the same manner as in Example 4-1, where the toner melted completely to have stuck filmily to the bottom of a sample bottle.

Using the above toner, a two-component type developer was prepared in the same manner as in Example 4-1. Using this two-component type developer, images for evaluating fixing performance were formed in the same manner as in Example 4-1 to evaluate fixing performance. As the result, no particle shape was observable.

Characteristics of the toner particles and toners produced in Examples 4-1 to 4-12 and Comparative Examples 4-1 and 4-2 are summarized in Table 8. The results of evaluation are summarized in Table 9.

With regard to the anti-blocking properties shown in Table 9, 30 g of toner particles were put in a 30 ml sample bottle. This was left in a 50° C. thermostatic chamber for 2 days. Thereafter, the condition of the toner was visually observed. The results are shown according to the following ranks.

A: Particles flow when the bottle is slanted.

B: Particles flow when the bottle is patted on its bottom.

C: Particles flow in mass when the bottle is slanted.

D: Particles has melted partly and has stuck to the bottle.

E: Particles has melted completely and has stuck filmily to the bottle bottom.

With regard to the fixing performance shown in Table 9, a solid image was developed and fixed on an OHP sheet and thereafter whether or not any particle shape of the toner remained was observed with a scanning electron microscope at 1,000 magnifications. The results are shown according to the following ranks.

A: No particle shape is observable.

B: At least 6 particles stay their particle shape.

C: At least 10 particles stay their particle shape.

D: Almost all particles stay their particle shape.

TABLE 1

| | Characteristics of Toner Particles and Toner | | | | | | |
|---|---|---|---|---|---|---|---|
| | | Si concentration | | | | | |
| | Silicon compound used to form coating layer | Particle surface of toner (wt. %) | Particle cross section of toner (wt. %) | Particle surface of toner after washing (wt. %) | Particle surface/particle cross section Si concentration ratio | Percent loss of silicon concentration after washing (%) |
| Example: | | | | | | |
| 1-1 | Tetraethoxysilane | 15.32 | 0.03 | 11.44 | 510.67 | 25.33 |
| 1-2 | Tetraethoxysilane | 15.24 | 0.02 | 11.66 | 762.00 | 23.49 |
| 1-3 | Propyltrimethoxysilane | 3.33 | 0.25 | 2.98 | 13.32 | 10.51 |
| 1-4 | Propyltrimethoxysilane | 3.42 | 0.25 | 3.04 | 13.68 | 11.11 |
| 1-5 | Tetraethoxysilane & methyltrimethoxysilane | 3.15 | 0.33 | 2.98 | 9.55 | 5.40 |
| 1-6 | Tetraethoxysilane & methyltrimethoxysilane | 3.75 | 0.31 | 3.63 | 12.10 | 3.20 |
| 1-7 | Tetraethoxysilane | 15.32 | 0.03 | 11.44 | 510.67 | 25.33 |
| 1-8 | Tetraethoxysilane | 10.12 | 5.75 | 9.84 | 1.76 | 2.77 |
| 1-9 | Tetraethoxysilane | 0.08 | 0.01 | 0.06 | 8.00 | 25.00 |
| 1-10 | Tetraethoxysilane | 10.33 | 0.04 | 7.66 | 258.25 | 25.85 |
| Comparative Example: | | | | | | |
| 1-1 | None | 0.00 | 0.00 | — | — | — |
| 1-2 | Hydrophobic fine silica particles | 0.45 | 0.00 | 0.30 | — | 33.33 |

TABLE 2

| | Evaluation Results | | | | |
|---|---|---|---|---|---|
| | Quantity of triboelectricity | | | | |
| | Initial stage (mC/kg) | After 30,000 = sheet running (mC/kg) | Fixing performance | Transfer efficiency (%) | Surface observation of toner particles after running |
| Example: | | | | | |
| 1-1 | −32.60 | −32.10 | A | 98.5 | No film-break |
| 1-2 | −33.40 | −32.80 | A | 98.2 | No film-break |
| 1-3 | −30.20 | −30.18 | A | 98.4 | No film-break |
| 1-4 | −29.64 | −29.60 | A | 98.4 | No film-break |
| 1-5 | −28.24 | −28.21 | A | 98.4 | No film-break |
| 1-6 | −31.80 | −31.78 | A | 97.5 | No film-break |
| 1-7 | −30.70 | −30.30 | A | 98.6 | No film-break |
| 1-8 | −33.24 | −32.84 | B | 98.5 | No film-break |
| 1-9 | −26.01 | −25.51 | A | 97.2 | No film-break |
| 1-10 | −33.59 | −32.99 | B | 98.7 | No film-break |
| Comparative Example: | | | | | |
| 1-1 | −10.40 | −8.95 | A | 68.9 | — |
| 1-2 | −29.80 | −26.40 | A | 89.7 | Standing free |

TABLE 3

| | Characteristics of Toner Particles and Toner | | | | | |
|---|---|---|---|---|---|---|
| | | Si concentration | | | | |
| | Coupling agent used in coupling treatment of coating layer surface | Particle surface of toner (wt. %) | Particle cross section of toner (wt. %) | Particle surface of toner after washing (wt. %) | Particle surface/particle cross section Si concentration ratio | Percent loss of silicon concentration after washing (%) |
| Example: | | | | | | |
| 2-1 | Dimethylethoxysilane | 16.32 | 0.03 | 15.34 | 544.00 | 6.00 |
| 2-2 | Dimethylethoxysilane | 15.98 | 0.02 | 15.39 | 799.00 | 3.69 |
| 2-3 | Dimethylethoxysilane | 15.87 | 0.03 | 15.28 | 529.00 | 3.72 |
| 2-4 | Titanium ethoxide | 13.55 | 0.03 | 12.56 | 451.67 | 7.31 |
| 2-5 | Aluminum(III) n-butoxide | 12.54 | 0.02 | 11.57 | 627.00 | 7.74 |
| 2-6 | Methacryloxypropyl-methyldimethoxysilane | 16.54 | 0.03 | 15.67 | 551.33 | 5.26 |
| 2-7 | Hexamethyldisilazane | 16.25 | 0.03 | 15.41 | 541.67 | 5.17 |
| 2-8 | Dimethylethoxysilane | 17.02 | 0.02 | 16.24 | 851.00 | 4.58 |
| 2-9 | Dimethylethoxysilane | 15.35 | 0.02 | 14.46 | 767.50 | 5.80 |

TABLE 3-continued

| | Characteristics of Toner Particles and Toner | | | | | |
|---|---|---|---|---|---|---|
| | | Si concentration | | | | |
| | Coupling agent used in coupling treatment of coating layer surface | Particle surface of toner (wt. %) | Particle cross section of toner (wt. %) | Particle surface of toner after washing (wt. %) | Particle surface/particle cross section Si concentration ratio | Percent loss of silicon concentration after washing (%) |
| Comparative Example: | | | | | | |
| 2-1 | No coating layer formed | — | — | — | — | — |
| 2-2 | Coated with hydrophobic fine silica particles | 0.45 | 0.00 | 0.30 | — | 33.33 |

Remarks:

In Examples 2-1 to 2-9, tetraethoxysilane and methyltrimethoxysilane are used as coating-layer-forming silicon compounds.

TABLE 4

| | Evaluation Results | | | | | | |
|---|---|---|---|---|---|---|---|
| | Quantity of triboelectricity | | | | | | |
| | 25° C./30% RH environment | | 30° C./80% RH environment | | * | | Surface |
| | Initial stage (mC/kg) | After 30,000 = sheet running (mC/kg) | Initial stage (mC/kg) | After 30,000 = sheet running (mC/kg) | Fixing performance | Transfer efficiency (%) | observation of toner particles after running |
| Example: | | | | | | | |
| 2-1 | −32.46 | −31.86 | −32.22 | −31.74 | A | 98.6 | OK |
| 2-2 | −31.15 | −30.77 | −30.86 | −30.35 | A | 98.8 | OK |
| 2-3 | −31.52 | −31.13 | −31.33 | −30.86 | A | 98.5 | OK |
| 2-4 | −33.21 | −32.77 | −33.00 | −32.48 | A | 98.6 | OK |
| 2-5 | −33.25 | −32.90 | −30.92 | −30.40 | A | 98.7 | OK |
| 2-6 | −31.41 | −31.01 | −33.76 | −33.23 | A | 97.4 | OK |
| 2-7 | −32.11 | −31.69 | −31.89 | −31.43 | A | 98.6 | OK |
| 2-8 | −33.24 | −32.65 | −32.98 | −32.47 | A | 98.7 | OK |
| 2-9 | −32.54 | −31.10 | −30.89 | −30.40 | A | 97.4 | OK |
| Comparative Example: | | | | | | | |
| 2-1 | −10.40 | −8.95 | −5.24 | −3.32 | A | 68.9 | — |
| 2-2 | −29.80 | −26.40 | −19.45 | −17.23 | A | 89.7 | Standing free |

* A: No areas are seen where particle shape of toner remains.

TABLE 5

| | Toner Particle Surface Coating-layer-forming Material And Toner Particle Size Distribution | | | | |
|---|---|---|---|---|---|
| | Formation of coating layers | | Number = average particle diameter | Standard deviation | Coefficient of variation |
| | Silicon compound used | Forming method | (μm) | S.D. | (%) |
| Example: | | | | | |
| 3-1 | Tetraethoxysilane | Built up from the outside after formation of toner particles. | 5.45 | 1.09 | 20.00 |
| 3-2 | Tetraethoxysilane & methyltriethoxysilane | Built up from the outside after formation of toner particles. | 5.31 | 0.63 | 11.86 |
| 3-3 | 3-(methacryloxy)propyltrimethoxysilane | Silicon compound is made present inside toner particles after formation of toner particles. | 5.43 | 0.77 | 14.18 |
| 3-4 | 3-(methacryloxy)propyltrimethoxysilane | Silicon compound is made present inside toner particles after formation of toner particles. | 5.21 | 0.54 | 10.36 |

TABLE 5-continued

Toner Particle Surface Coating-layer-forming Material And Toner Particle Size Distribution

| | Formation of coating layers | | Number = average particle diameter | Standard deviation | Coefficient of variation |
|---|---|---|---|---|---|
| | Silicon compound used | Forming method | (μm) | S.D. | (%) |
| 3-5 | 3-(methacryloxy)propyltrimethoxysilane | Silicon compound is made present inside toner particles after formation of toner particles. | 5.20 | 0.69 | 13.27 |
| 3-6 | 3-(methacryloxy)propyltrimethoxysilane | * | 5.68 | 0.98 | 17.25 |
| 3-7 | Tetraethoxysilane & methyltriethoxysilane | The same as Example 3-3 but washing only with water. | 6.89 | 1.05 | 15.24 |
| 3-8 | Tetraethoxysilane & methyltriethoxysilane | The same as Example 3-2 but using more silicon compound. | 6.55 | 0.85 | 12.98 |
| 3-9 | Tetraethoxysilane & methyltriethoxysilane | The same as Example 3-2 but using less silicon compound. | 5.33 | 0.99 | 18.57 |
| 3-10 | Tetraethoxysilane & methyltriethoxysilane | Built up from the outside but using toner-particle-forming solution. | 5.29 | 0.71 | 13.42 |
| 3-11 | Tetraethoxysilane & methyltriethoxysilane | The same as Example 3-2 but using toner particles with different particle size distribution. | 10.6 | 1.38 | 13.03 |
| 3-12 | Tetraethoxysilane & methyltriethoxysilane particle size distribution. | The same as Example 3-2 but using toner particles with different | 6.59 | 1.89 | 28.68 |
| Comparative Example: | | | | | |
| 3-1 | No coating layer formed. | — | 5.04 | 0.61 | 12.10 |
| 3-2 | Tetraethoxysilane | The same as Example 3-6 but under conditions causing hydrolysis and polycondensation with difficulty. | 5.10 | 0.79 | 15.49 |
| 3-3 | Fine silica particles | Mixed by external addition | 5.04 | 0.98 | 19.44 |

* Silicon compound is made present inside toner particles at the time of toner-particle formation.

TABLE 6

Characteristics of Toner Particles and Toner

| | Si concentration Quantity of silicon atoms present: | | | State of | Precent loss |
|---|---|---|---|---|---|
| | on particle surfaces of toner (Si1) (wt. %) | in particle cross sections of toner (Si3) (wt. %) | on particle surfaces of toner after washing (Si2) (wt. %) | presence of Si in toner particles (Si1)/(Si3)* | of Si concentration after washing (%)** |
| Example: | | | | | |
| 3-1 | 10.70 | 0.03 | 8.54 | 356.67 | 20.19 |
| 3-2 | 4.21 | 0.06 | 3.20 | 70.17 | 23.99 |
| 3-3 | 5.82 | 0.44 | 4.53 | 13.23 | 22.16 |
| 3-4 | 6.23 | 0.30 | 5.58 | 20.77 | 10.43 |
| 3-5 | 5.99 | 0.39 | 4.30 | 15.36 | 28.21 |
| 3-6 | 4.42 | 0.12 | 3.38 | 36.83 | 23.53 |
| 3-7 | 6.32 | 5.45 | 4.99 | 1.16 | 21.04 |
| 3-8 | 20.16 | 0.19 | 16.09 | 106.11 | 20.19 |
| 3-9 | 1.01 | 0.01 | 0.92 | 101.00 | 8.91 |
| 3-10 | 4.15 | 0.05 | 3.23 | 83.00 | 22.17 |
| 3-11 | 13.05 | 0.04 | 10.38 | 326.25 | 20.45 |
| 3-12 | 4.71 | 0.33 | 3.72 | 14.27 | 21.02 |
| Comparative Example: | | | | | |
| 3-1 | — | — | — | — | — |
| 3-2 | 0.03 | 0.01 | 0.02 | 3.00 | 33.33 |
| 3-3 | 0.54 | 0.00 | 0.38 | — | 30.18 |

*The larger the value is, the more silicon compound is present at surface portion. When it is small, the silicon compound is present also on the inside.
**When the value is 30% or less, silicon-compound-containing particulate matters are judged to stand stuck firmly to one another.

TABLE 7

| | Evaluation Results | | | | |
|---|---|---|---|---|---|
| | Running performance evaluation Charge quantity | | Dot reproducibility | | |
| | Initial stage (mC/kg) | After 100,000 = sheet running (mC/kg) | Initial stage | After 100,000 = sheet running | Fixing performance |
| Example: | | | | | |
| 3-1 | −46.36 | −43.26 | A | B | A |
| 3-2 | −47.96 | −45.69 | A | A | A |
| 3-3 | −45.86 | −44.48 | A | A | B |
| 3-4 | −47.55 | −46.87 | A | A | B |
| 3-5 | −47.59 | −45.69 | A | A | B |
| 3-6 | −47.59 | −46.32 | A | A | A |
| 3-7 | −47.55 | −46.98 | A | A | B |
| 3-8 | −45.23 | −45.24 | A | A | B |
| 3-9 | −40.21 | −36.02 | A | B | A |
| 3-10 | −47.89 | −45.14 | A | A | A |
| 3-11 | −42.14 | −41.53 | B | B | A |
| 3-12 | −42.01 | −41.25 | B | B | A |
| Comparative Example: | | | | | |
| 3-1 | −7.56 | (1) | C | — | A |
| 3-2 | −10.25 | (2) | D | — | A |
| 3-3 | −44.12 | −21.0 | A | C | A |

(1) Toner particles melt-adhered mutually on 3,000th sheet running.
(2) In-machine melt-adhered on 5,000th sheet running.

TABLE 8

| | Characteristics of Toner Particles and Toner | | | | | |
|---|---|---|---|---|---|---|
| | | Si concentration | | | | |
| | Silicon compound used to form coating layer | Particle surface (Si1) (wt. %) | Particle cross section (Si3) (wt. %) | Particle surface after washing (Si2) (wt. %) | State of presence of Si in toner particles (Si1)/(Si3)* | Percent loss of Si concentration after washing (%)** |
| Example: | | | | | | |
| 4-1 | Tetraethoxysilane | 6.39 | 0.07 | 4.76 | 91.29 | 25.51 |
| 4-2 | Hexyltrimethoxysilane | 4.75 | 0.26 | 3.59 | 18.27 | 24.42 |
| 4-3 | (3-Glycidoxypropyl)-methyldimethoxysilane | 5.15 | 0.19 | 4.61 | 27.11 | 10.49 |
| 4-4 | (3-Glycidoxypropyl)-methyldimethoxysilane | 3.91 | 0.13 | 3.12 | 30.08 | 20.20 |
| 4-5 | Tetraethoxysilane | 19.73 | 0.02 | 15.87 | 986.50 | 19.56 |
| 4-6 | Tetraethoxysilane & methyltriethoxysilane | 12.79 | 0.06 | 9.71 | 213.17 | 24.08 |
| 4-7 | (3-Glycidoxypropyl)-methyldimethoxysilane | 4.10 | 4.00 | 3.68 | 1.03 | 10.24 |
| 4-8 | Tetraethoxysilane | 5.78 | 0.06 | 4.88 | 96.33 | 15.57 |
| 4-9 | Tetraethoxysilane | 4.80 | 0.05 | 3.61 | 96.00 | 24.79 |
| 4-10 | Tetraethoxysilane | 20.49 | 1.70 | 14.86 | 12.05 | 27.48 |
| 4-11 | Tetraethoxysilane | 6.05 | 5.32 | 4.55 | 1.14 | 24.79 |
| Comparative Example: | | | | | | |
| 4-1 | No coating layer formed | — | — | — | — | — |
| 4-2 | Tetraethoxysilane | 0.09 | 0.02 | 0.05 | 4.50 | 44.44 |
| 4-3 | Silicone resin coatings | 3.66 | 0.07 | 2.85 | 52.29 | 22.13 |
| 4-4 | External addition | 0.55 | 0.01 | 0.37 | 55.00 | 32.73 |

*The larger the value is, the more silicon compound is present at surface portion. When it is small, the silicon compound is present also on the inside.
**When the value is 30% or less, silicon-compound-containing particulate matters are judged to stand stuck firmly to one another

TABLE 9

| | Properties of Toner and Evaluation Results | | | | | | |
|---|---|---|---|---|---|---|---|
| | Average particle diameter (μm) | Glass transition point: Base particles (° C.) | Toner (Tg) (° C.) | Melt-starting temp. (Mp) (° C.) | Mp-Tg (° C.) | Anti-blocking properties | Fixing performance |
| Example: | | | | | | | |
| 4-1 | 6.39 | 27.86 | 35.71 | 53.95 | 18.24 | A | A |
| 4-2 | 6.78 | 27.86 | 34.55 | 64.69 | 30.14 | A | A |
| 4-3 | 6.89 | 27.86 | 33.08 | 57.64 | 24.56 | A | A |
| 4-4 | 6.57 | 27.86 | 33.60 | 56.24 | 22.64 | A | A |
| 4-5 | 6.59 | 27.86 | 33.48 | 67.72 | 34.24 | A | B |
| 4-6 | 6.82 | 27.86 | 33.52 | 71.41 | 37.89 | A | B |
| 4-7 | 6.22 | 27.86 | 36.45 | 72.99 | 36.54 | A | B |
| 4-8 | 6.62 | 20.13 | 28.69 | 44.11 | 15.42 | A | A |
| 4-9 | 6.44 | 58.63 | 64.18 | 104.40 | 40.22 | A | C |
| 4-10 | 6.32 | 27.86 | 34.55 | 142.40 | 107.85 | A | C |
| 4-11 | 6.25 | 27.86 | 35.83 | 99.57 | 63.74 | A | C |
| Comparative Example: | | | | | | | |
| 4-1 | 6.01 | 27.86 | 27.86 | 32.89 | 5.03 | E | Unable |
| 4-2 | 6.35 | 27.86 | 28.74 | 49.15 | 20.41 | D | A |
| 4-3 | 6.63 | 27.86 | 28.55 | 106.21 | 77.66 | A | D |
| 4-4 | 6.11 | 27.86 | 29.75 | 43.33 | 13.58 | E | A |

What is claimed is:

1. A process for producing a toner, comprising the steps of:

producing toner particles composed of at least a binder resin and a colorant; and building up a polycondensate of a silicon compound on the surfaces of the toner particles from the outside of the particles to form on each toner particle surface a coating layer in a state of particulate matters being stuck to one another; said particulate matters containing at least a silicon compound.

2. The process according to claim 1, wherein said step of producing the toner particles is the step of dispersing in an aqueous medium the toner particles composed of at least a binder resin and a colorant to prepare a toner dispersion; said aqueous medium comprising water or a mixed solvent of water and a water-miscible solvent in which at least a silicon compound has been dissolved; and said step of forming the coating layer is the step of adding the toner dispersion to an aqueous alkaline solvent or a mixed solvent of an aqueous alkaline solvent and water, to allow the silicon compound to undergo polycondensation to build up a polycondensate on the surfaces of said toner particles from the outside of the particles to form on each toner particle surface a coating layer in a state of particulate matters being stuck to one another; said particulate matters containing at least the silicon compound.

3. The process according to claim 1, wherein the quantity of silicon atoms present on the particle surfaces of the toner having had said coating layer formed, as determined by electron probe microanalysis (EPMA) is from 0.1 to 20.0% by weight with respect to the total sum of quantities of carbon atoms, oxygen atoms and silicon atoms.

4. The process according to claim 1, wherein the quantity of silicon atoms present on the particle surfaces of the toner having had said coating layer formed, as determined by electron probe microanalysis (EPMA) is from 0.1 to 10.0% by weight with respect to the total sum of quantities of carbon atoms, oxygen atoms and silicon atoms.

5. The process according to claim 1, wherein the quantity of silicon atoms present on the particle surfaces of the toner having had said coating layer formed, as determined by electron probe microanalysis (EPMA) is from 0.1 to 4.0% by weight with respect to the total sum of quantities of carbon atoms, oxygen atoms and silicon atoms.

6. The process according to claim 1, wherein the quantity of silicon atoms present in the particle cross sections of the toner having had said coating layer formed, as determined by electron probe microanalysis (EPMA) is not more than 4.0% by weight with respect to the total sum of quantities of carbon atoms, oxygen atoms and silicon atoms.

7. The process according to claim 1, wherein the quantity of silicon atoms present in the particle cross sections of the toner having had said coating layer formed, as determined by electron probe microanalysis (EPMA) is not more than 0.1% by weight with respect to the total sum of quantities of carbon atoms, oxygen atoms and silicon atoms.

8. The process according to claim 1, wherein the quantity of silicon atoms present on the particle surfaces of the toner having had said coating layer formed, as determined by electron probe microanalysis (EPMA) is from 0.1 to 20.0% by weight with respect to the total sum of quantities of carbon atoms, oxygen atoms and silicon atoms, and the quantity of silicon atoms present in the particle cross sections of the toner having had said coating layer formed, as determined by electron probe microanalysis (EPMA) is not more than 4.0% by weight with respect to the total sum of quantities of carbon atoms, oxygen atoms and silicon atoms.

9. The process according to claim 1, wherein the quantity of silicon atoms present on the particle surfaces of the toner having had said coating layer formed, as determined by electron probe microanalysis (EPMA) is from 0.1 to 10.0% by weight with respect to the total sum of quantities of carbon atoms, oxygen atoms and silicon atoms, and the quantity of silicon atoms present in the particle cross sections of the toner having had said coating layer formed, as determined by electron probe microanalysis (EPMA) is not more than 0.1% by weight with respect to the total sum of quantities of carbon atoms, oxygen atoms and silicon atoms.

10. The process according to claim 1, wherein the quantity of silicon atoms present on the particle surfaces of the toner having had said coating layer formed, as determined by electron probe microanalysis (EPMA) is from 0.1 to 4.0% by weight with respect to the total sum of quantities of carbon atoms, oxygen atoms and silicon atoms, and the quantity of silicon atoms present in the particle cross sections of the toner having had said coating layer formed, as determined by electron probe microanalysis (EPMA) is not more than 0.1% by weight with respect to the total sum of quantities of carbon atoms, oxygen atoms and silicon atoms.

11. The process according to claim 1, wherein the quantity of silicon atoms present on the particle surfaces of the toner having had said coating layer formed is at least twice the quantity of silicon atoms present in the particle cross sections of that toner.

12. The process according to claim 1, wherein said coating layer is formed of a polycondensate of the silicon compound.

13. The process according to claim 12, wherein said polycondensate of the silicon compound has been formed by the sol-gel process.

14. The process according to claim 12, wherein said coating layer is formed in a state of particulate matters having combined chemically with one another; said particulate matters containing said polycondensate of the silicon compound.

15. The process according to claim 1, wherein said binder resin comprises a resin selected from the group consisting of a styrene resin, an acrylic resin, a methacrylic resin, a polyester resin and a mixture of any of these.

16. The process according to claim 1, wherein said coating layer has been surface-treated with a coupling agent.

17. The process according to claim 16, wherein said coupling agent is capable of reacting silanol groups present on the surface of said coating layer.

18. The process according to claim 1, wherein said toner has a number-average particle diameter of from 0.1 $\mu$m to 10.0 $\mu$m and a coefficient of variation in number distribution of 20.0% or less.

19. The process according to claim 18, wherein the number-average particle diameter of said toner is from 1.0 $\mu$m to 8.0 $\mu$m.

20. The process according to claim 18, wherein the number-average particle diameter of said toner is from 3.0 $\mu$m to 5.0 $\mu$m.

21. The process according to claim 18, wherein the coefficient of variation in number distribution of said toner is 15.0% or less.

22. The process according to claim 18, wherein the coefficient of variation in number distribution of said toner is 10.0% or less.

23. The process according to claim 18, wherein said step of producing toner particles is the step of dissolving at least a polymerizable monomer in a solvent in which a polymerizable monomer for synthesizing a binder resin is soluble but its polymer is insoluble, and polymerizing the polymerizable monomer in the solvent to produce toner particles composed of at least a binder resin and a colorant.

24. The process according to claim 18, wherein said step of producing the toner particles is the step of dissolving at least a polymerizable monomer in a solvent in which a polymerizable monomer for synthesizing a binder resin is soluble but its polymer is insoluble, and polymerizing the polymerizable monomer in the solvent to produce toner particles composed of at least a binder resin and a colorant, to prepare a toner dispersion in which the toner particles have been dispersed; and said step of forming the coating layer is the step of adding the toner dispersion to an aqueous alkaline solvent or a mixed solvent of an aqueous alkaline solvent and water, to allow a silicon compound to undergo polycondensation to build up a polycondensate on the surfaces of toner particles from the outside of the particles to form on each toner particle surface a coating layer in a state of particulate matters being stuck to one another; said particulate matters containing at least the silicon compound.

25. The process according to claim 18, wherein said step of producing the toner particles is the step of dissolving at least a polymerizable monomer in a solvent in which a polymerizable monomer for synthesizing a binder resin is soluble but its polymer is insoluble, and polymerizing the polymerizable monomer in the solvent to produce toner particles composed of at least a binder resin and a colorant, to prepare a toner dispersion in which the toner particles have been dispersed; and said step of forming the coating layer is the step of cooling the toner dispersion to room temperature and adding at least a silicon compound and an alkali in the toner dispersion thus cooled, to allow the silicon compound to undergo polycondensation to build up a polycondensate on the surfaces of toner particles from the outside of the particles to form on each toner particle surface a coating layer in a state of particulate matters being stuck to one another; said particulate matters containing at least the silicon compound.

26. The process according to claim 1, wherein said toner has at least one glass transition point at 60° C. or below, a melt-starting temperature of 100° C. or below and a difference between melt-starting temperature and glass transition point of 38° C. or smaller.

27. The process according to claim 26, wherein said toner further comprises a release agent component in an amount not more than 80% by weight.

28. A process for producing a toner, comprising the steps of:

producing toner particles composed of at least a binder resin and a colorant and having a silicon compound present internally; and allowing the toner particles to react in an aqueous medium selected from the group consisting of water and a mixed solvent of water and a water-miscible solvent, to cause the silicon compound to undergo hydrolysis and polycondensation on the surfaces of the toner particles to form on each toner particle surface a coating layer in a state of particulate matters being stuck to one another; the particulate matters containing at least the silicon compound.

29. The process according to claim 28, wherein said step of producing the toner particles is a step comprising the steps of;

dispersing toner particles composed of at least a binder resin and a colorant and not having a silicon compound present internally, in an aqueous medium selected from the group consisting of water and a mixed solvent of water and a water-miscible solvent to prepare a toner particle dispersion;

dispersing at least a silicon compound in an aqueous medium selected from the group consisting of water and a mixed solvent of water and a water-miscible solvent to prepare a silicon compound dispersion; and adding the toner particle dispersion in the silicon compound dispersion to make the silicon compound permeated into the toner particles to have the silicon compound present internally.

30. The process according to claim 28, wherein the quantity of silicon atoms present on the particle surfaces of the toner having had said coating layer formed, as determined by electron probe microanalysis (EPMA) is from 0.1 to 20.0% by weight with respect to the total sum of quantities of carbon atoms, oxygen atoms and silicon atoms.

31. The process according to claim 28, wherein the quantity of silicon atoms present on the particle surfaces of the toner having had said coating layer formed, as determined by electron probe microanalysis (EPMA) is from 0.1 to 10.0% by weight with respect to the total sum of quantities of carbon atoms, oxygen atoms and silicon atoms.

32. The process according to claim 28, wherein the quantity of silicon atoms present on the particle surfaces of the toner having had said coating layer formed, as determined by electron probe microanalysis (EPMA) is from 0.1 to 4.0% by weight with respect to the total sum of quantities of carbon atoms, oxygen atoms and silicon atoms.

33. The process according to claim 28, wherein the quantity of silicon atoms present in the particle cross sections of the toner having had said coating layer formed, as determined by electron probe microanalysis (EPMA) is not more than 4.0% by weight with respect to the total sum of quantities of carbon atoms, oxygen atoms and silicon atoms.

34. The process according to claim 28, wherein the quantity of silicon atoms present in the particle cross sections of the toner having had said coating layer formed, as determined by electron probe microanalysis (EPMA) is not more than 0.1% by weight with respect to the total sum of quantities of carbon atoms, oxygen atoms and silicon atoms.

35. The process according to claim 28, wherein the quantity of silicon atoms present on the particle surfaces of the toner having had said coating layer formed, as determined by electron probe microanalysis (EPMA) is from 0.1 to 20.0% by weight with respect to the total sum of quantities of carbon atoms, oxygen atoms and silicon atoms, and the quantity of silicon atoms present in the particle cross sections of the toner having had said coating layer formed, as determined by electron probe microanalysis (EPMA) is not more than 4.0% by weight with respect to the total sum of quantities of carbon atoms, oxygen atoms and silicon atoms.

36. The process according to claim 28, wherein the quantity of silicon atoms present on the particle surfaces of the toner having had said coating layer formed, as determined by electron probe microanalysis (EPMA) is from 0.1 to 10.0% by weight with respect to the total sum of quantities of carbon atoms, oxygen atoms and silicon atoms, and the quantity of silicon atoms present in the particle cross sections of the toner having had said coating layer formed, as determined by electron probe microanalysis (EPMA) is not more than 0.1% by weight with respect to the total sum of quantities of carbon atoms, oxygen atoms and silicon atoms.

37. The process according to claim 28, wherein the quantity of silicon atoms present on the particle surfaces of the toner having had said coating layer formed, as determined by electron probe microanalysis (EPMA) is from 0.1 to 4.0% by weight with respect to the total sum of quantities of carbon atoms, oxygen atoms and silicon atoms, and the quantity of silicon atoms present in the particle cross sections of the toner having had said coating layer formed, as determined by electron probe microanalysis (EPMA) is not more than 0.1% by weight with respect to the total sum of quantities of carbon atoms, oxygen atoms and silicon atoms.

38. The process according to claim 28, wherein the quantity of silicon atoms present on the particle surfaces of the toner having had said coating layer formed is at least twice the quantity of silicon atoms present in the cross sections of that toner particles.

39. The process according to claim 28, wherein said coating layer is formed of a polycondensate of the silicon compound.

40. The process according to claim 39, wherein said polycondensate of the silicon compound has been formed by the sol-gel process.

41. The process according to claim 39, wherein said coating layer is formed in a state of particulate matters having combined chemically with one another; said particulate matters containing said polycondensate of the silicon compound.

42. The process according to claim 28, wherein said binder resin comprises a resin selected from the group consisting of a styrene resin, an acrylic resin, a methacrylic resin, a polyester resin and a mixture of any of these.

43. The process according to claim 28, wherein said coating layer has been surface-treated with a coupling agent.

44. The process according to claim 43, wherein said coupling agent is capable of reacting silanol groups present on the surface of said coating layer.

45. The process according to claim 28, wherein said toner has a number-average particle diameter of from 0.1 $\mu$m to 10.0 $\mu$m and a coefficient of variation in number distribution of 20.0% or less.

46. The process according to claim 45, wherein the number-average particle diameter of said toner is from 1.0 $\mu$m to 8.0 $\mu$m.

47. The process according to claim 45, wherein the number-average particle diameter of said toner is from 3.0 $\mu$m to 5.0 $\mu$m.

48. The process according to claim 45, wherein the coefficient of variation in number distribution of said toner is 15.0% or less.

49. The process according to claim 45, wherein the coefficient of variation in number distribution of said toner is 10.0% or less.

50. The process according to claim 45, wherein said step of producing toner particles is the step of dissolving at least a polymerizable monomer in a solvent in which a polymerizable monomer for synthesizing a binder resin is soluble but its polymer is insoluble, and polymerizing the polymerizable monomer in the solvent to produce toner particles composed of at least a binder resin and a colorant.

51. The process according to claim 28, wherein said toner has at least one glass transition point at 60° C. or below, a melt-starting temperature of 100° C. or below and a difference between melt-starting temperature and glass transition point of 38° C. or smaller.

52. The process according to claim 51, wherein said toner further comprises a release agent component in an amount not more than 80% by weight.

* * * * *